US012376646B2

(12) United States Patent
Ophir

(10) Patent No.: US 12,376,646 B2
(45) Date of Patent: Aug. 5, 2025

(54) SHOE AND FOOTWEAR WITH INTEGRATED INSOLE OR SOLE HAVING SAND-CONTAINING CHAMBERS AND HAVING SENSORS AND ELECTRICAL STIMULATION UNITS

(71) Applicant: INSAND LTD., Moshav Nir Banim (IL)

(72) Inventor: Anat Ophir, Moshav Nir Banim (IL)

(73) Assignee: INSAND LTD., Moshav Nir Banim (IL)

( * ) Notice: Subject to any disclaimer, the term of this patent is extended or adjusted under 35 U.S.C. 154(b) by 0 days.

(21) Appl. No.: 18/586,479

(22) Filed: Feb. 25, 2024

(65) Prior Publication Data

US 2024/0188682 A1 Jun. 13, 2024

Related U.S. Application Data

(63) Continuation-in-part of application No. 17/932,378, filed on Sep. 15, 2022, now Pat. No. 11,925,236, (Continued)

(51) Int. Cl.
*A43B 17/00* (2006.01)
*A43B 7/142* (2022.01)
(Continued)

(52) U.S. Cl.
CPC ..... *A43B 17/006* (2013.01); *A43B 7/142* (2013.01); *A43B 7/148* (2013.01); *A43B 17/14* (2013.01)

(58) Field of Classification Search
CPC ..... A43B 17/006; A43B 7/148; A43B 7/142
See application file for complete search history.

(56) References Cited

U.S. PATENT DOCUMENTS 5,005,575 A * 4/1991 Geri ..... A43B 7/1415 36/43
5,261,169 A * 11/1993 Williford ..... A43B 17/102 36/43
(Continued)

FOREIGN PATENT DOCUMENTS

CA 2478749 A1 * 2/2006 ..... A43B 1/0081
DE 4332606 A1 * 6/1994 ..... A43B 17/06
(Continued)

*Primary Examiner* — Megan E Lynch
(74) *Attorney, Agent, or Firm* — AlphaPatent Associates Ltd.; Daniel J. Swirsky

(57) ABSTRACT

A shoe or other footwear has a non-removable multi-layer insole. A middle layer of the insole has apertures that define several discrete storage chambers within the insole. Each storage chamber stores a mixture of particulate or granular materials, such as sand, powdered titanium, powdered aluminum, powdered talcum, powdered zinc. The insole or footwear further includes integrated components such as: electromyogram (EMG) sensors, temperature sensors, pressure sensors, humidity sensors, sweat sensors. The insole or footwear further includes integrated stimulating units, such as: Transcutaneous Electrical Nerve Stimulation (TENS) units, electrodes, infrared radiation units. Data is sensed by the sensors integrated in the insole or footwear, in response to a human foot stepping on the discrete storage chambers that store the particulate or granular materials, and optionally in response to stimulation operations. Data is processed to detect or estimate a medical condition, and to selectively modify operational properties of the stimulation units.

21 Claims, 26 Drawing Sheets

Related U.S. Application Data which is a continuation of application No. 17/027,785, filed on Sep. 22, 2020, now Pat. No. 11,452,336, which is a continuation-in-part of application No. PCT/IL2019/050429, filed on Apr. 16, 2019.

(60) Provisional application No. 62/661,013, filed on Apr. 22, 2018.

(51) Int. Cl.
*A43B 7/148* (2022.01)
*A43B 17/14* (2006.01)

(56) References Cited

U.S. PATENT DOCUMENTS 5,555,584 A * 9/1996 Moore, III ..... A43B 7/28 36/43
5,921,003 A * 7/1999 Kim ..... A43B 1/0045 36/136
6,024,093 A * 2/2000 Cron ..... A43B 1/0027 36/43
6,061,929 A * 5/2000 Ritter ..... A43B 3/122 36/31
6,176,025 B1 * 1/2001 Patterson ..... A43B 7/1445 36/35 B
6,453,578 B1 * 9/2002 Yung ..... A43B 7/22 36/43
7,200,955 B2 * 4/2007 Foxen ..... A43B 7/1445 36/31
2002/0092203 A1 * 7/2002 Hardt ..... A43B 7/142 36/43
2003/0101620 A1 * 6/2003 Reed ..... A43B 13/42 36/43
2006/0010717 A1 * 1/2006 Finkelstein ..... A43B 13/187 36/43
2006/0254088 A1 * 11/2006 McCormick ..... A41D 31/065 36/44
2007/0180734 A1 * 8/2007 Foster ..... A43B 17/003 36/43
2008/0034619 A1 * 2/2008 Van Dyck ..... A43B 7/00 36/11.5
2008/0060221 A1 * 3/2008 Hottinger ..... A43B 13/04 36/11.5
2008/0072451 A1 * 3/2008 Mizrahi ..... A43B 1/0045 36/2.6
2009/0307925 A1 * 12/2009 Pfister ..... A43B 7/223 36/43
2011/0016747 A1 * 1/2011 Bitton ..... A43B 17/08 36/43
2011/0078920 A1 * 4/2011 Tschernjaew ..... A43B 17/102 36/44
2011/0099845 A1 * 5/2011 Miller ..... A43B 7/145 36/91
2012/0324758 A1 * 12/2012 Tang ..... A43B 7/144 36/28
2013/0333243 A1 * 12/2013 Dushey ..... A43B 3/103 36/94
2014/0075779 A1 * 3/2014 Bruce ..... A43B 7/148 36/29
2016/0095378 A1 * 4/2016 Kriegel ..... A43B 3/0078 36/11.5
2017/0027277 A1 * 2/2017 Anthony ..... A43B 7/1463
2017/0202300 A1 * 7/2017 Sherman ..... A43B 13/386
2017/0295885 A1 * 10/2017 Stern ..... F16F 15/04
2018/0000196 A1 * 1/2018 Lovell ..... A43B 7/148
2018/0168282 A1 * 6/2018 Tanaka ..... A43B 7/142
2020/0077741 A1 * 3/2020 Hurd ..... A43B 13/04
2020/0245726 A1 * 8/2020 Hartmann ..... A43B 13/42
2020/0375307 A1 * 12/2020 Hurd ..... A43B 13/188

FOREIGN PATENT DOCUMENTS

EP 2939557 A1 * 11/2015 ..... A43B 13/41
KR 20110043584 A * 4/2011
WO WO-2018169537 A1 * 9/2018 ..... A43B 1/0072

* cited by examiner

SHOE AND FOOTWEAR WITH INTEGRATED INSOLE OR SOLE HAVING SAND-CONTAINING CHAMBERS AND HAVING SENSORS AND ELECTRICAL STIMULATION UNITS

CROSS-REFERENCE TO RELATED APPLICATIONS

This patent application is a Continuation-in-Part (CIP) of U.S. Ser. No. 17/932,378, filed on Sep. 15, 2022, which is hereby incorporated by reference in its entirety; which is a Continuation of U.S. Ser. No. 17/027,785, filed on Sep. 22, 2020, now patent number U.S. Pat. No. 11,452,336 (issued on Sep. 27, 2022), which is hereby incorporated by reference in its entirety; which is a Continuation-in-Part (CIP) of PCT international application number PCT/IL2019/050429, having an international filing date of Apr. 16, 2019, published as international publication number WO 2019/207569 A1, which is hereby incorporated by reference in its entirety; which claims priority and benefit from U.S. 62/661,013, filed on Apr. 22, 2018, which is hereby incorporated by reference in its entirety.

FIELD

The present invention relates to the field of shoes and footwear.

BACKGROUND

Millions of people worldwide wear shoes and other types of footwear on a daily basis. For example, shoes protect and comfort the human feet while a person is standing, walking, running, or performing other activities. Some shoes are worn as a fashion article; and some types of footwear articles are worn for specific purposes. For example, rain-boots are often worn to protect the human feet from becoming wet on a rainy day or when the ground is covered with water.

SUMMARY

Some embodiments provide a shoe or other footwear has a non-removable multi-layer insole. For example, a middle layer of the insole has apertures that define several discrete storage chambers within the insole. Each storage chamber stores a mixture of particulate or granular materials, such as sand, powdered titanium, powdered aluminum, powdered talcum, powdered zinc. The insole or footwear further includes integrated components such as: electromyogram (EMG) sensors, temperature sensors, pressure sensors, humidity sensors, sweat sensors. The insole or footwear further includes integrated stimulating units, such as: Transcutaneous Electrical Nerve Stimulation (TENS) units, electrodes, infrared radiation units. Data is sensed by the sensors integrated in the insole or footwear, in response to a human foot stepping on the discrete storage chambers that store the particulate or granular materials, and optionally in response to stimulation operations. Data is processed to detect or estimate a medical condition, and to selectively modify operational properties of the stimulation units.

Some embodiments of the present invention comprise an insert or insole (e.g., an insertable/removable/replaceable/detachable insole or insert or layer) for a shoe or for other footwear article (e.g., for a boot, for a sandal, for sneakers, or the like), and particularly a removable and/or detachable and/or replaceable and/or detachable shoe-insert or footwear-insert or insole that a user may easily insert into (and later, easily remove from) a shoe or other footwear article. The insert or insole of the present invention has or comprises therein one or more pockets, or particularly (for example) two pockets or three pockets; such as, a front-side pocket beneath the fore-foot, and a side pocket (or a side set-of-pockets) below the median arch of the foot, and a rear pocket beneath the heel. Each one of these pockets comprises or contains or stores therein a particulate or granular or powdered combination or mixtures of two or more materials.

In some embodiments, each one of those insole pocket may store a mixture of materials, which may include, for example: (A) "kinetic sand", together with (mixed with) air, or in vacuum (e.g., without any air in such pocket); or sand and/or silica and/or quartz, and/or fine-grained and/or powdered sand and/or silica and/or quartz; and (B) further mixed with powdered aluminum or powdered titanium or powdered zinc or powdered magnesia (powdered MgO, powdered magnesium oxide), powdered silver or other powdered metal, particularly having anti-bacterial properties, or other anti-bacterial agent, or air; and (C) powdered or fine-grained talcum and/or cork and/or wood and/or coal, or air.

In some embodiments, an article includes an insole which includes at least a base layer, and a plurality of discrete elastic shape-shifting pockets that are attached to the base layer and are protruding upwardly relative to the base layer. Each pocket stores a mixture of two or more particulate materials. At least one particulate material is: natural sand, synthetic sand, artificial sand, kinetic sand, silica, or quartz. At least one other particulate material is: powdered aluminum, powdered titanium, powdered zinc, powdered magnesia, powdered silver, air, powdered anti-bacterial agent, powdered metal, powdered talcum, grained cork, grained coal, or grained wood. The article is implemented as a stand-alone replaceable insole for a shoe; or as an integral part of a sole of a shoe; or as a sock.

Each such insole pockets or cavities or chambers storing such unique combination or mixture of these materials, operates as a Short-Term memory layer and provides dynamically-changing support and/or comfort to the human wearer, while enabling each pocket to separately and/or discretely shape-shift in response to dynamic movement by the wearer, and/or while creating stimulus to the foot to engage with the insole pocket(s), thereby increasing blood flow towards or within the foot, preventing or mitigating thrombosis, reducing anxiety, increasing attention span and focus (for some users), providing tactile stimulus, and/or providing other benefits.

Some embodiments of the present invention may further comprise a shoe or other footwear article, or a sock or legging or stocking, which has a pre-produced or integral or integrated or built-in sole or insole or sole-layer or internal lining, which may have or may comprise such built-in or integral pocket(s) having such unique mixture in them.

The present invention may provide other and/or additional advantages and/or benefits.

DETAILED DESCRIPTION OF SOME DEMONSTRATIVE EMBODIMENTS OF THE PRESENT INVENTION

Figure 1A:
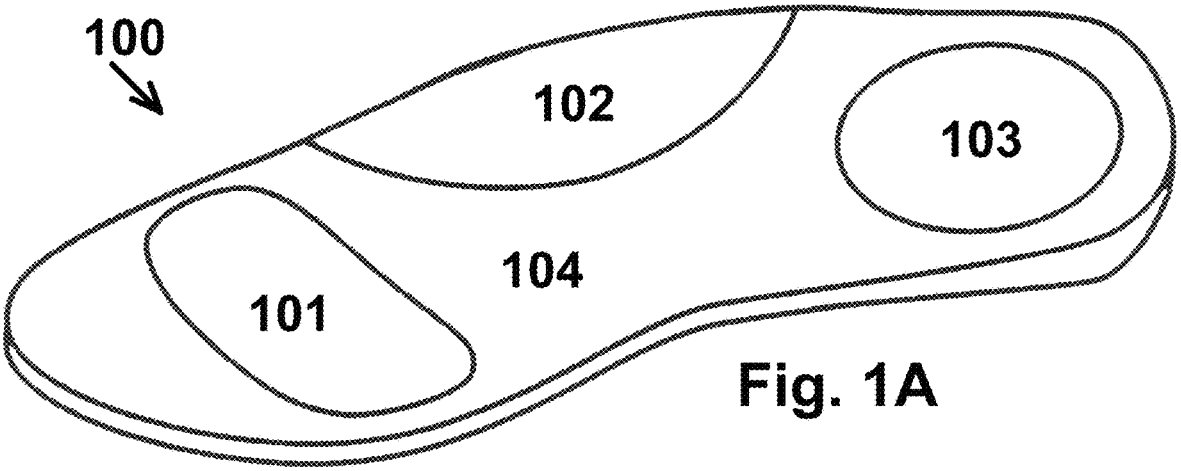
FIG. 1A is a schematic illustration of an insole or insert, in accordance with some demonstrative embodiments of the invention.

The terms "shoe" or "shoes" or "footwear" or "footwear article(s)", as used herein, may include any suitable type of shoe or shoes or footwear which may comprise a sole and/or which may accommodate therein (or therein) a removable or detachable or insertable or replaceable insert or footwear-insert or insole or insole-layer; including, for example, casual shoes, formal shoes, athletic shoes, sports shoes, sneakers or sneaker shoes, shoes or footwear formed of leather and/or rubber and/or plastic materials and/or fabric, dress shoes, casual shoes, slip-on shoes, high-heel shoes or high-heeled footwear, mules or "mule" type shoes, sling-back shoes, clogs, platform shoes, sandals, open-toe shoes, boat shoes, slippers, shoes for indoor use, shoes for outdoor use, boots, rain-boots, ski boots, hiking boots, dance shoes, tap shoes, military shoes, orthopedic shoes, flip-flops, and/or other suitable types of footwear.

The terms "insole" or "insert" or "shoe-insert" or "footwear-insert" as used herein may include, for example, a removable shoe-insert or footwear-insert or a layer or a cushioning-layer or an augmented-layer that can be inserted by a human wearer into a shoe (or into a footwear) without utilizing insertion tools and/or without using attachment tools and/or without using attachment materials (e.g., glue), and/or such shoe-insert or footwear-insert which may be removable by a human wearer from a shoe (or from a footwear) without utilizing extraction tools and/or without utilizing removal tools.

The term "sole" as used herein may include, for example, a bottom part or bottom region or bottom area or bottom layer(s) of a shoe (or of a footwear) which separates between the ground and the bottom-side of the foot of the human wearer; for example, a "sole" of a shoe (or of other footwear) may comprise or may correspond to three layers: a removable or non-removable "insole" which is the top-layer of the sole (e.g., which directly touches the bottom-side of the human foot, and does not touch the ground that the human wearer walks on), an "outsole" which is the bottom layer of the sole (e.g., which directly touches the ground, and which does not directly touch the foot of the human wearer), and a "mid-sole" or "midsole" which is a middle layer of the sole and is sandwiched or trapped between the insole (the upper layer of the sole) and the outsole (which is the bottom layer of the sole).

The Applicants have realized that some conventional shoes or footwear articles (e.g., boots, sandals, sports shoes, or the like) may provide some protection or support to the human wearer; however, many users may still feel discomfort or inconvenience when wearing their shoes (or footwear), particularly after elongated period of times, such as after wearing the shoes continuously for eight hours (e.g., at work in school, or the like).

The Applicants have realized that some users desire to relieve or reduce the discomfort, by adding or inserting into their shoes an insertable insole or an insert, such as formed of rubber or sponge, in order to provide some comfort; or, some users choose to wear particular types of shoes that have insoles that already comprise a built-in or integrated sole having a cushioning layer, such as formed of foam material or sponge material.

However, the Applicants have realized that such conventional inserts, insertable insoles, or built-in soles, may operate—at most—as a Long-Term Memory Layer, which assumes within a few minutes or hours or days particular fixed shape and/or form and/or spatial structure that correspond to the footprint of the human wearer during that time-frame, and then continue to assume the same fixed shape and form and spatial structure generally continuously for months or even years, and they do not return back to their original form and/or they do not dynamically change their form or shape or structure from one day to the next day or from one hour to the next hour.

The Applicants have further realized that a human wearer may have a different or a slightly-different footprint, each time that he or she utilizes a shoe or an insole or insert, due to one or more reasons or causes or conditions that were identified by the Applicants; for example, a shoe and/or a sole and/or an insert and/or an insole may slightly expand or shrink due to temperature changes or due to other environmental changes (e.g., becoming wet or slightly wet or moist, from rain or from water or even from human sweat); similarly, a human foot may expand or swell or bloat due to temperature changes or due to a medical condition or due to other reasons that may cause feet to swell or to bloat or to conversely shrink in size or reduce in size (e.g., pregnancy; diabetics; cancer; malnutrition; dieting; over-eating); furthermore, an insert and/or an insole may slightly move within the shoe (or the footwear) from one wearing-session to a subsequent wearing-session, since the insole or insert is typically non-glued to the shoe itself, and is still free to slightly move—even by 1 or 2 or 5 millimeters, forward and/or backward and/or sideways—such as due to the friction force or the pushing force or the pulling force that the user applies when he inserts his foot into the shoe and/or when he removes his foot from the shoe, thereby causing slight (yet important) movements of the insole or insert; due to wear-and-tear of the shoe and/or the sole and/or the insert and/or the insole; due to the time-of-day or the time-frame in which the user wears the shoe, or the level of effort or tiredness of the user or the type of activity that the user performs. For example: user Adam wears his shoes and insoles and applies to them great pressure when he walks (or runs), but applies to them smaller pressure when he sits, and the Long-Term Memory Layer fails to respond to the two different levels of pressure in these two different activities; similarly, user Janet applies to her shoes or insoles a greater amount of pressure at 9 AM when she starts her workday, but applies to her same shoes or insoles a smaller amount of pressure at 5 PM when she ends her workday and is tired; or the like.

Moreover, the Applicants have realized that a conventional insole or sole or insert, even if formed with Long-Term Memory properties, fails to dynamically accommodate itself and/or its three-dimensional shape to the continuous and dynamic changes in foot-pressure that is applied to different areas or regions of the insole (or sole, or insert) as a person is walking or running; for example, even during a walking activity, the wearer applies different levels of pressure (e.g., in the front side, or in the back side, of the foot) when he lifts his foot off the ground, or when he presses his foot into (or towards) the ground, or when his foot (and his shoe) travel(s) momentarily in the air between two steps, or the like.

The Applicants have developed a unique and novel insole or shoe-insert or footwear-insert or removable insole, as well as a built-in insole or integrated insole which may be an integral part of a sole of a shoe (or of other footwear) or may be an integral part of a sock or stocking or legging, which operates as a Short-Term Memory Layer: once it comes into contact with, or under pressure of, the foot of the human wearer, it rapidly or immediately or instantly assumes the shape or form or structure of the particular wearer's foot; but then, once the human wearer removes his or her foot from the shoe (or sock, or insole), or once the human wearer slightly moves his foot within the shoe or within the sock or on top of the insole, the unique shape-shifting layer dynamically and rapidly or instantly or immediately assumes its original or idle or non-pressed position or spatial structure or shape or form, or it "springs back" (immediately, or gradually within a second or two seconds or three seconds) to its original spatial structure, or it transforms or shape-shifts back to a form that is generally similar to its original non-pressed spatial structure; such that the next time that the wearer utilizes that insole with that shoe (or footwear), or the next time that the wearer puts on that shoe (with integrated insole) or that sock (with integrated insole), the unique insole or insert again dynamically assumes a new, fresh, current structure that accommodates the new, fresh, current foot-print of the wearer, which may be slightly different from the previous foot-print due to one or more reasons.

Moreover, the insole or insert or sole of the present invention, which may be a stand-alone removable insole or may be integrated within a shoe or a footwear or a sock or stocking or legging, may dynamically shape-shift or may dynamically change its form or shape or three-dimensional structure, not only from one day to the next day; but also, in a dynamic and continuous manner, during the same wearing-session, accommodating and adapting its spatial structure to the ongoing changes in the amount or directions of pressure that the user applies towards the insole or insert or sole; and dynamically adjusting its three-dimensional properties to accommodate such changes and to provide increased comfort and convenience to the user under changing conditions.

In accordance with the present invention, an insert or a shoe-insert or a footwear insert, or an insertable insole or removable insole or detachable insole or replaceable insole, or a sole (or a sole-layer) of a shoe or of a footwear or a sock or a stocking, may comprise one pocket, or two pockets, or three pockets, or four pockets, or five pockets, or other number of discrete or separate pockets, or a set of insole pockets that are entirely separate from each other and do not share any common edge or panel or border, or a set of insole pockets that are discrete from each other (e.g., such that the content in Pocket A does not mix with the content in Pocket B) yet may share a common panel or edge or border, or a combination or such pockets which may be of the same type or may be of different types. Each one of such insole pockets may comprise, for example: Kinetic Sand with air; or, exclusively Kinetic Sand (e.g., without air; being trapped with a vacuum in such pocket); or, a combination or mixture of materials, such as: sand and/or silica and/or quartz, and/or fine-grained sand and/or powdered sand, and/or fine-grained silica and/or powdered silica, and/or fine-grained quartz and/or powdered quartz, and/or gross-grained sand and/or gross-grained silica and/or gross-grained quartz; and (B) further mixed with powdered aluminum and/or powdered titanium and/or powdered zinc and/or powdered magnesia (MgO) and/or powdered silver and/or other powdered metal, particularly having anti-bacterial properties, or other anti-bacterial agent, or air; and (C) powdered or fine-grained talcum and/or cork and/or wood and/or coal.

In accordance with some embodiments of the present invention, the particular combinations or mixtures of materials, is not merely heavy and hard sea-sand or beach-sand or regular sand; and such unique combination or mixture of which mixes together (in the same insole pocket) two or more materials, is not merely a "sand-like" material, and has unique properties of Short-Term Memory and does not have a property of Long-Term Memory; and the mixture that is enclosed in a Sealed Insole Pocket together with Air (e.g., at a particular ratio of Materials Mixture to Air), has properties of Short-Term memory/Short-Term three-dimensional shape retention, instead of having a property of Long-Term three-dimensional shape retention; and it remains dynamically accommodating to the dynamically-changing footprint and/or the pressures and/or the forces that are applied by the human wearer as long as there are indeed or actually applied, and to the extent that they are indeed or actually applied; and, it springs-back or shape-shifts back (entirely, or at least partially, or gradually within a few seconds or within a few minutes) to its original or idle or non-pressed position or its original three-dimensional shape or structure once such forces or pressures are no longer applied (entirely or partially), and/or it dynamically adjusts or dynamically modifies its three-dimensional shape or structure in response to dynamically-changing forces or pressures that are applied by the human user (e.g., throughout the day, as the human wearer is alert or is tired, as the human wearer engages in different types of activities such as running or walking or sitting or standing or resting, or the like); and/or, such insole pocket containing such unique mixture may be continuously shape-shifting or modifying its shape or three-dimensional structure and does not remain in a constant shape or a fixed or long-term three-dimensional structure.

In accordance with some embodiments, Kinetic Sand that may be utilized inside a Pocket of an insole or an insert or a sole or a shoe or a sock; and such Kinetic Sand may be produced in one or more suitable manners, or may comprise one or more suitable materials; for example: mixture of M percent sand with N percent additive(s); mixture of M percent silica or silica-sand with N percent additive(s); mixture of M percent beach-sand or sea-sand with N percent additive(s); mixture of M percent quartz or quartz-sand or quartz-based sand, with N percent additive(s); and/or other suitable mixtures or combinations of materials. In some embodiments, the value of M may be, for example: 100 percent; or 99.5 percent; or 99 percent; or 98.5 percent; or 98 percent; or 97 percent; or 95 percent; or 92 percent; or 90 percent; whereas the value of N (the additive(s)) is equal to 100-N percent of the mixture. In some embodiments, the value of M may be, for example: M>99.9 percent; or M>99.5 percent; or M>99 percent; or M>98.5 percent; or M>98 percent; or M>97 percent; or M>95 percent; or M>92 percent; or M>90 percent; whereas the value of N (the additive(s)) is equal to 100-N percent of the mixture.

In some embodiments, one or more types of Kinetic Sand may be used in each pocket; and such types may be, for example, one or more (or a mixture of) the following: a commercial material known as "Kinetic Sand" which is a modeling sand toy, made (for example) by "Spin Master Ltd" of Toronto, Ontario, Canada (e.g., available for purchase on its website: www.SpinMaster.com; or available for purchase in "Walmart" stores or in "Target" stores in the United States); moldable sand; sand that sticks only to itself, and does not stick to anything else; modelling sand; shapeable sand which can be shaped into a desired shape and then momentarily assumes or retains that shape before springing back or forming back its previous position or shape; sand that does not dry out; sand that remains soft and does not become rigid over time; a mixture or combination of M percent sand with N percent polydimethylsiloxane or PDMS or Liquid Polymerized Siloxane (where M:N are, for example, 99:1, or 99:0.5, or 98:2, or 98.5:1.5, or 97:3, or 97.5:2.5, or 96:4, or 95:5); a mixture or combination of M percent sand with N percent Silicone Oil (where M:N are, for example, 99:1, or 99:0.5, or 98:2, or 98.5:1.5, or 97:3, or 97.5:2.5, or 96:4, or 95:5); a mixture or combination of M percent sand with N percent oil (where M:N are, for example, 99:1, or 99:0.5, or 98:2, or 98.5:1.5, or 97:3, or 97.5:2.5, or 96:4, or 95:5); a mixture of combination of M percent sand with N percent oil (where M:N are, for example, 99:1, or 99:0.5, or 98:2, or 98.5:1.5, or 97:3, or 97.5:2.5, or 96:4, or 95:5); a mixture of combination of M percent sand with N percent shaving creme (where M:N are, for example, 99:1, or 98:2, or 97:3, or 96:4, or 95:5, or 92:8, or 90:10; or, where M is, for example, M>90, or M>92, or M>95, or M>97, or M>98, or M>99); or a mixture or combination of sand with liquid glue and/or with liquid starch (e.g., wherein the sand is at least 90 percent of the mixture; wherein the mixture is optionally warmed or cooked for 3 or 4 or 5 or 6 hours at approximately 110 or 120 or 130 or 150 degrees Fahrenheit. In some embodiments, the Kinetic Sand may have high thermal resistance; and/or may have high viscosity.

In some embodiments, all the pockets may contain the same material(s), for example, all the pockets containing Kinetic Sand and air; or, all the pockets containing only Kinetic Sand without any air; or all the insole pockets containing the exact same materials that are mixed (in each pocket) at exactly the same ratio. In other embodiments, one (or more) of the insole pockets contains Kinetic Sand with air, whereas one (or more) other pockets of the same insole or insert or sole may contain Kinetic Air in vacuum (without any air); or, one or more of the insole pockets contains a first combination of materials (e.g., fine-grained silica mixed with powdered talcum and mixed with powdered titanium), whereas one or more pockets of the same insole may contain a second, different, combination of materials (e.g., the same materials but at different mixture ratio; or, a set of different materials, such as gross-grained quartz with powdered silver and with fine-grained cork). In some embodiments, an insole or insert or sole or shoe may comprise two or more pockets; for example, a first pocket containing Kinetic Sand and Air (or other mixture of other materials) at a ratio of K1 to A1; and a second pocket containing Kinetic Sand and Air (or other mixture of other materials) at a different ratio of K2 to A2. In some embodiments, A1 or A2 may optionally be zero; or, K1 or 2 may optionally be 100 percent.

In some embodiments, optionally, the ratio of Kinetic Sand to Air, denoted as the ratio K:A, in a pocket of such insole or insert or sole or shoe, may be for example one of the following ratio: 99:1, or 98:2, or 97:3, or 95:5, or 92:8, or 90:10, or 85:10, or 80:20, or 75:25, or 70:30, or 67:33, or 66:34, or 60:50, or 55:45, or 51:49, or 50:50.

In some embodiments, optionally, the ratio of Kinetic Sand to Air, may be denoted as the ratio K:A, and the value of K (when expressed as percentile value) may be, for example: K=100%; or K=99%; or K<99%; or K=98%; or K<98%; or K=97%; or K<97%; or K=95%; or K<95%; or K=92%; or K<92%; or K=90%; or K<90%; or K=85%; or K<85%; or K=80%; or K<80%; or K=75%; or K<75%; or K=70%; or K<70%; or K=67%; or K<67%; or K=66%; or K<66%; or K=60%; or K<60%; or K=55%; or K<55%; or K=51%; or K<51%; or K=50%.

Similarly, the above-mentioned ratio values of K to A, may be used wherein K denotes the weight or the volume of the mixture of non-air materials within the insole pocket, whereas A denotes the weight or volume of the air within the insole pocket. In some embodiments, each pocket, or some of the pockets, or all of the pockets, may contain zero air trapped or stored inside them; such that each such pocket comprises, exclusively, the unique mixture of non-air materials, trapped or closed with vacuum in such air-less pocket. Such air-less pockets, filled with such combination of powdered or granular or particulate materials, may me manufactured in one or more suitable processes; such as, generally similar to a process in which an air-free bag of powdered coffee is manufactured and sealed, or in other suitable production ways.

In some embodiments, each pocket (or, at least one pocket) of the insole or sole or insert, contains more Kinetic Sand (or: non-air materials) than Air (e.g., by volume; by weight; or by volume and by weight).

In some embodiments, an insole or an insert may be produced as a "universal" item that can fit into or can be insertable into a variety of different shoes or footwear items; or, as a size-based item which is produced or provided in certain discrete sizes (e.g., US size 9, US size 9.5, US size 10, with optional sub-categories of sizing for males, for females, and for children or minors). Due to the unique utilization of the Kinetic Sand and/or unique mixture(s) in the pocket(s), the insert or insole may dynamically and/or autonomy modify its own three-dimensional shape or structure (e.g., its own height, length, and/or width, at particular portions or regions thereof) in order to dynamically accommodate or fit itself the particular (e.g., changing, momentary) anatomy and/or physiology and/or structure of the foot of the human wearer.

The insert or insole has Short Term Memory properties, such as, it retains its three-dimensional structure or shape as long as the foot that presses on it indeed remains pressing on it; but it springs-back or modifies its shape back into another shape (e.g., its original or non-pressed or idle state or shape) once such pressure is removed or is reduced (e.g., immediately, or substantially immediately, or gradually within 1 or 3 or 5 or 10 or 15 or 30 or 60 seconds of removal or reduction of such pressure or forces). Accordingly, the insole or insert maintains its functionality and efficiency over time, over weeks and months and even years; in contrast with, for example, a conventional Long-Term Memory Foam that retains its pressed position after a few hours or days or weeks of utilization and pressure absorption. The insole or insert of the present invention thus dynamically responds to (and accommodates) the momentary and/or current and/or ever-changing three-dimensional shape of the foot of the human wearer, particularly when he or she walks or runs or even stands or sits or rests, instead of producing resistance to the movement or the shape-change of the human foot.

In some embodiments, the insert or insole or sole of the present invention, may optionally comprise multiple layers; for example, two layers or three layers or four layers.

For example, a first layer of the insole or insert or sole may be formed of a foamed material, such as foamed latex, or latex foam, or polyurethane, or foamed polyurethane, or polyurethane foam, or sponge, or rubber, or other suitable polymer or materials which is generally elastic and/or non-rigid (e.g., can be folded or bent easily by an average human user applying force with his hand), and optionally being generally light-weight. This first layer may operate as a "base layer" or a "basis layer", onto which—or into which—the one or more pockets of Kinetic Sand are attached or inserted or connected or glued or sewn or mounted. This first layer provides support and convenience to the foot, and absorbs shocks or forces or pressures that the foot encounters when it meets the ground during walking or running or standing. Additionally or alternatively, this first layer may further operate as a non-slip basis or layer, which prevents the entirety of the insole or insert from slipping or moving within the shoe (or the footwear), and/or which reduces the movement of such insert or insole relative to the shoe or within the shoe.

The first layer may be formed of latex foam, or foamed latex; for example, formed of natural (non-artificial) material which has high durability; having a level of ventilation and/or compressibility and/or degree of compression that are suitable and convenient for a human wearer; providing to the human wearer support that responds to the points of pressure, without negatively affecting the movement or transport of liquids or blood within the human body. In some embodiments, optionally, the first layer may be formed of latex or foamed latex or latex foam, having one or more anti-bacterial properties and/or anti-microbial properties, or may be coated with (or may be mixed with) an anti-bacterial agent and/or an anti-microbial agent.

The first layer may optionally be formed of polyurethane, or polyurethane foam, or foamed polyurethane; which may have high resistance to wear-and-tear, may be cost effective, may have anti-bacterial properties which may reduce or eliminate offensive odors and/or may limit the growth of bacteria or fungus, thereby enabling utilization of the product in hot and/or high-moisture environments; having resistance to tearing and breaking, having ability to be glued or connected to other layer(s) or element(s) of the product; being light-weight, having the ability to be painted and to retain such paint layers; having a relatively low fusion temperature, with resistance to oily materials; and optionally having anti-static properties which may thus reduce the tendency of the product to attract static electrical charge.

The first layer may be formed of other materials; for example: Polystyrene; foamed Polystyrene; Polystyrene foam; Polyethylene; Polyethylene foam; foamed Polyethylene; Ethylene Vinyl Acetate (EVA); poly EVA (PEVA); foamed polymer(s); elastomeric polymer(s); foamed elastomeric polymer(s); thermoplastic material(s); foamed thermoplastic material(s); or the like.

In some embodiments, the first layer may be formed of other materials, for example: Plastazote®; DynaFoam®; Spenco®; PORON®; Orthopedic Felt; and/or other material(s).

The second layer may contain, or may host, or may be attached to, the one or more Pockets having therein the mixture of materials. Each such pocket may be entirely and hermetically closed and sealed, to prevent the material from escaping or leaking; and such closing may be achieved, for example, by gluing or bonding together a top-layer of the insole and a bottom-layer of the insole while they sandwich or trap within them the middle-layer which has holes or cut-outs or cavities or windows or apertures or slits that thus store the mixture of materials. Such pocket(s) may thus be formed of latex and/or plastic and/or nylon and/or polymer(s) and/or rubber, or from an elastic and/or thermoplastic polymer, or from thermoplastic polyurethane (TPU), or from flexible vinyl or from flexible polyvinyl or from flexible polyvinyl chloride (PVC), and/or may be formed via a top layer made of Spandex or Lycra or Elastane or other fabric or textile, and/or from other suitable synthetic material and/or natural material.

Each insole pocket may be formed as a thin and elastic container; in some embodiments, the container of the pocket may be transparent, to allow the mixture of materials to be visible or partially visible to the user. Each pocket is hermetically sealed, for example, by using glue, bonding, heat, welding, and/or other mechanisms. Optionally, a pocket may be coated with (and/or may contain therein) one or more anti-bacterial agents and/or anti-microbial agents and/or anti-fungus agents.

In some embodiments, the two or more pockets may be entirely discrete and separate from each other, except that they may all be mounted on (or glued to, or connected to, or attached to) the same layer of insole or insert (e.g., the "first layer" described above, formed of foamed latex or polyurethane or other material). In other embodiments, the two or more pockets may optionally be interconnected to each other, via a wire or a thread or via several wires or threads. In still other embodiments, the two or more pockets may be implemented as a set of multiple pockets that are interconnected via a thin channel that is also filled with the same material and/or with the same or other mixture of materials and/or with Kinetic Sand (e.g., if such implementation is efficient due to production considerations). In some embodiments, the pocket(s) may be mounted on, or inserted into, corresponding holes or overtures or apertures or slits in the first layer, or may be glued into or attached into craters or channels or valleys in the first layer. In some embodiments, optionally, the pockets and the first layer (or, the pockets and the first and second layers; or, the pockets and all three layers) may be implemented as a single integrated unit which is produced in a single process or in a two-step process.

In a demonstrative embodiment, each sealed pocket out of the two or three (or more) pockets of the insole or insert or sole, contains a mixture of materials, at a particular ratio (of weight and/or volume). The pocket thus responds to the dynamics of the human foot; the mixture of materials in the pocket becomes temporarily compressed or short-time compressed upon absorption of force or pressures. Upon release or reduction of such applied forces or pressures, the pocket with such mixture of materials returns to its original and/or idle state or shape or structure, such as over a period of 1 or 3 or 5 or 10 or 30 or 60 seconds; the gradual return being complete, or being at least partial or dominant (e.g., at least 50 percent of the previous shape or structure is re-acquired by the pocket); thereby responding dynamically to minute changes in the position or location of parts of the human foot, without producing resistance to the movement or motion of the human body. The pockets with the mixture of materials may further enable better or improved division or spreading of the weight of the human body onto the footprint(s) of that human, thereby reducing inconvenience and pain as well as inflammations and maladies. The pockets with mixture of materials may further provide to the user a feeling of walking or stepping on the beach, or on sand or beach sand or sea sand.

The size, the volume, the location, the shape and/or the weight of each pocket and its stored materials, as well as the selection of the stored materials and their ratio, may be configured or determined or defined in order to achieve particular implementation goals. For example, the Applicants have realized that two pockets with a particular mixture—a rear-side pocket that supports the heel or the hind foot or the back-side of the foot, and a front-side pocket that supports the fore foot or the toes or the front-side of the foot—is a suitable dual-pocket structure that is particularly suitable for an Open or Generally-Open footwear, such as an open shoe, a sandal, a flip-flop, a clog, or the like; whereas, a triple-pocket structure, having also an additional mid-foot pocket that supports the mid-foot or the medial longitudinal arch or the mid-area of the foot, is more suitable for a Closed or Generally-Closed footwear, such as sneakers, sports shoes, athletic shoes, boots, rainboots, or the like.

In some embodiments, the rear-side pocket or the hind-foot pocket, is located at a rear-side area of the insole or insert or sole, or at the area that is intended to be stepped-on or pressed-by or pressured-by the heel of the user or the hind foot of the user or the rear-side of the foot of the user. The rear-side pocket may contain, for example between 10 to 40 grams of particulate materials; or, between 12 to 35 grams of particulate materials; or, between 15 to 30 grams of particulate materials; or, between 20 to 25 grams of particulate materials; or, between 10 to 15 grams of particulate materials; or, between 15 to 20 grams of particulate materials; or, between 20 to 25 grams of particulate materials; or, between 25 to 30 grams of particulate materials; or, between 30 to 35 grams of particulate materials; or, between 35 to 40 grams of particulate materials; or, between 10 to 20 grams of particulate materials; or, between 20 to 30 grams of particulate materials; or, between 30 to 40 grams of particulate materials. The Applicants have realized that these particular values and/or ranges, may be particularly beneficial and/or advantageous, as being sufficient and/or suitable in order to provide adequate convenience and comfort to the user; taking into account, also, that an insufficient weight of particulate materials in this pocket may fail to achieve its purposes of providing support and comfort to the user, whereas an excessive weight of particulate materials in this pocket (and/or in other pocket(s)) may cause the insert or the insole or the entire shoe or footwear to become excessively heavy or inconveniently heavy and such excessive weight may actually increase the user's discomfort instead of reducing it. In some embodiments, the cross-section of the rear-side pocket (e.g., when sliced generally parallel to the ground, or generally horizontally) may be a circle, or an oval, or an elliptic shape, or egg shape. The rear-side pocket with particulate materials, particularly due to said shape or structure, may further enable transfer or forward shifting or division of the pressure from some of the weight of the human wearer, forwardly towards the front-side of the foot, thereby reducing the pressure or force that is applied on the heel or the hind foot of the wearer.

In some embodiments, the front-side pocket or the fore-foot pocket, is located at a front-side area of the insole or insert or sole, or at the area that is intended to be stepped-on or pressed-by or pressured-by the toes of the user or the fore foot of the user or the front-side of the foot of the user. The front-side pocket may contain, for example between 3 to 15 grams of particulate materials; or, between 5 to 12 grams of particulate materials; or, between 5 to 10 grams of particulate materials; or, between 6 to 8 grams of particulate materials; or, between 3 to 6 grams of particulate materials; or, between 6 to 10 grams of particulate materials; or, between 10 to 15 grams of particulate materials; or, between 3 to 10 grams of particulate materials. The Applicants have realized that these particular values and/or ranges, may be particularly beneficial and/or advantageous, as being sufficient and/or suitable in order to provide adequate convenience and comfort to the user; taking into account, also, that an insufficient weight of particulate materials in this pocket may fail to achieve its purposes of providing support and comfort to the user, whereas an excessive weight of particulate materials in this pocket (and/or in other pocket(s)) may cause the insert or the insole or the entire shoe or footwear to become excessively heavy or inconveniently heavy and such excessive weight may actually increase the user's discomfort instead of reducing it. In some embodiments, the cross-section of the front-side pocket (e.g., when sliced generally parallel to the ground, or generally horizontally) may be generally similar to a half-circle, or to a curved shape, or to a tear-drop shape or rain-drop shape, to a shape formed of two or more curved lines or curved borders. The front-side pocket with particulate materials, particularly due to said shape or structure, may further enable adequate division of the weight of the user across the five toes; and further enables or assists the fore-foot to stabilize itself and/or the foot at their suitable place within the shoe or the footwear.

In some embodiments, the central pocket or the mid-side pocket or the mid-foot pocket, is located at a generally central area of the insole or insert or sole, or at the area that is intended to be stepped-on or pressed-by or pressured-by the medial longitudinal arch of the foot or by the mid-foot of the user. The mid-side pocket may contain, for example between 8 to 20 grams of particulate materials; or, between 8 to 15 grams of particulate materials; or, between 8 to 12 grams of particulate materials; or, between 12 to 20 grams of particulate materials; or, between 15 to 20 grams of particulate materials; or, between 10 to 18 grams of particulate materials; or, between 12 to 16 grams of particulate materials. The Applicants have realized that these particular values and/or ranges, may be particularly beneficial and/or advantageous, as being sufficient and/or suitable in order to provide adequate convenience and comfort to the user; taking into account, also, that an insufficient weight of particulate materials in this pocket may fail to achieve its purposes of providing support and comfort to the user, whereas an excessive weight of particulate materials in this pocket (and/or in other pocket(s)) may cause the insert or the insole or the entire shoe or footwear to become excessively heavy or inconveniently heavy and such excessive weight may actually increase the user's discomfort instead of reducing it. In some embodiments, the cross-section of the mid-side pocket (e.g., when sliced generally parallel to the ground, or generally horizontally) may be generally similar to a banana or to an eye, or to a curved shape, or to a tear-drop shape or rain-drop shape, to a shape formed of two or more curved lines or curved borders. The mid-side pocket with particulate materials, particularly due to said shape or structure, may provide adequate support to the medial longitudinal arch of the foot, and/or may reduce pain or discomfort at or near the medial longitudinal arch of the foot.

Optionally, the third layer may be formed of a suitable fabric or material, such as cotton, wool, silk, polyester, leather, suede, woven fabric, non-woven fabric, and/or other material(s); or may be implemented as a coating or a coated-layer. The third layer may provide a pleasant feel when touched by the user's body, and/or may prevent or reduce sweat and/or offensive odors.

In some embodiments, the third layer may cover an entirety of the second layer and of the first layer. In other embodiments, the third layer may only partially cover the layer(s) beneath it; for example, the third layer may optionally have holes, apertures, cut-outs, slits, and/or contoured shape that leaves room for the Pocket(s) beneath it to protrude through the third layer such that those Pockets (which contain particulate materials) would still be in direct contact with the human foot, in order to provide enhanced or maximal level of support and comfort to the human wearer; while still covering or coating, via the third layer, the other portions of the insole or insert, such as the other regions of the first layer (the lowest layer); and this structure may be relevant, for example, if each pocket is manufactured and implemented as a stand-alone pocket which does not necessarily utilize the top layer of the insole as its top-side boundary or panel.

Reference is made to FIG. 1A, which is a schematic illustration of an insole 100 or insert, in accordance with some demonstrative embodiments of the invention. The insole or insert may be suitable for closed or generally-closed or partially-closed shoe or footwear; or, in some implementations, for an open or generally-open or partially-open shoe or footwear. FIG. 1A shows the insole or insert in its assembled state; showing three pockets 101, 102 and 103 that contain the mixture of materials described above or herein, which are embedded in an insole/insert layer or insole base insole body 104, or which protrude upwardly relative to such layer or relative to such insole base or insole body 104.

Figure 1B:
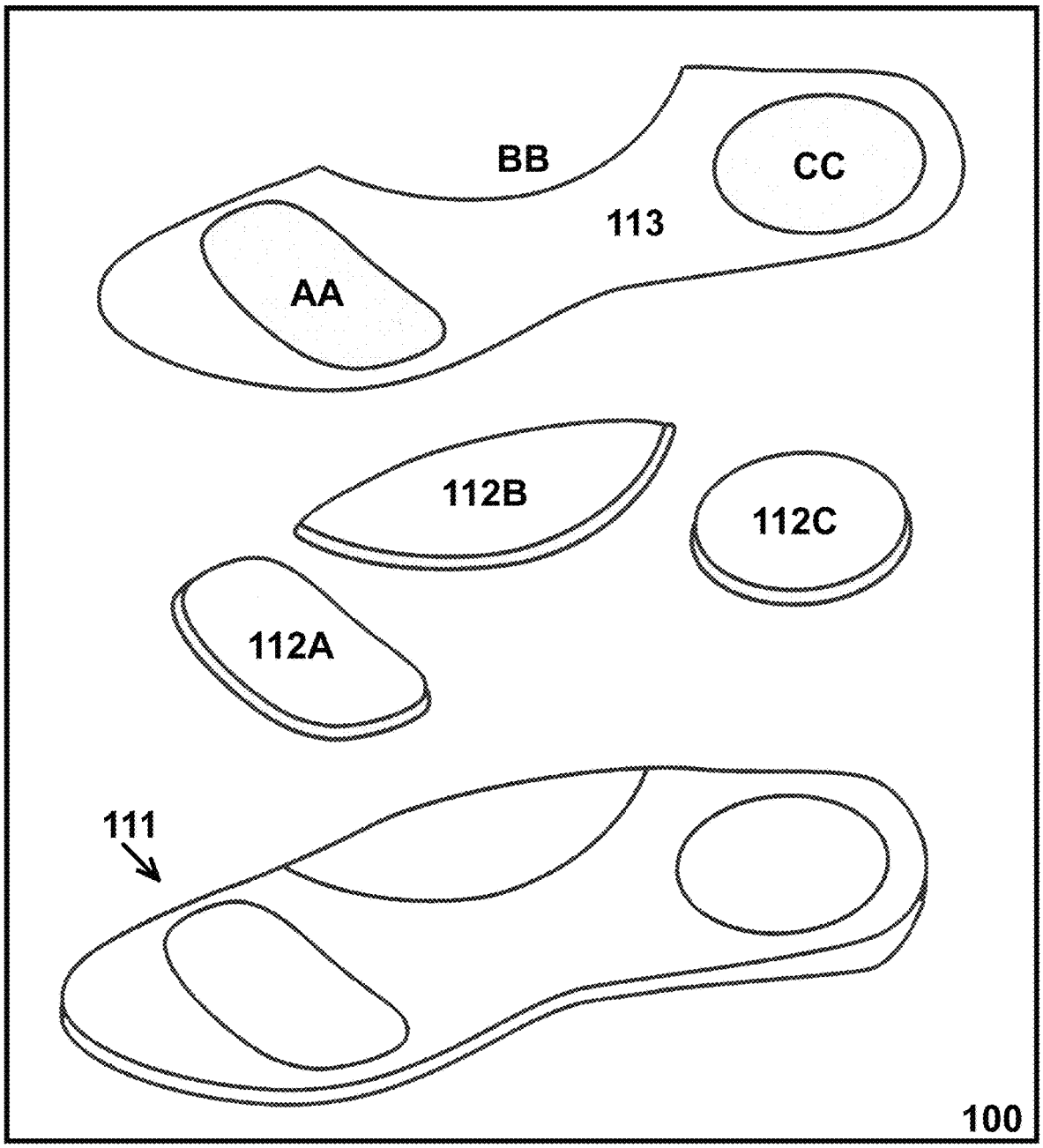
FIG. 1B is a schematic illustration of a set of components of an insole, in accordance with some demonstrative embodiments of the present invention.

Reference is made to FIG. 1B, which is a schematic illustration of a set 110 of components of an insole, in accordance with some demonstrative embodiments of the present invention. For example, a base layer 113 may comprise or may implement cut-outs or slits or windows or holes or apertures or cavities, denoted AA and BB and CC. Three respective pockets, denoted 112A and 112B and 112C, may be inserted into or may protrude or pass through (or be felt through) those cavities; to achieve the final insole 111 having those pockets, wherein each pocket is an elastic shape-shifting pocket that stores therein a mixture of materials as described above or herein.

Figure 2A:
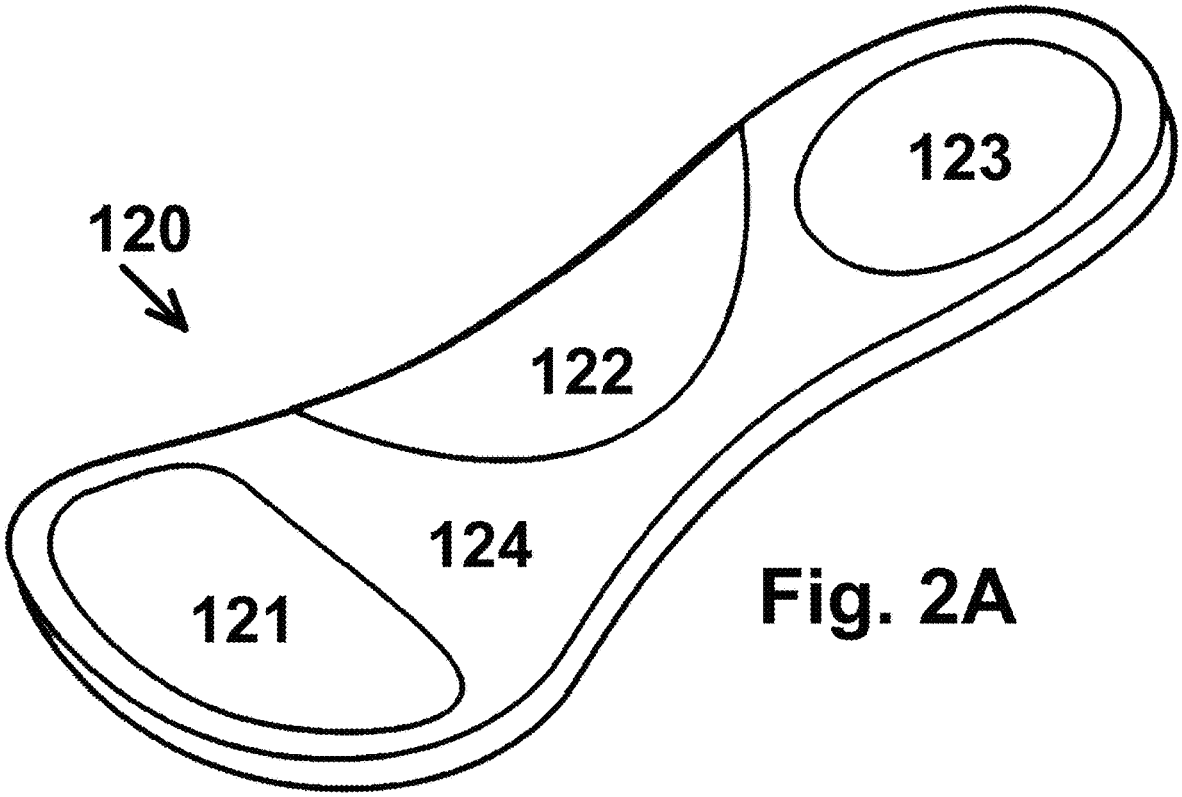
FIG. 2A is a schematic illustration of another insole or insert, in accordance with some demonstrative embodiments of the invention.

Reference is made to FIG. 2A, which is a schematic illustration of another insole 120 or insert, in accordance with some demonstrative embodiments of the invention. The insole or insert may be suitable for closed or generally-closed or partially-closed shoe or footwear; or, in some implementations, for an open or generally-open or partially-open shoe or footwear. FIG. 2A shows the insole or insert in its assembled state; showing three pockets 121, 122 and 123 that contain the mixture of materials described above or herein, which are embedded in an insole/insert layer or insole base insole body 124, or which protrude upwardly relative to such layer or relative to such insole base or insole body 124.

Figure 2B:
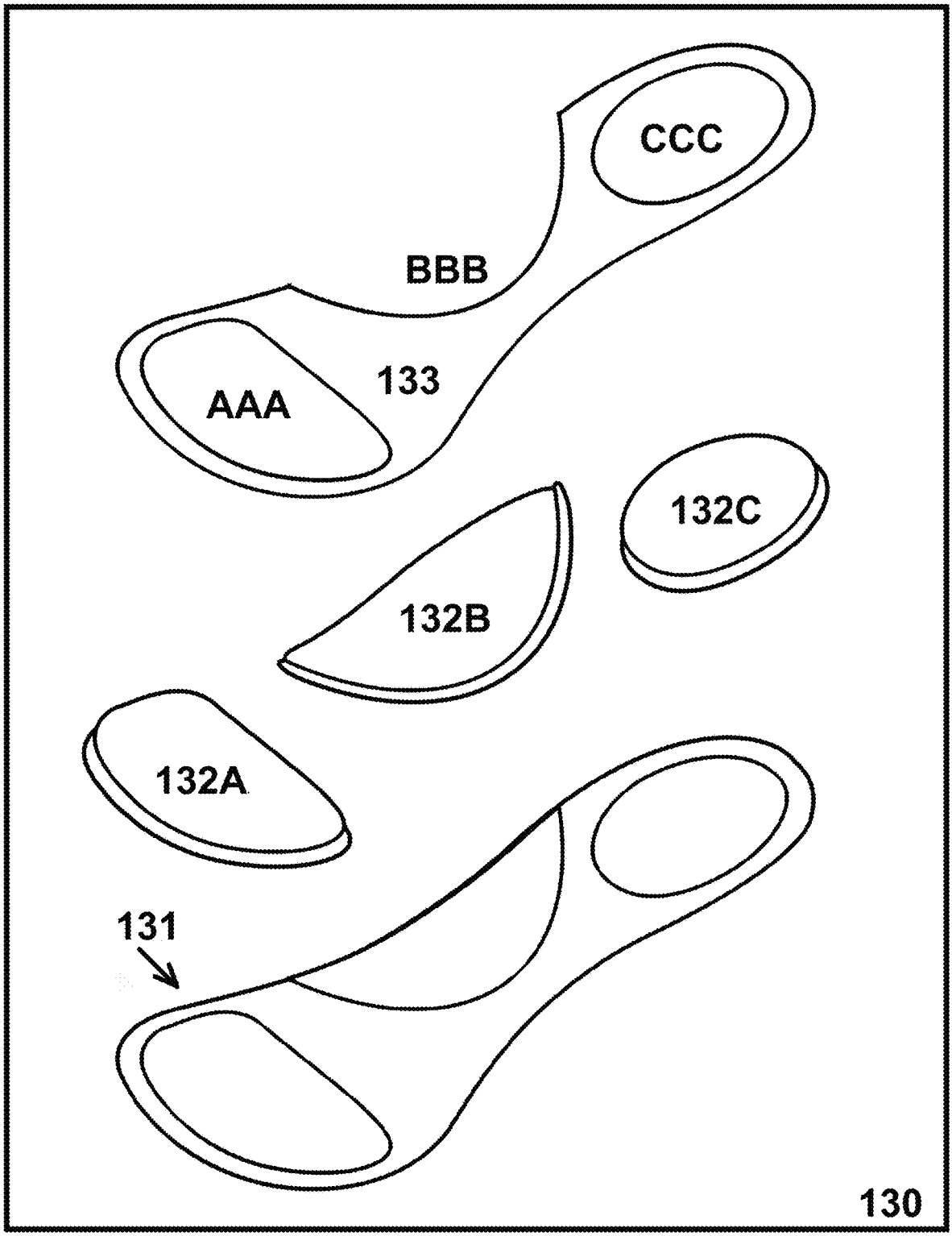
FIG. 2B is a schematic illustration of another set of components of an insole, in accordance with some demonstrative embodiments of the present invention.

Reference is made to FIG. 2B, which is a schematic illustration of a set 130 of components of an insole, in accordance with some demonstrative embodiments of the present invention. For example, a base layer 133 may comprise or may implement cut-outs or slits or windows or holes or apertures or cavities, denoted AAA and BBB and CCC. Three respective pockets, denoted 132A and 132B and 132C, may be inserted into or may protrude or pass through (or be felt through) those cavities; to achieve the final insole 131 having those pockets, wherein each pocket is an elastic shape-shifting pocket that stores therein a mixture of materials as described above or herein.

Figure 3A:
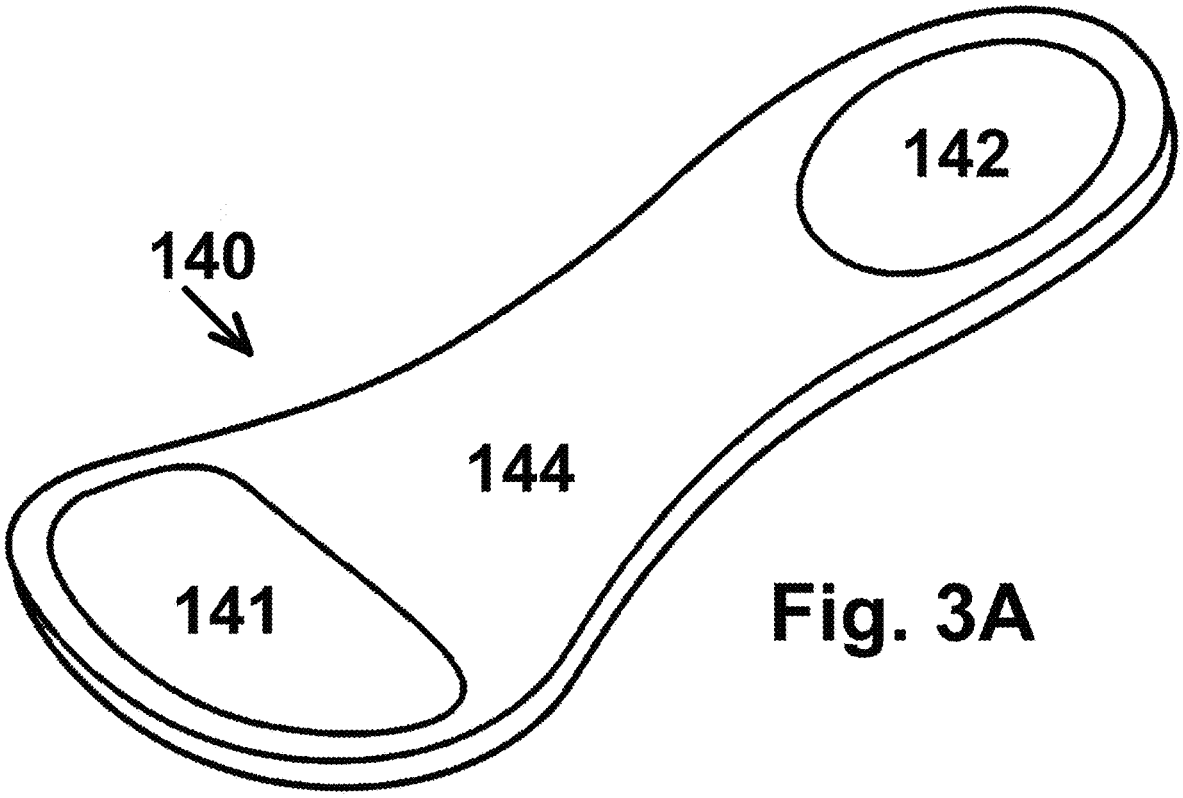
FIG. 3A is a schematic illustration of yet another insole or insert, in accordance with some demonstrative embodiments of the invention.

Reference is made to FIG. 3A, which is a schematic illustration of yet another insole 140 or insert, in accordance with some demonstrative embodiments of the invention. The insole or insert may be suitable for closed or generally-closed or partially-closed shoe or footwear; or, in some implementations, for an open or generally-open or partially-open shoe or footwear. FIG. 3A shows the insole or insert in its assembled state; showing two pockets 141 and 142 that contain the mixture of materials described above or herein, which are embedded in an insole/insert layer or insole base insole body 144, or which protrude upwardly relative to such layer or relative to such insole base or insole body 144.

Figure 3B:
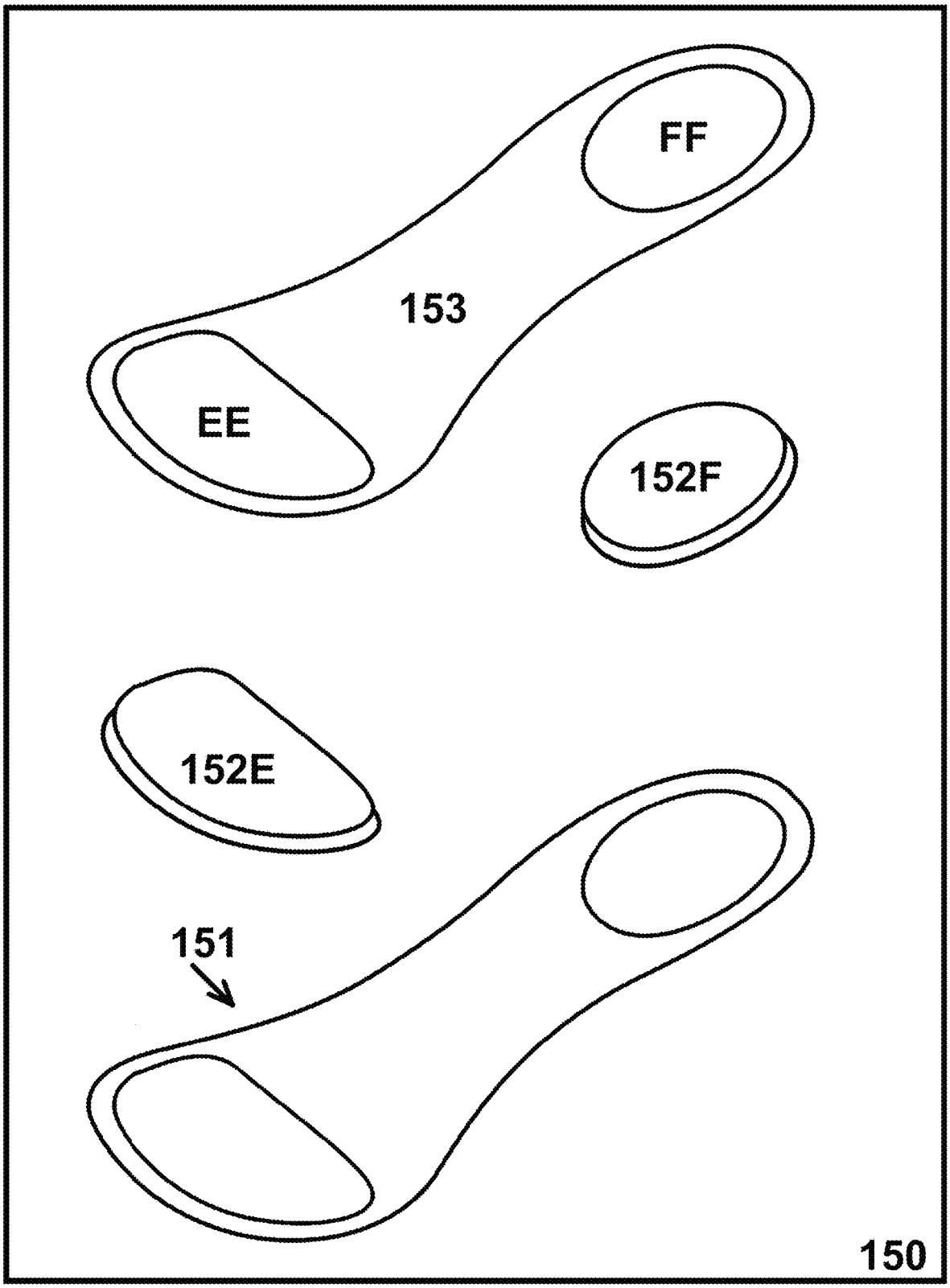
FIG. 3B is a schematic illustration of yet another set of components of an insole, in accordance with some demonstrative embodiments of the present invention.

Reference is made to FIG. 3B, which is a schematic illustration of a set 150 of components of an insole, in accordance with some demonstrative embodiments of the present invention. For example, a base layer 153 may comprise or may implement cut-outs or slits or windows or holes or apertures or cavities, denoted EE and FF. Two respective pockets, denoted 152E and 152F, may be inserted into or may protrude or pass through (or be felt through) those cavities; to achieve the final insole 151 having those pockets, wherein each pocket is an elastic shape-shifting pocket that stores therein a mixture of materials as described above or herein.

Figure 4:
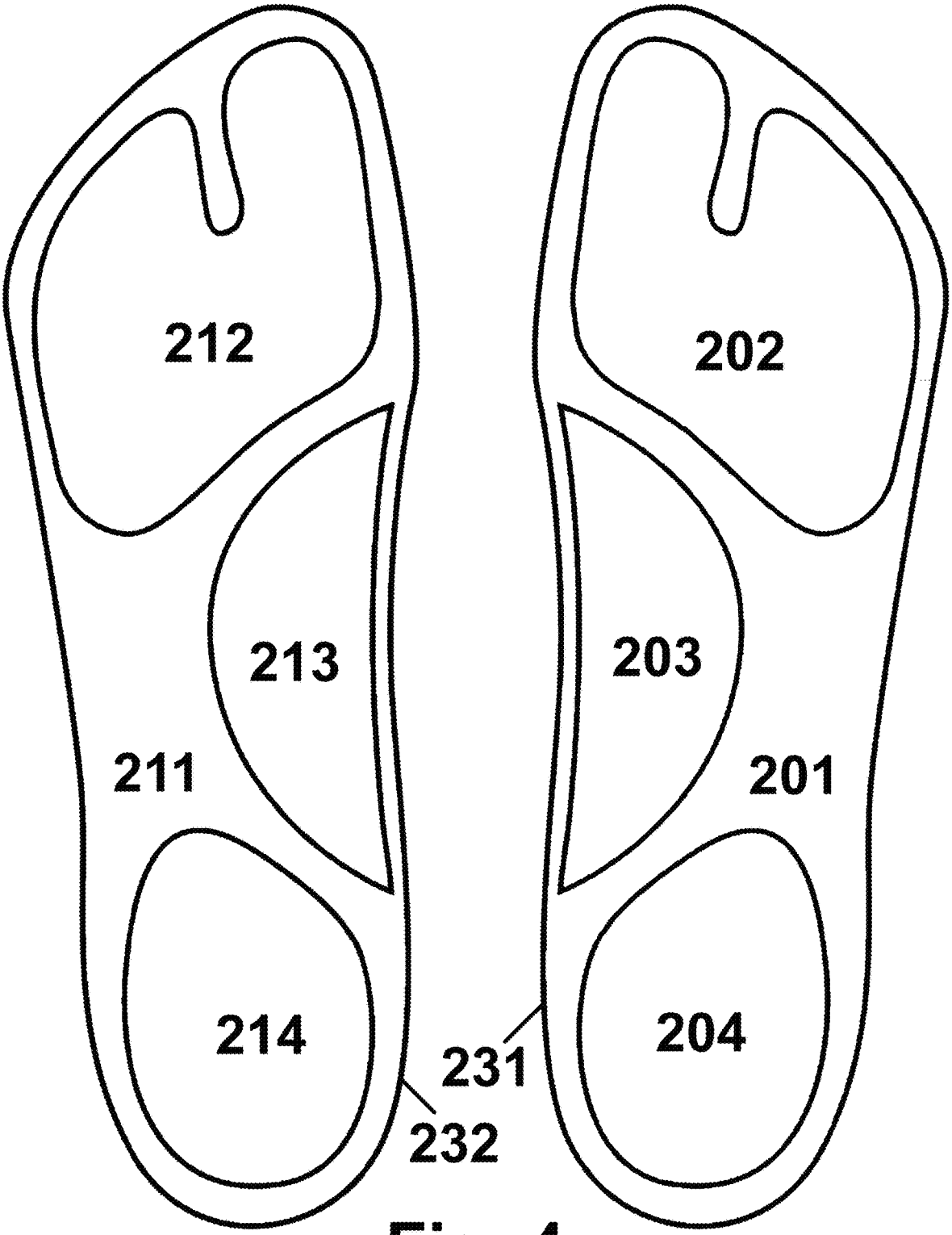
FIG. 4 is a schematic illustration of a top view of a pair of two insoles or inserts, in accordance with some demonstrative embodiments of the invention.

Reference is made to FIG. 4, which is a schematic illustration of a top view of a pair of two insoles 231-232 or inserts, in accordance with some demonstrative embodiments of the invention. These insoles or inserts may be particularly suitable for flip-flops or for other types of sandals or footwear having a Y-shaped strap or a "toe thong" which passes between the first toe and the second toe of each foot.

For example, in the right-foot insole 231, there are shown a base layer 201 and three shape-shifting pockets (202, 203, 204) that are filled with the mixture of materials described above or herein. Similarly, in the left-foot insole 232, there are shown a base layer 211 and three shape-shifting pockets (212, 213, 214) that are filled with the mixture of materials described above or herein. Uniquely, the front-side pocket (202, 212) of each insole (231, 232) is structured as a U-shaped pocket having a cut-out or a channel that allows the pocket to surround the Y-shaped strap or the "toe thong".

Figure 5:
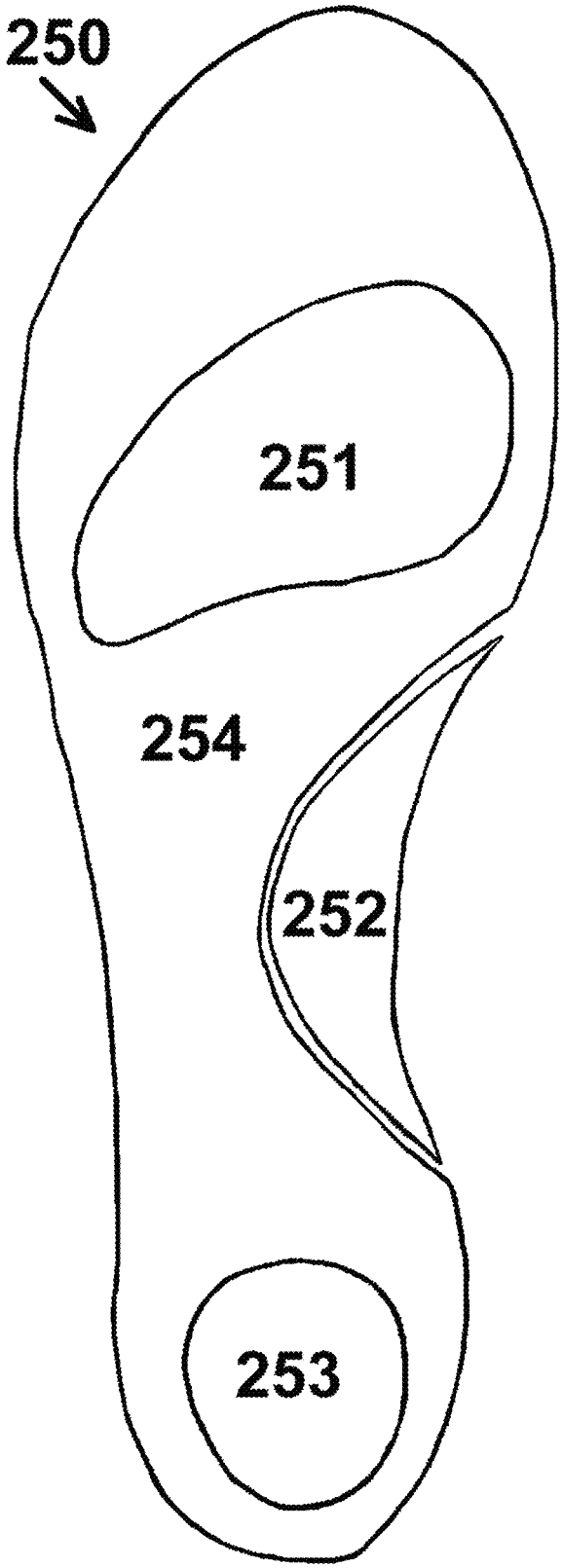
FIG. 5 is a schematic illustration of another insole or insert, in accordance with some demonstrative embodiments of the invention.

Reference is made to FIG. 5, which is a schematic illustration of another insole 250 or insert, in accordance with some demonstrative embodiments of the invention For example, three pockets (251, 252, 253) may protrude through or may pass through, or may be mounted on or glued or bonded on top of, or may be otherwise integrated with or embedded with, a base layer 254; each pocket filled with (or storing) a mixture of two or more particulate materials as described above or herein.

Figure 6:
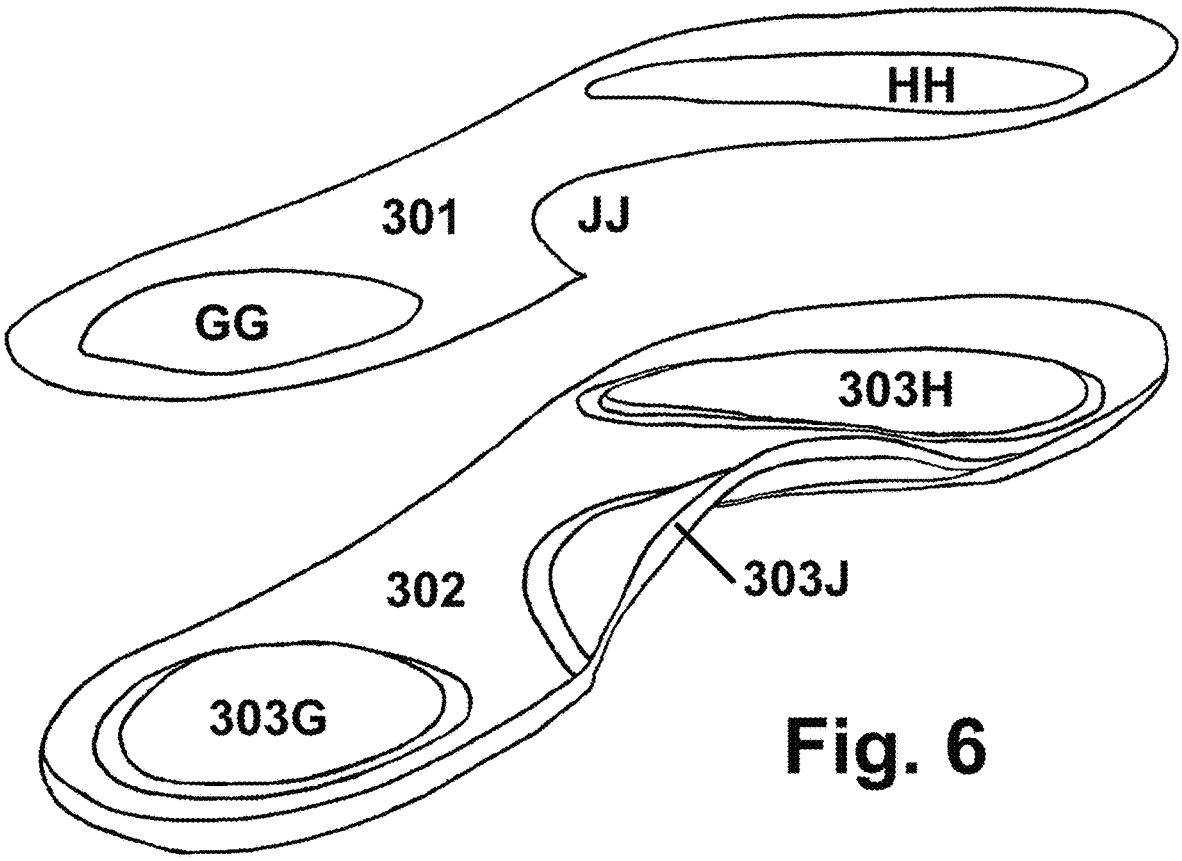
FIG. 6 is a schematic illustration of two layers, which may be bonded or glued or connected to each other to form an insole or insert, in accordance with some demonstrative embodiments of the invention.

Reference is made to FIG. 6, which is a schematic illustration of two layers 301-302 which may be bonded or glued or connected to each other to form an insole or insert, in accordance with some demonstrative embodiments of the invention. Layer 301 features specific cavities or cut-outs or apertures, denoted GG and HH and JJ. Layer 302 comprises a protruding pocket 303G which passes or protrudes through aperture GG. Layer 302 further comprises a protruding pocket 303H which passes or protrudes through aperture HH. With regard to cut-out JJ of layer 301, various options may be implemented; for example, a corresponding pocket may be included in layer 302 or may pass through or may protrude through layer 302 in the respective region; or, as depicted, a three-dimensional structure or an upward-facing curved structure 303J may be integrated in layer 302 or may be glued or bonded or connected to it, or may be an integral part of layer 302, to provide in layer 302 an upward lifting that may support the medial arch, not necessarily accommodating a pocket there.

Figure 7:
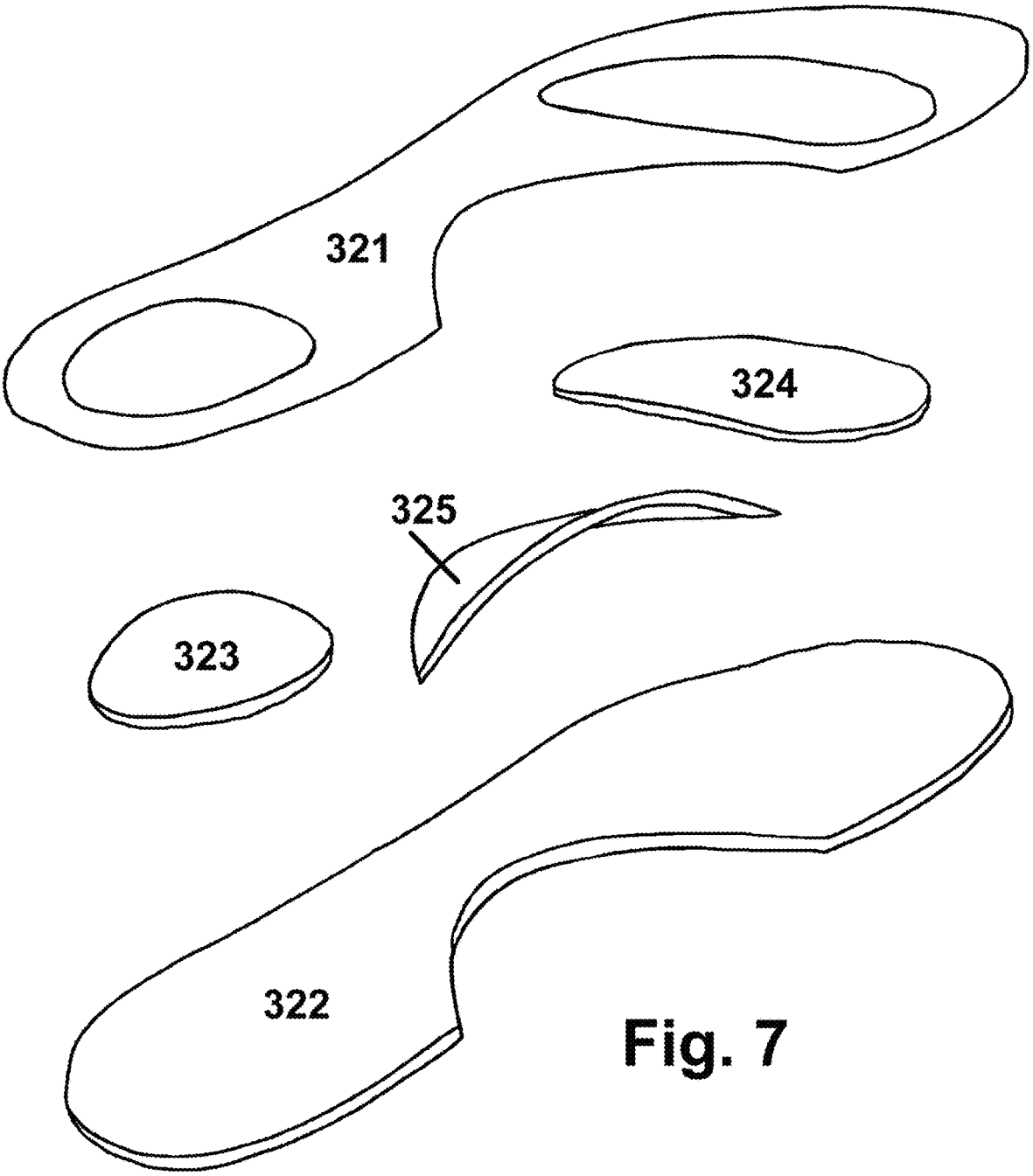
FIG. 7 is a schematic illustration of two layers, which may be bonded or glued or connected to each other to form an insole or insert, in accordance with some demonstrative embodiments of the invention.

Reference is made to FIG. 7, which is a schematic illustration of two layers 321-332 which may be bonded or glued or connected to each other to form an insole or insert, in accordance with some demonstrative embodiments of the invention. Layer 321 features specific cavities or cut-outs or apertures. On top of layer 322 there may be mounted a fore-of-foot protruding pocket 323 and a heel-side protruding pocket 324. An additional support element 325 may further support the medial arch, as a third pocket filled with the mixture of materials, and/or as a three-dimensional structure or elastic or semi-clastic protrusion or curvature.

Figure 8:
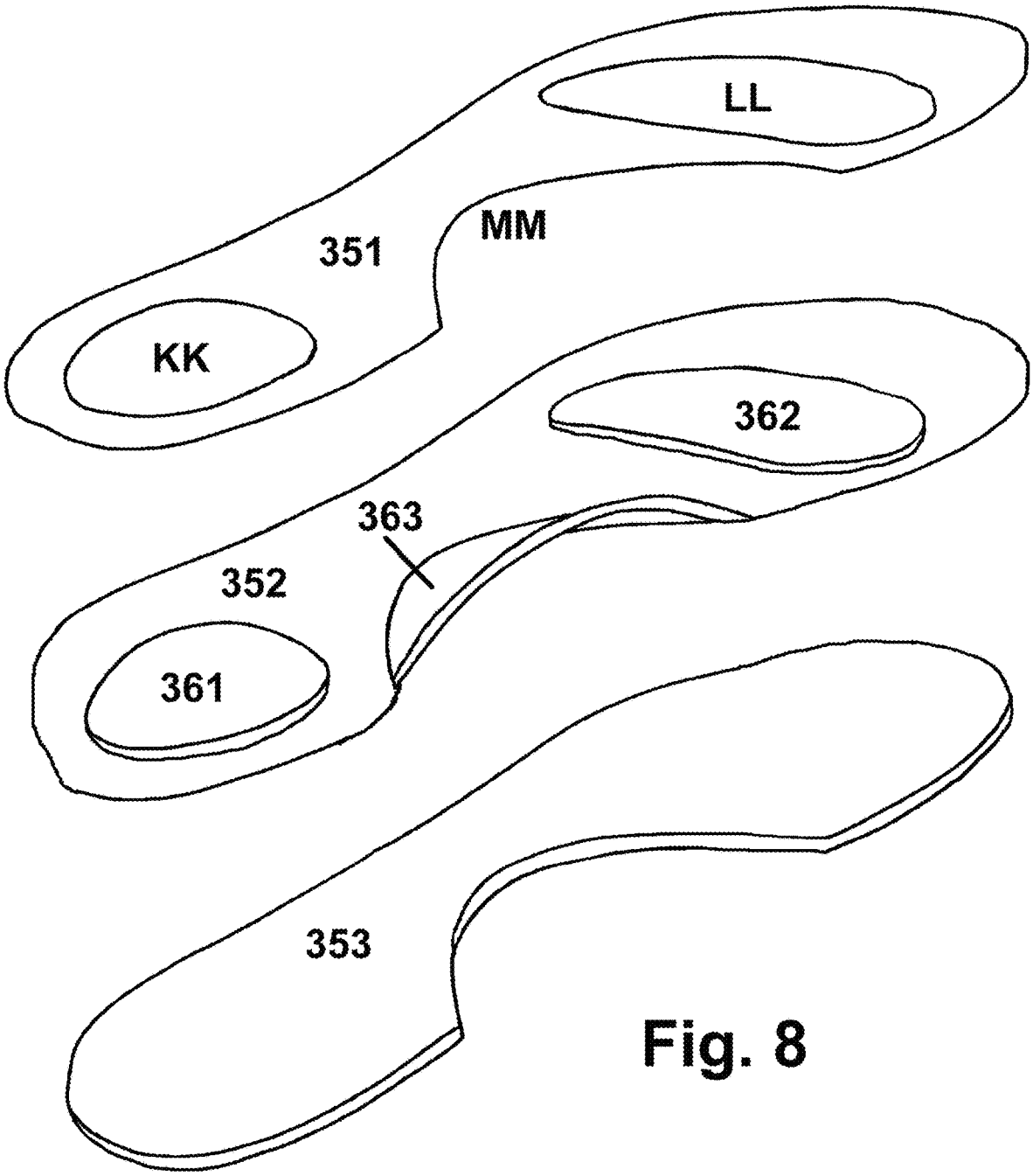
FIG. 8 is a schematic illustration of three layers, which may be bonded or glued or connected to each other to form an insole or insert, in accordance with some demonstrative embodiments of the invention.

Reference is made to FIG. 8, which is a schematic illustration of three layers 351-353 which may be bonded or glued or connected to each other to form an insole or insert, in accordance with some demonstrative embodiments of the invention. Layer 351 features specific cavities or cut-outs or apertures, denoted KK and LL and MM. On top of layer 352 there may be mounted a fore-foot protruding pocket 362 and a heel-side protruding pocket 361. An additional support element 363 may further support the medial arch, as a third pocket filled with the mixture of materials, and/or as a three-dimensional structure or elastic or semi-clastic protrusion or curvature. An additional layer 353 may be glued, such as made of foam and/or latex and/or foamed latex and/or latex foam, to provide further support and convenience to the entirety of the foot, and/or to operate as a base onto which the other layers and/or pockets are mounted or glued or bonded or connected.

For demonstrative purposes, some of the drawings may depict a "stand-alone" insole or a "stand-alone" insert, which may be inserted into (and/or removed from) a shoe or a footwear article, and/or without necessarily showing the shoe or footwear. However, some embodiments of the present invention may similarly comprise an entire Sole that is intended to be part of a shoe or part of a footwear article; and further, some embodiments of the present invention may similarly comprise an entire Shoe (or footwear article) that includes such Sole or such insole/insert, as an integrated or integral or built-in or non-removable or non-replaceable component; as well as such Shoe (or footwear article) that includes such Sole or such insole insert as a removable or replaceable component. Some embodiments of the present invention may similarly comprise a sock or stocking, having integrated or embedded at the bottom portion or the foot-portion or the sole-portion of the sock, the two or more shape-shifting pockets that store the mixture of particulate materials as described above or herein.

The present invention may comprise a method or process for producing or manufacturing an insole or an insert or a sole or a shoe or a sock or a stocking or a footwear article; for example, by performing: producing or obtaining Kinetic Sand; producing a mixture of Kinetic Sand with Air; producing a pocket which stores the mixture of Kinetic Sand with Air; hermetically closing and scaling the pocket; repeating the creation of pocket, to create a total of two or three or more pockets which store Kinetic Sand with Air; connecting or mounting or gluing or attaching the pocket(s) of Kinetic Sand onto or into or to a base-layer of an insert/insole; optionally, coating or brushing the article with a coating (e.g., anti-bacterial coating or agent, anti-microbial coating or agent, anti-fungus coating or agent); optionally, connecting or mounting or gluing or attaching a top-side layer having cut-outs or slits or holes through which the pockets of Kinetic Sand may protrude or may be felt.

The present invention may comprise another method or another process for producing or manufacturing an insole or an insert or a sole or a shoe or a sock or a stocking or a footwear article; for example, by performing: producing or obtaining a mixture of the particulate materials that are described above or herein, optionally as pre-grained or pre-powdered material, or optionally with additional graining or powdering of each material and/or of the mixture of materials mixed together; producing a pocket which is able to store the mixture, optionally as a cavity that is trapped within a bottom-side layer and a top-side layer, the cavity being defined via cut-offs within a middle layer, and similarly producing at least two such cavities; filling those cavities with said mixture of particulate materials; hermetically closing and sealing the pocket(s), such as, by gluing or bonding or connecting together the three layers. In some embodiments, hermetically sealed pockets of said materials may be pre-produced, and then may be mounted on a base layer or on an insole layer or even on an already-produced insole or insole-base-layer, or may be glued or bonded or attached thereto. Some embodiments may further include, optionally, coating or brushing the article or the insole or the pockets with a coating (e.g., anti-bacterial coating or agent, anti-microbial coating or agent, anti-fungus coating or agent); optionally, connecting or mounting or gluing or attaching a top-side layer having cut-outs or slits or holes through which the pockets may protrude or may be felt.

The methods may be automated or semi-automated; for example, implemented by an automated or semi-automated system having robotic arms, robotic parts, a computerized controller, automated or semi-automated injection molding sub-systems, sewing or welding or gluing or bonding unit(s), brushing unit, coating unit, cutting unit (e.g., to cut the contour of each layer, and/or to create cut-outs or holes in a layer to accommodate a pocket), and/or other suitable units.

The present invention provides a universal, comfort, convenient and/or orthopedic sole or insole, having at least one flexible pocket which stores therein an anti-bacterial mixture of materials, particularly containing sand or quartz or silica or kinetic sand or similar sand-like material. In some embodiments, the sole or insole has a front-side pocket; and a right-side/left-side pocket or sets of pockets; and a rear-side pocket. The right-side pocket (or sets of pockets) is in a right-foot sole or insole; the left-side pocket (or set of pockets) is in a left-side sole or insole. If a set of pockets is used, it may comprise two or three or four or five or other numbers of pockets, which may be discrete pockets that are separated from each other and/or that do not share a common edge or a common panel; or, they may be discrete pockets that are touching each other and/or sharing a common edge or panel.

The sole or insole may adapt itself, and its form and shape, to the shape and/or structure and/or spatial position of the foot of the wearer; and provides support and/or orthopedic support and/or medical support and/or convenience to the entirety of the foot of the wearer; and may further respond, in a dynamic manner, by changing its shape and/or by shape-shifting itself and/or by shape-shifting one or more of its pockets, to the dynamic movement or dynamic changes in the spatial orientation or position of the foot of the wearer.

In some embodiments, the inclusion in the pocket(s) of sand or quartz or silica or kinetic sand or other specific materials and/or other particulates or particulate materials, may further enable the sole or insole to provide a massage or a massage-like operation or feeling to the foot of the wearer, particularly while the wearer is walking or moving or running, and/or while the wearer utilizes his toes or his foot to fidget with the pockets of the insole (e.g., even when the wearer is sitting or standing); thereby improving the flow of blood within the foot and/or to the foot, and thereby providing medical advantages as well as an ability to fiddle or fidget with the sole components or pockets, and/or thereby contributing to reduction of anxiety of some wearers and/or to helping some wearers to increase their focus or attention or attention span when they handle another touch (e.g., working, learning, reading, writing). The particular structure of the sole or insole, and the particular location and content and structure of the pockets thereof, contribute to stimulation of the foot and/or of the nerves of the foot of the wearer, and/or stimulation of the muscles and/or bones of the foot or some of them; thereby providing an opportunity to the wearer to move his foot's muscles and/or bones in response to the integrated stimulation from the sand-filled pocket(s), and thereby reducing or mitigating or even eliminating (for some users) possible medical conditions or medical complications, e.g., thrombosis; deep vein thrombosis (DVT); tingling feet, or paresthesia, or a feeling that the foot "fell asleep" while standing or sitting; foot numbness; restless foot; medical complications due to non-movement or insufficient movement of the foot during a flight in an aircraft or during a long car-trip or vehicular trip, or during long periods of standing in the same place at work or at home, or the like. The flexible sand-filled pockets of the sole or insole, cause or trigger or stimulate or invite the muscles and/or bones and/or nerves in the foot of the wearer, to respond and/or to engage with such shape-shifting pockets, and also trigger the human body to move and to invest energy in such activity of engaging with those insole pockets. Optionally, the top surface of the sole or insole is not a flat surface; thereby forcing the foot and/or the entire body of the wearer (for some users) to work harder in order to maintain balance, even sub-consciously, thereby contributing directly or indirectly to stability and/or resilience of the human body and to a medically-correct upright standing position of the wearer.

In some embodiments, the insole may be formed of, or may comprise, multiple layers; such as three layers: top layer (closest to the foot), bottom layer (closest to the ground or floor), and middle layer that is "sandwiched" between them.

The bottom layer or the lower or lowest layer of the insole may have a generally flat bottom surface or bottom side or bottom panel; and may have two, or three, or four, or five, or multiple protrusions at the top side of the bottom layer. Such protrusions may push the sand mixture upwardly, towards the top regions of the insole; and/or assist to locate or localize or place or position or shape or shape-shift the sand mixture(s) in or towards or into the regions of the foot (of the wearer) that have craters or inlets, such as, the base of the phalanges (the base of the toes) and the medial longitudinal arch.

The bottom layer of the insole may be formed from one or more of the following materials: (1) Latex Foam, or Foamed Latex (e.g., natural material; stable and sustainable; resilient; light-weight; anti-bacterial); (2) Polyurethane Foam, or Foamed Polyurethane (e.g., clastic; stable and sustainable; resilient; light-weight; non-expensive; anti-bacterial); (3) Polystyrene Foam, or Foamed Polystyrene (e.g., light-weight; elastic; non-expensive; suitable for efficient design and processing); (4) Polyethylene Foam, or Foamed Polyethylene, or Polythene Foam, or Foamed Polythene, or foamed PE, or foamed polyethene, or foamed poly(methylene) (e.g., light-weight; sustainable and stable; resilient; suitable for efficient design and processing); (5) Ethylene-vinyl acetate (EVA), or poly (ethylene-vinyl acetate) (PEVA) (e.g., light-weight; anti-bacterial; high-density material; sustainable and stable; resilient; elastic; environmentally friendly); and/or a combination or mixture of two or more of these materials and/or other material(s).

The middle layer or the "sandwiched" layer of the insole may be flat or generally flat, or may have curvature similar to the bottom layer of the insole; and may be formed of one or more materials that are similar to those of the bottom layer of the insole. The middle layer of the insole is spatially structured to contain cut-outs or holes or apertures or slits or windows which spatially form, once the middle layer is glued together or bonded together with the bottom layer (underneath) and with the top layer (above), particular cavities or chambers or pockets that store therein the anti-bacterial sand-based mixtures or the anti-bacterial particulate mixture(s) described above or herein. Such pockets may be filled during the manufacturing process of the insole; such as, prior to the bonding of the top layer of the insole on top of the middle layer of the insole. The three-dimensional or spatial structure of the second layer and its cut-outs, in combination with the three-dimensional or spatial structure of the bottom layer and the third layer, define together (e.g., once the sand mixture is inserted and once the three layers are glued or bonded as a three-layer sandwich) the shape and size of the sand-filled or mixture-filled pocket(s) of the final insole.

The top layer or the upper layer of the insole, may be formed or Lycra or Spandex or Elastane or other suitable fabric or material or textile, particularly semi-elastic or partially-clastic material, which may be natural and/or artificial; and may be stable and resilient, having a dense mash or mash-like texture or structure yet soft and comfortable to feel. The top layer allows the pocket(s) and their contained materials, to instantly or rapidly shape-shift and retain their original or "idle" non-pressed or non-pushed position and spatial arrangement once the pressure or forces that were applied (e.g., by the foot) are removed or are weakened. The top layer may be formed of such material or fabric which may absorb human sweat and/or may cause such human sweat to evaporate; thereby assisting in keeping the human foot dry or non-sweat or less sweaty. The top layer may be glued or bonded on top of the other layers of the insole, and may cause a trapping or a sandwiching of the sand or other mixtures within the pockets or chambers within the insole.

In the cavities or pockets or chambers, that are defined by the cut-outs or holes of the middle layer, and that are bounded by the lower layer (beneath them) and by the top layer (above them), one or more materials or combinations of materials may be stored or contained.

In some embodiments, for example, each such pocket or chamber of the insole, may comprise a mixture of: (a) 50 to 95 percent (or, 50 to 99 percent) of sand and/or quartz and/or fine-grained sand and/or fine-grained quartz and/or fine-grained silica and/or gross-grained sand and/or gross-grained silica and/or gross-grained quartz and/or synthetic sand and/or natural sand and/or beach sand and/or kinetic sand; and (b) 5 to 30 percent of powdered (or fine-grained) metal and/or powdered (or fine-grained) silver and/or powdered (or fine-grained) aluminum and/or powdered (or fine-grained) zinc and/or powdered (or fine-grained) titanium and/or powdered (or fine-grained) magnesia (MgO, magnesium oxide), and/or air; and (c) the remainder, or up to 30 percent, of one or more additive materials, such as powdered (or fine-grained) coal, powdered (or fine-grained) wood, air, talcum powder or "baby powder", powdered (or fine-grained) cork (e.g., from the cork oak tree, or *Quercus* Suber, or other oak tree).

In some embodiments, a front pocket or chamber may be located or structured to be beneath the toes or the phalanges; the front pocket provides support to the front-side or front-region of the foot, and/or to the toes or phalanges and/or to the forefoot or the ball-of-foot (or ball of foot; between the arch and the toes); and/or may fill, or support, a crater that exists at the base of the phalanges or at the base of the toes of the foot. The front pocket or chamber may contain sand-mixture or a mixture of materials, having a weight of 5 to 40 grams; or having a weight of 10 to 35 grams; or having a weight of 15 to 30 grams; or having a weight of 20 to 25 grams; or having a weight of 10 to 30 grams; or having a weight of 10 to 20 grams; or having a weight of 20 to 30 grams; or having a weight of 20 to 40 grams; or having a weight of 25 to 35 grams; or having a weight of 30 to 40 grams. The weight of the entire insole or insert may be a function of: (i) the size of the insole or insert, such as, whether it is generally suitable for a foot of a child or a teenager or an adult, with further differentiation among foot sizes (e.g., male size US 8 is smaller and thus lighter relative to male size US 10); (ii) the size of the pockets, (iii) the number of the pockets, (iv) the shape(s) of the pocket(s) used, (v) the particular mixture(s) of materials that are selected for each pocket, and/or (vi) the material(s) from which the insole or insert is formed (e.g., latex foam, foamed latex, other materials). In some embodiments, the insole or insert may be produced in different sizes to accommodate different foot sizes, and thus the weight and/or the volume of the mixture of particular materials would vary among such different sizes.

In some embodiments, a set of two or three or four discrete or separated "medial arch pockets" or "medial arch chambers" of the insole may be located or structured to be beneath the medial arch of the foot; and/or may fill, or support, a crater that exists at the medial arch of the foot. The medial arch pockets, in the aggregate, may contain sand-mixture or a mixture of materials, having a weight of 5 to 50 grams; or having a weight of 10 to 40 grams; or having a weight of 15 to 30 grams; or having a weight of 20 to 30 grams; or having a weight of 20 to 40 grams; or having a weight of 20 to 35 grams; or having a weight of 20 to 30 grams; or having a weight of 15 to 40 grams; or having a weight of 15 to 45 grams; or having a weight of 20 to 50 grams.

In some embodiments, a rear (or heel-side) pocket or chamber may be located or structured to be beneath the heel of the foot; the rear pocket provides support to the rear-side of the foot and/or to the heel; and/or may support the heel of the foot. The rear pocket or the heel pocket of the insole may contain sand-mixture or a mixture of materials, having a weight of 2 to 30 grams; or having a weight of 2 to 25 grams; or having a weight of 5 to 25 grams; or having a weight of 10 to 25 grams; or having a weight of 10 to 20 grams; or having a weight of 15 to 25 grams; or having a weight of 20 to 30 grams; or having a weight of 10 to 20 grams; or having a weight of 15 to 25 grams; or having a weight of 10 to 30 grams.

In some embodiments, the aggregate combined weight of all the materials that are stored in all the pockets or chambers of the insole, may be under 100 grams; or may be 10 to 90 grams; or may be 10 to 75 grams; or may be 10 to 50 grams; or may be 20 to 70 grams; or may be 20 to 50 grams; or may be 30 to 50 grams; or may be 30 to 75 grams; or may be 40 to 60 grams; or may have other suitable aggregated weight.

It is noted that the above-mentioned examples of ranges and/or weight-values, are not merely random values or ranges; but rather, they reflect numerous experiments and calculations performed by the Applicants in order to ensure that multiple goals are achieved in concert; such as, to achieve support to particular foot regions, to enable particular foot regions (or muscles, or nerves, or bones) to be stimulated or triggered, to enable engagement or fidgeting of particular foot regions with particular pockets, and yet to maintain an insole or a sole or a shoe that is not too heavy and still feels comfortable and light-weight while also conveying a feeling of support and engagement. It is noted that merely filling all of the pockets or some of them with "sea sand" or "beach sand", would create a heavy and non-convenient insole or shoe that feels like a heavy anchor and that fails to provide the benefits of the present invention.

The front pocket of the insole may provide support to the fore-foot and may fill the craters or inlets that exist at the base of the phalanges. The flexibility or elasticity of the front pocket of the insole, enables the particulate content of that pocket to massage or stimulate said regions of the foot, thereby increasing the blood flow to those regions of the foot. Additionally, the passage of the sand mixture (of the front pocket) through the phalanges or toes during movement or walking or running, or the fidgeting or the engagement of the phalanges or toes with the front pocket, may cause an increased number of foot muscles to operate, and may thus contribute to improvement of the standing position and/or balance of the wearer. Furthermore, the spatial structure of the front pocket, as well as its particular content, may stimulate the fore-foot or the front-region of the foot, as well as nerves and/or reflexology points or regions there; and/or may trigger an in-vivo signal that triggers movement or fidgeting or playing or engagement of the phalanges with the front pocket even when the wearer is generally at rest (e.g., sitting in an airplane or in a vehicle), and/or may cause the wearer to repeatedly expand and shrink his phalanges or toes, thereby increasing blood flow there and reducing or mitigating or eliminating thrombosis.

The medial arch pocket(s) may provide dynamic support and/or shape-shifting support to the medial arch, and may contribute to keeping the medial arch stable, healthy, and convenient. The medial arch pocket(s) may further provide a massage or an engagement or stimulus to the central area of the foot sole, and/or may increase the blood flow to those regions of the foot; and may further provide stimulus to the nerves and reflexology zones located at or near the medial arch of the foot.

The rear pocket or the heel pocket may support the heel and/or the ankle and/or the rear region of the foot, and/or may contribute to the balance of the entire foot and even the entire body of the wearer. The flexibility and content of the heel pocket may further enable some wearers to fidget or to play or to engage, with their heel, downwardly toward the heel pocket and then upwardly away from the heel pocket, thereby exercising the rear region of the foot or contributing to blood flow towards or within the heel area.

Figure 9A:
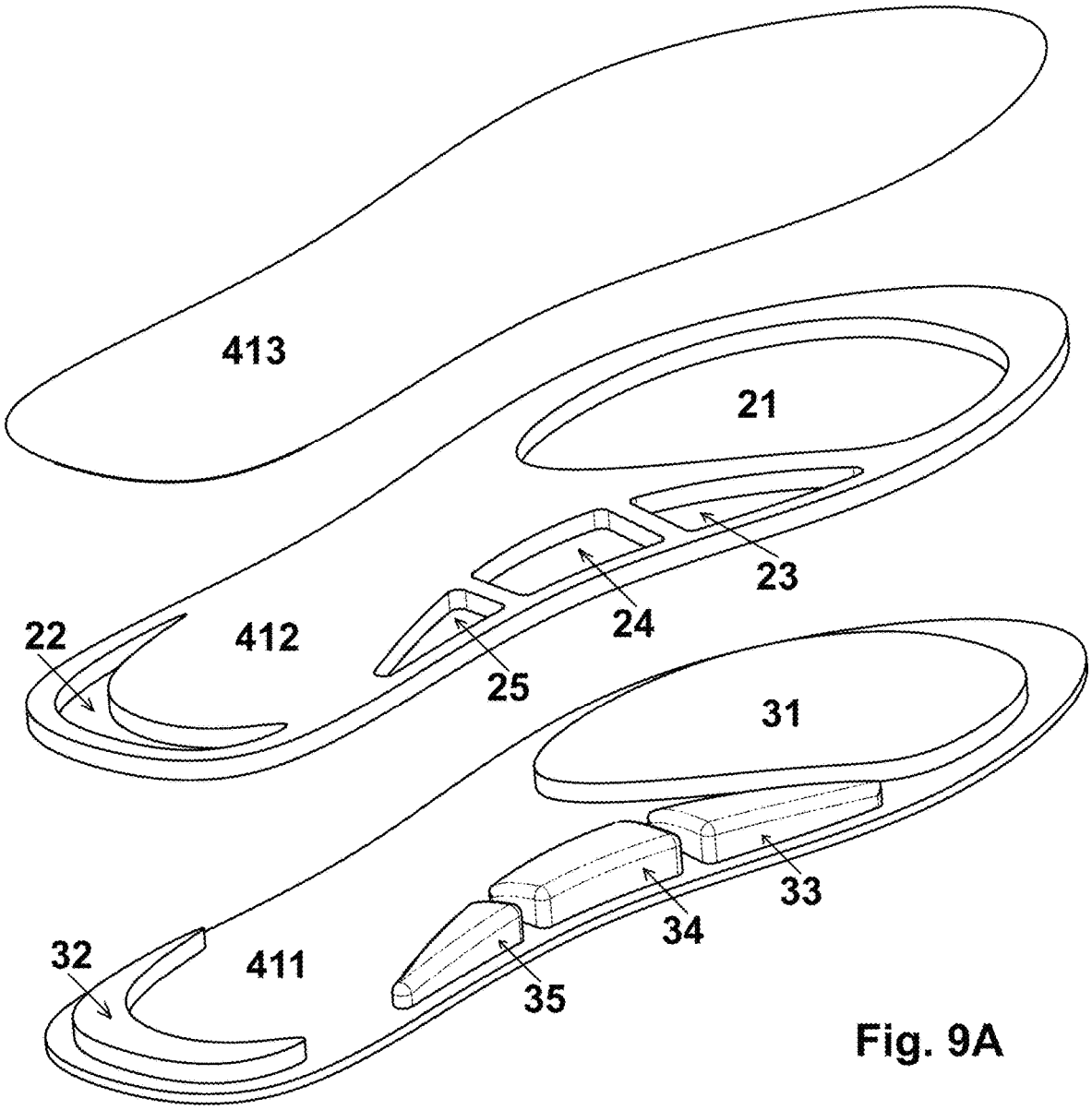
FIG. 9A is a schematic illustration of three other layers, which may be glued or bonded or attached together, to form an insole or insert in accordance with some demonstrative embodiments of the present invention.

Reference is made to FIG. 9A, which is a schematic illustration of three layers 411-413 which may be glued or bonded or attached together, to form an insole or insert in accordance with some demonstrative embodiments of the present invention. Layer 411 may be a bottom layer or a lower layer, which is closest to the ground or to the floor when the insole is worn by a wearer; layer 413 may be a top layer or an upper layer, which is closest to the skin of the foot of the wearer when the insole is worn; layer 412 may be a middle layer or an internal layer of the insole, sandwiched or integrated or trapped between layers 411 and 413.

For demonstrative purposes, five upwardly-protruding elements 31-35 are shown; each one of elements 31-35 may be a spatial protrusion or spatial curvature of the bottom layer 411, and/or may be or may comprise a pocket storing or containing or filled with a mixture of particulate materials as described above or herein; or, each such element 31-35 may be an actual pocket containing said mixture of particulate materials.

In some embodiments, cavities or apertures 21-25 in layer 412 may be filled with the mixture of particulate materials, which may be supported from beneath by the elements 31-35 which act as supporting elements; and the top layer 413 hermetically seals the particulate materials from above and creates a top panel for such five pockets; each pocket defined by the five cavities 21-25, and the layer 413 above them, and the upper side of elements 31-35 beneath them. In other embodiments, elements 31-35 may already be hermetically-sealed pockets that already store within them the mixture of particulate materials; and elements 31-35 may protrude through or may pass through the cavities 21-25 in layer 412; and layer 413 may further protect the two layers 411-412 and provide a comfortable feeling to the foot of the user. The upper layer 413 may be formed of Spandex or Lycra or Elastane or other suitable fabric or textile.

Figure 9B:
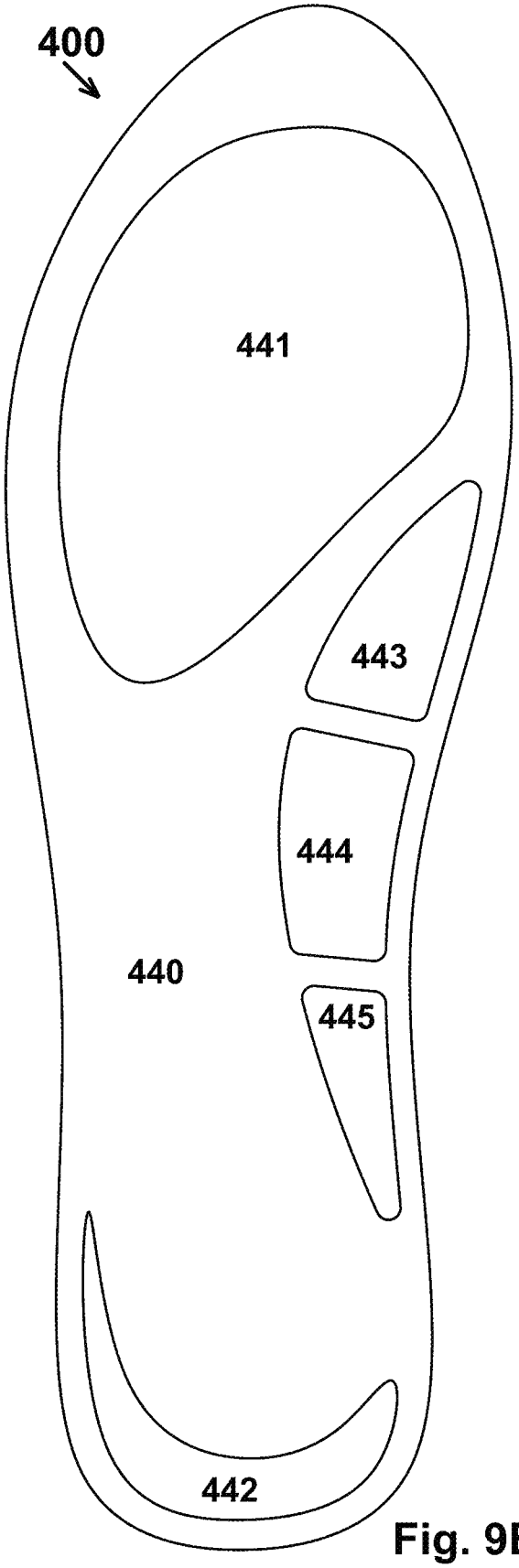
FIG. 9B is a schematic illustration of a top view of the bottom two layers of an insole or insert, in accordance with some demonstrative embodiments of the present invention.

Reference is made to FIG. 9B, which is a schematic illustration of a top view of the bottom two layers of an insole or insert 400, in accordance with some demonstrative embodiments of the present invention; showing their structure immediately prior to attaching to them the top layer to seal them; and demonstrating a base support member 440 which is the base of the insole, having mounted or glued on it five pockets 441-445, each one of said pockets containing or storing the mixture of particulate materials as described above or herein.

Figure 9C:
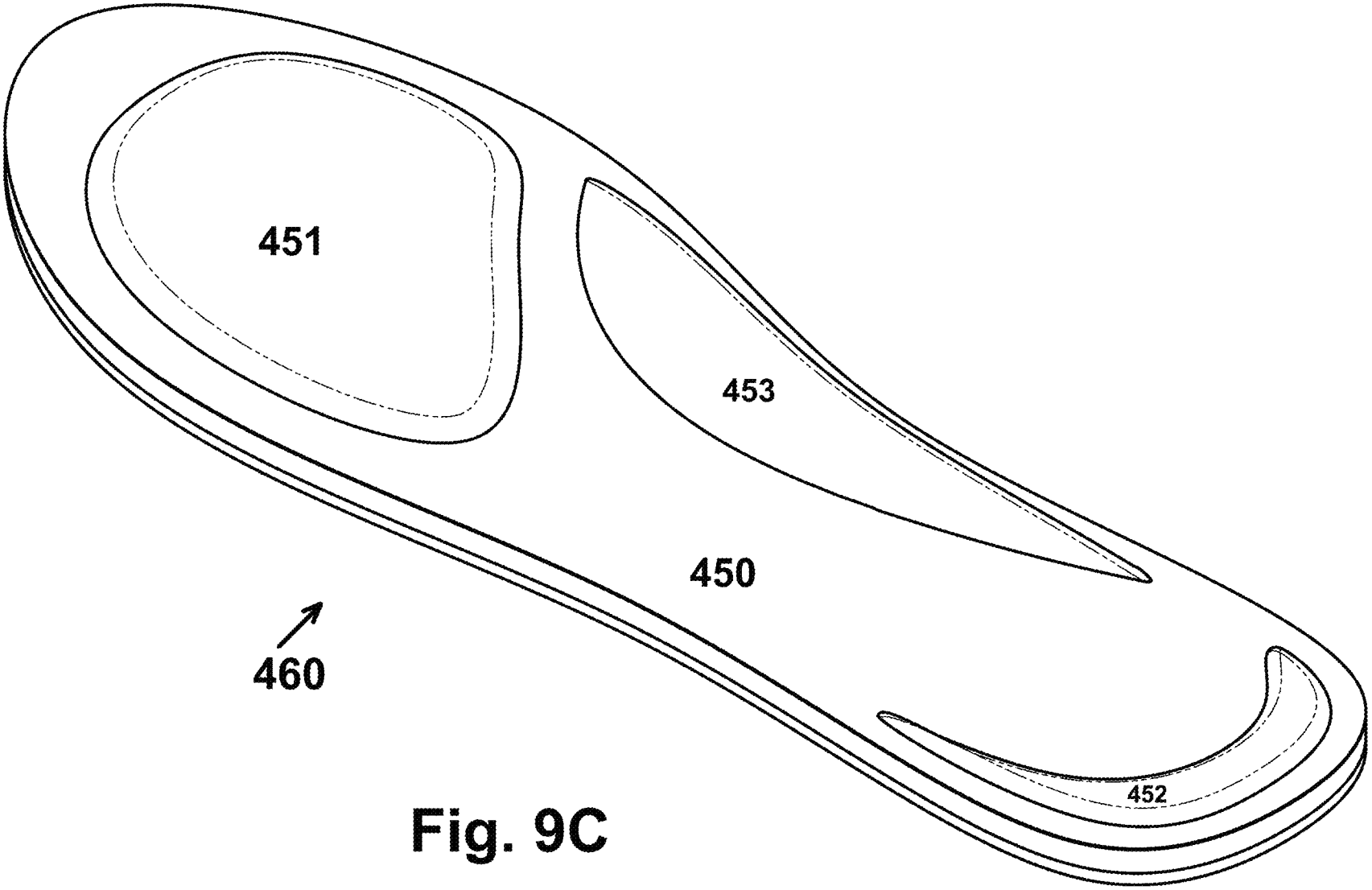
FIG. 9C is a schematic illustration of a perspective view of an insole or insert, in accordance with some demonstrative embodiments of the present invention.

Reference is made to FIG. 9C, which is a schematic illustration of a perspective view of an insole 460 or insert, in accordance with some demonstrative embodiments of the present invention. The top layer 450 operates to hide the internal division into separate compartments or pockets; such that a region 451 of fabric covers the fore-foot pocket, and a region 452 of fabric covers the heel-side pocket, and a region 453 of fabric covers the multiple discrete pockets that are located beneath it.

For demonstrative purposes, the heel-side pocket may be shown in some of the drawings as having a banana shape or a moon shape or a curved shape or a "u" shape or a "J" shape or an "L" shape. However, in other embodiments, the heel-side pocket may have other suitable shapes or structures, for example, oval, elliptical, egg-shaped, football shaped, trapezoid, rectangular, polygon, cloud shaped, pear shaped, or the like. Any of these shapes or structures may similarly be used for the fore-foot (front side) pocket; and/or for the side pocket or the side set-of-pockets that are located under the medial arch.

Figure 13A:
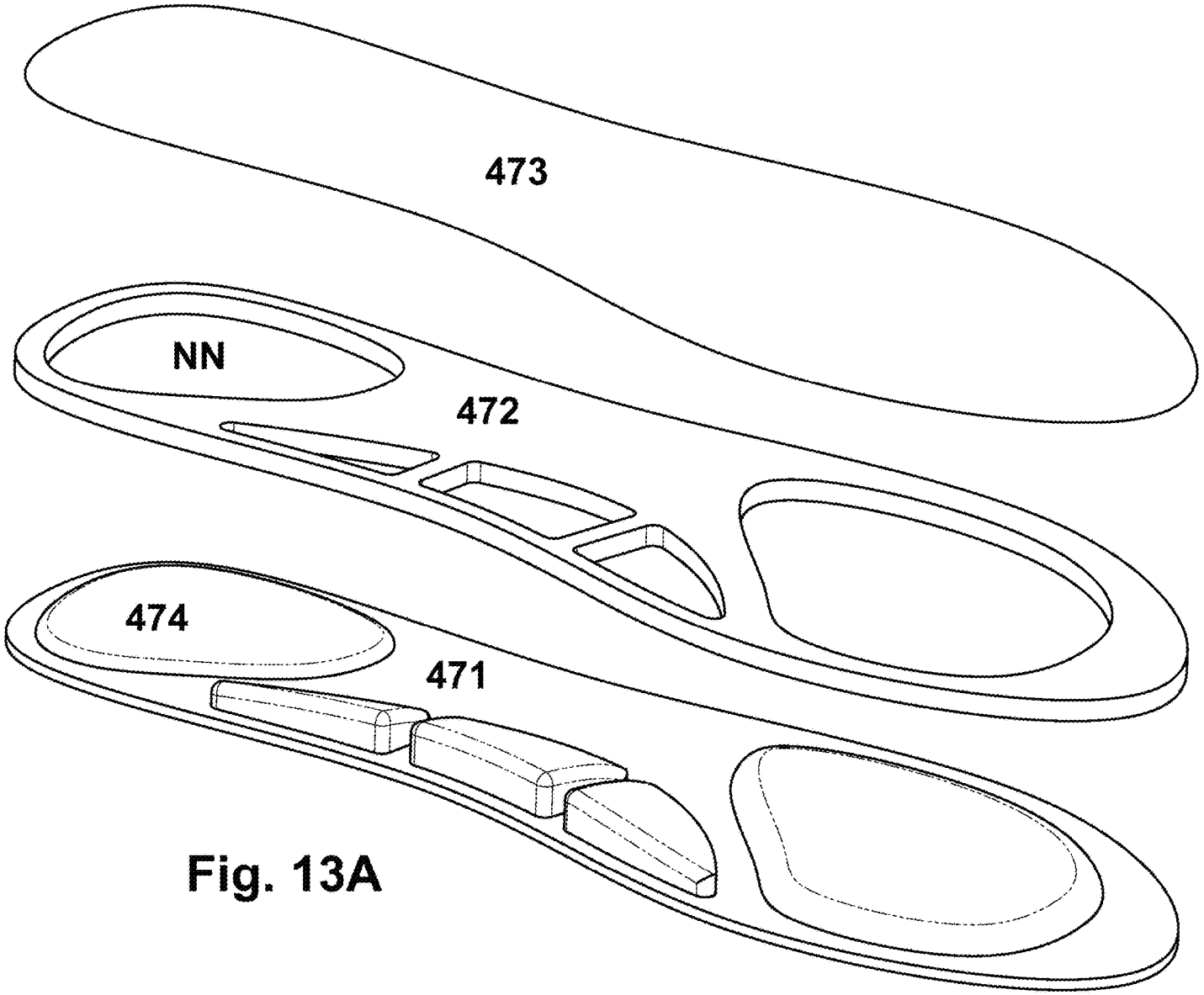
FIG. 13A is a schematic illustration of another set of three layers, which may be glued or bonded or attached together, to form an insole or insert in accordance with some demonstrative embodiments of the present invention.

Reference is made to FIG. 13A, which is a schematic illustration of another set of three layers 471-473 which may be glued or bonded or attached together, to form an insole or insert in accordance with some demonstrative embodiments of the present invention. These layers may be generally similar to the layers depicted in FIG. 9A; however, in FIG. 13A, a layer 471 features or includes a heel-side or rear-side pocket 474 that is not banana-shaped or moon-shaped, but rather, is generally circular or oval or elliptical or egg-shaped, and is able to pass through a complementing cut-out NN in layer 472. Other suitable structures or shapes may be used.

Figure 13B:
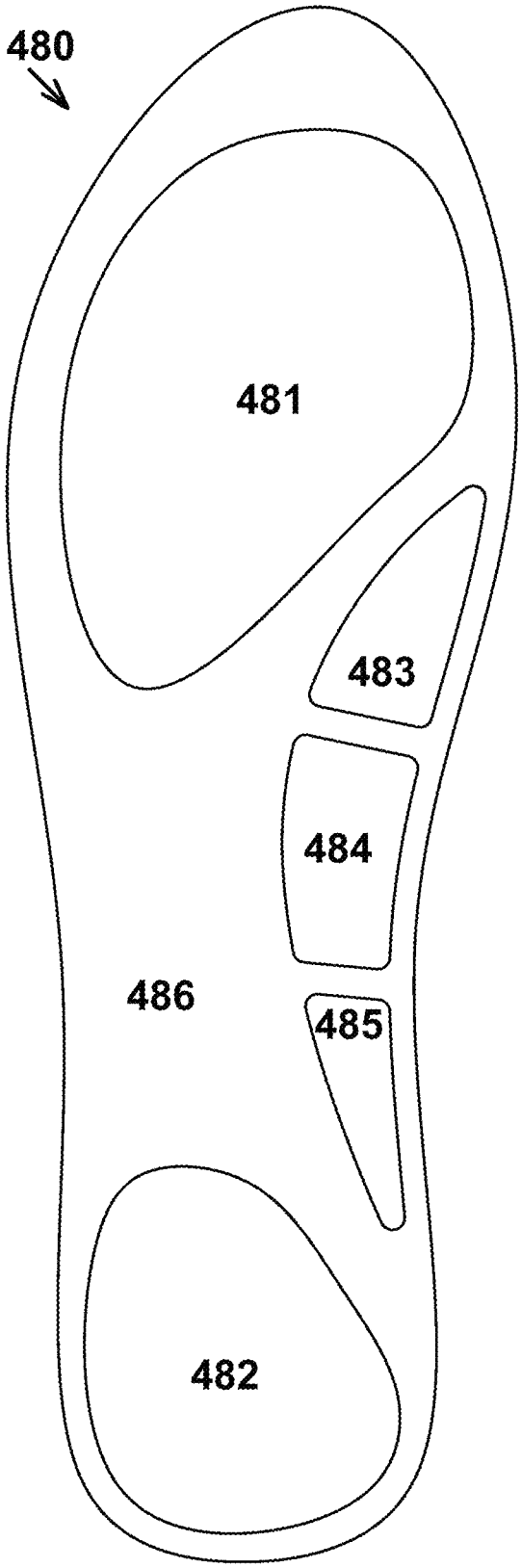
FIG. 13B is a schematic illustration of a top view of the bottom two layers of another insole or insert, in accordance with some demonstrative embodiments of the present invention.

Reference is made to FIG. 13B, which is a schematic illustration of a top view of the bottom two layers of another insole or insert 480, in accordance with some demonstrative embodiments of the present invention; showing their structure immediately prior to attaching to them the top layer to seal them; and demonstrating a base support member 486 which is the base of the insole, having mounted or glued on it five pockets 481-485, each one of said pockets containing or storing the mixture of particulate materials as described above or herein.

Figure 13C:
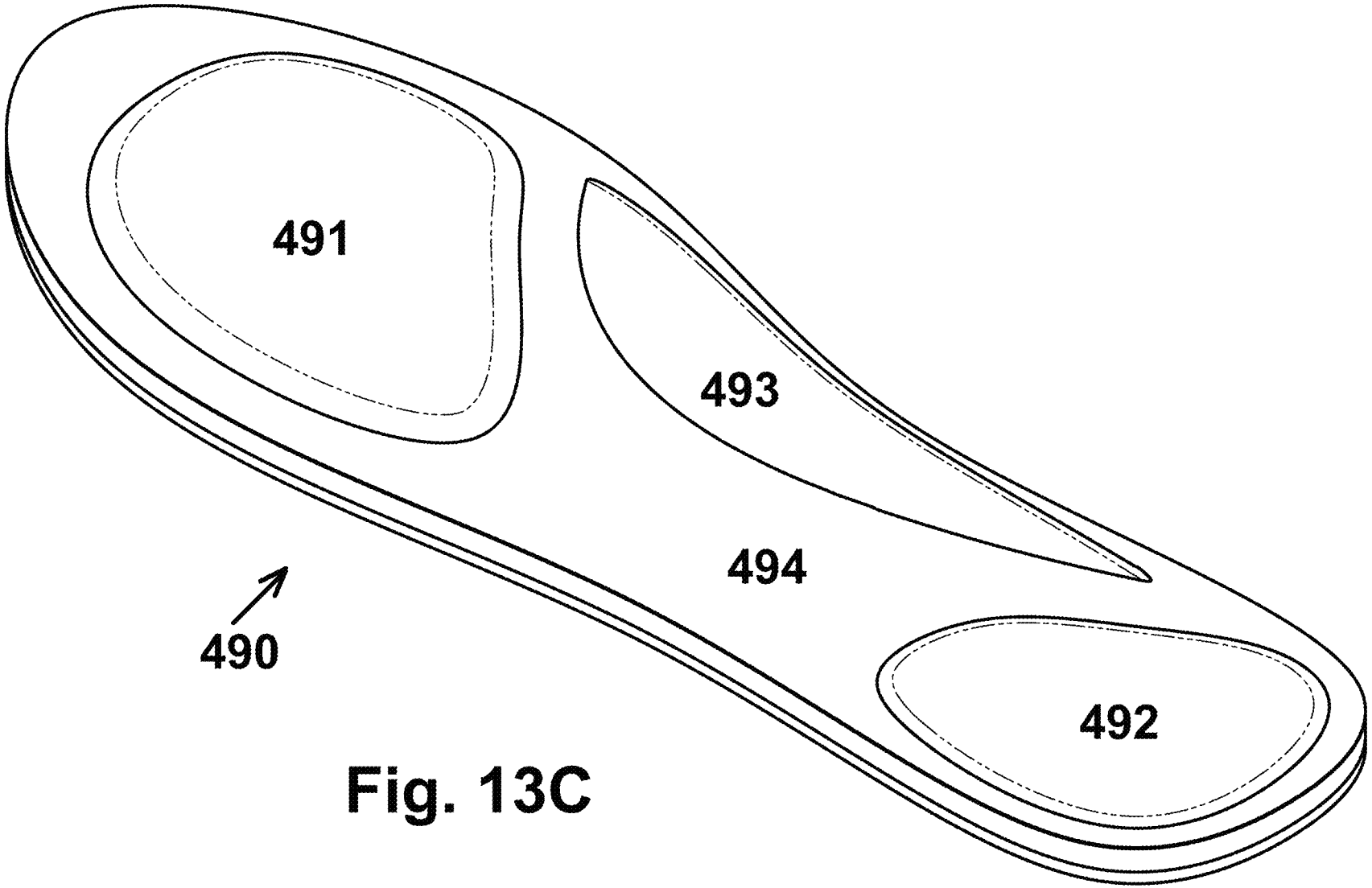
FIG. 13C is a schematic illustration of a perspective view of another insole or insert, in accordance with some demonstrative embodiments of the present invention.

Reference is made to FIG. 13C, which is a schematic illustration of a perspective view of another insole or insert 490, in accordance with some demonstrative embodiments of the present invention. The top layer 494 operates to hide the internal division into separate compartments or pockets; such that a region 491 of fabric covers the fore-foot pocket, and a region 492 of fabric covers the heel-side pocket, and a region 493 of fabric covers the multiple discrete pockets that are located beneath it.

Figure 14A:
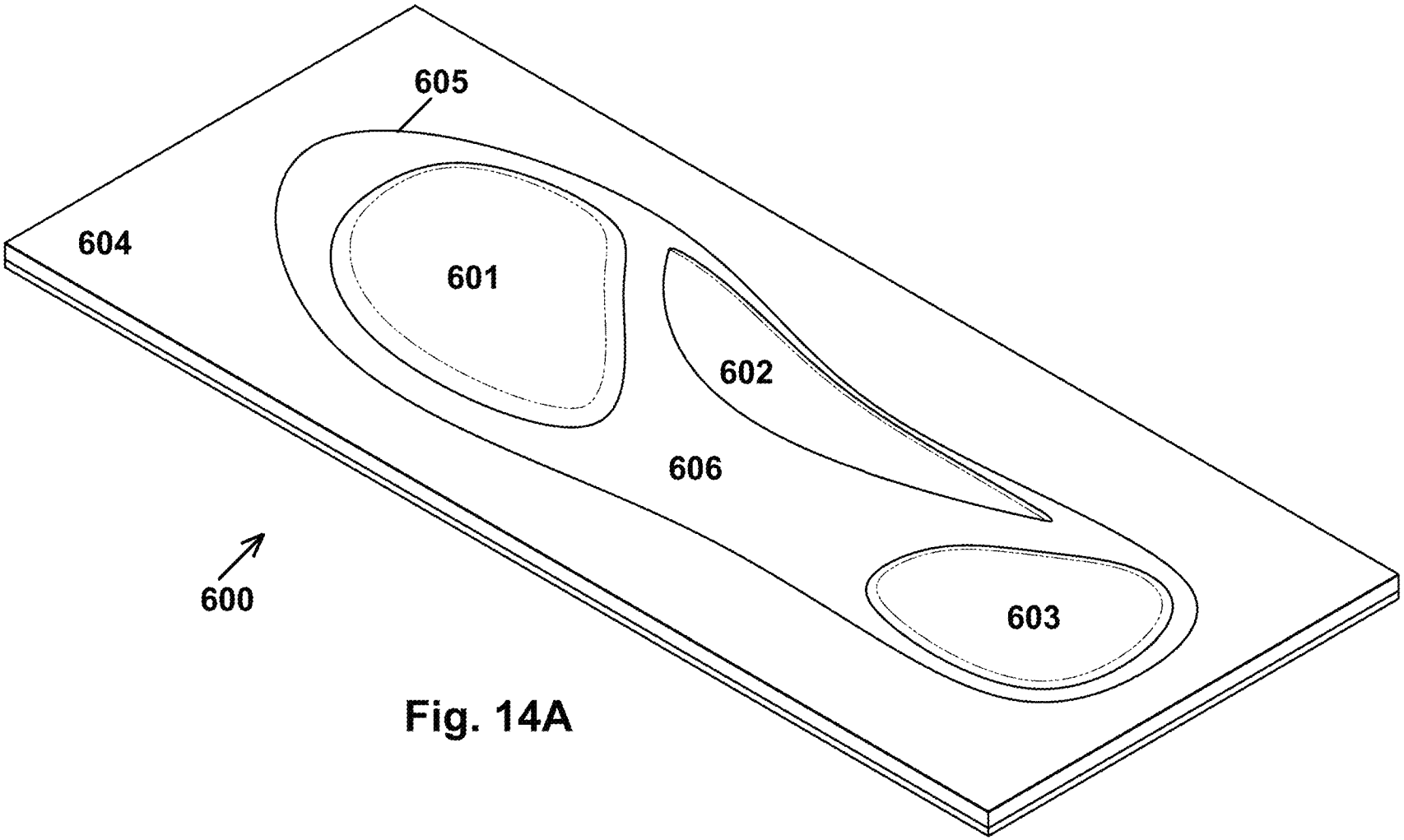
FIG. 14A is a schematic illustration of a perspective view of a cuttable article, which is convertible or cuttable into an insert or insole, in accordance with some demonstrative embodiments of the present invention.

Reference is made to FIG. 14A, which is a schematic illustration of a perspective view of a cuttable article 600, which is convertible or cuttable into an insert or insole, in accordance with some demonstrative embodiments of the present invention. Article 600 comprises therein an insert body 606, having therein multiple pockets 601-603 that store a mixture of particulate materials. However, instead of being generally foot-shaped, article 600 is provided as a larger-size item having a margin area 604 which surrounds the intended insert body 606, and optionally includes a marking 605 of the contour of such insert. The margin area 604 may be formed of the same material(s) from which the insert body 606 is formed (e.g., foamed latex, or latex foam), and may lack any pockets that store particulate materials. The cuttable article 600 is thus suitable for mass manufacturing or mass production, which may then be followed by cutting (e.g., with scissors, with a knife, with a blade, with a machine, or the like) along or near the contour marking 605 in order to achieve the desired shape or structure or size of the actual insert. Such cutting may be performed at the manufacturing facility, or at a distributor facility, or at a retail store (e.g., a shoe store), or even at the home of the final consumer or end-user who may cut the article 600 to fit the shape of his own particular foot. The manufacturing of article 600, particularly in large quantity, may facilitate the actual cutting or tailoring of a particular insert to the size or shape of the foot of a particular consumer; and/or may further facilitate the production or the mass production of a series of inserts based on gender and/or age-range and/or shoe-size and/or other parameters (e.g., a set of inserts suitable for male size US 9, or another set of inserts suitable for females size US 7.5, or the like), such that different sizes or shapes or contours may be applied to cut different inserts from the same series of multiple cuttable articles 600.

Figure 14B:
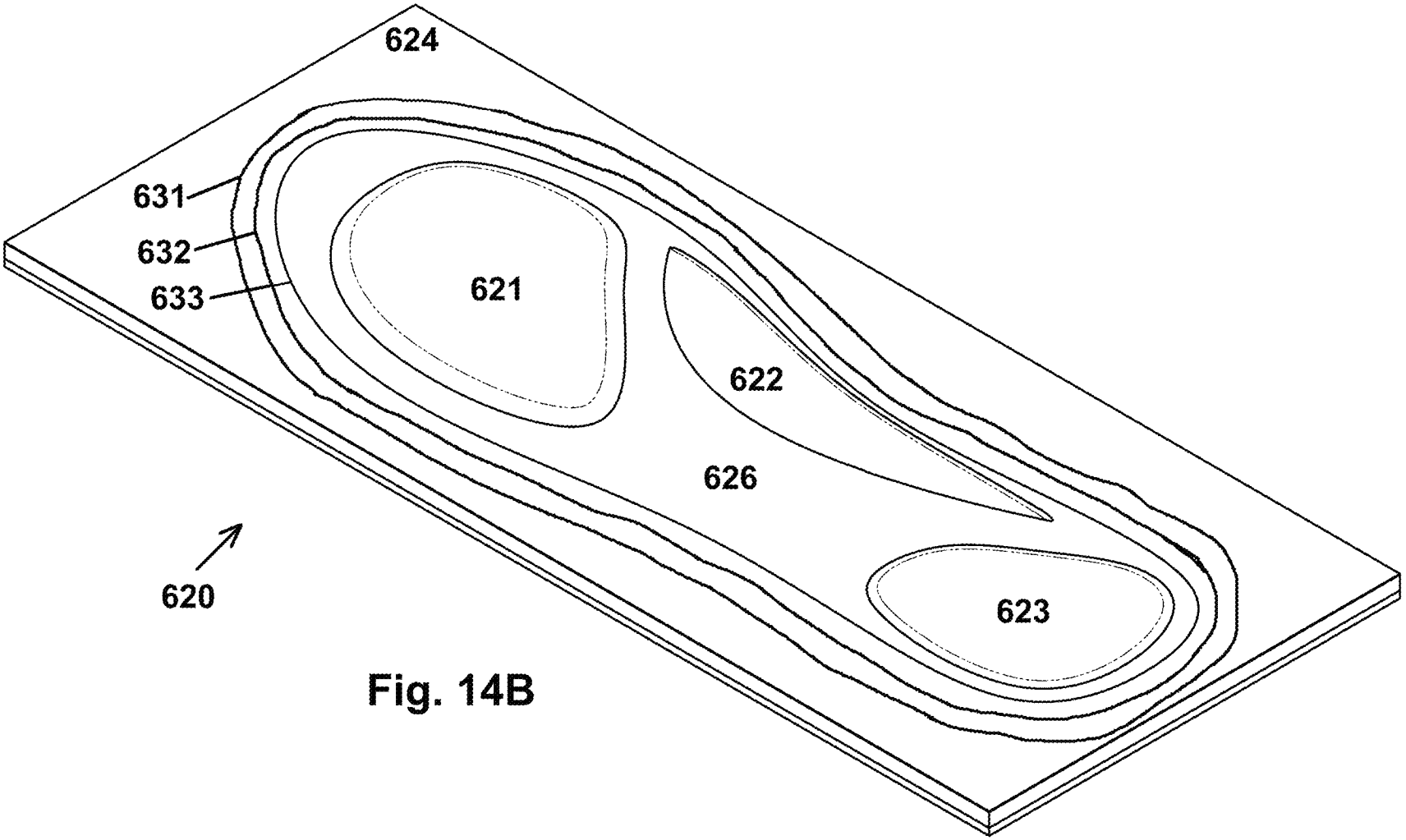
FIG. 14B is a schematic illustration of a perspective view of another cuttable article, which is convertible or cuttable into an insert or insole, in accordance with some demonstrative embodiments of the present invention.

Reference is made to FIG. 14B, which is a schematic illustration of a perspective view of another cuttable article 620, which is convertible or cuttable into an insert or insole, in accordance with some demonstrative embodiments of the present invention. Article 620 comprises therein an insert body 626, having therein multiple pockets 621-623 that store a mixture of particulate materials. However, instead of being generally foot-shaped, article 620 is provided as a larger-size item having a margin area 624 which surrounds the intended insert body 626, and optionally includes multiple possible markings 631-633 of multiple possible contours of such insert. The margin area 624 may be formed of the same material(s) from which the insert body 626 is formed (e.g., foamed latex, or latex foam), and may lack any pockets that store particulate materials. The cuttable article 620 is suitable for mass manufacturing or mass production, which may then be followed by cutting along or near one of the contour markings 631-633, in order to achieve the desired shape or structure or size of the actual insert. For example, the cuttable article 620 may be provided with an instruction manual or with other indication or message, that cutting along contour marking 631 would be suitable for a male foot of size US 10; and that cutting along contour marking 632 would be suitable for a male foot of size US 9; and that cutting along contour marking 633 would be suitable for a male foot of size US 8 or for a female foot of size 7. Such cutting may be performed at the manufacturing facility, or at a distributor facility, or at a retail store (e.g., a shoe store), or even at the home of the final consumer or end-user who may cut the article 620 to fit the shape of his own particular foot.

Figure 10:
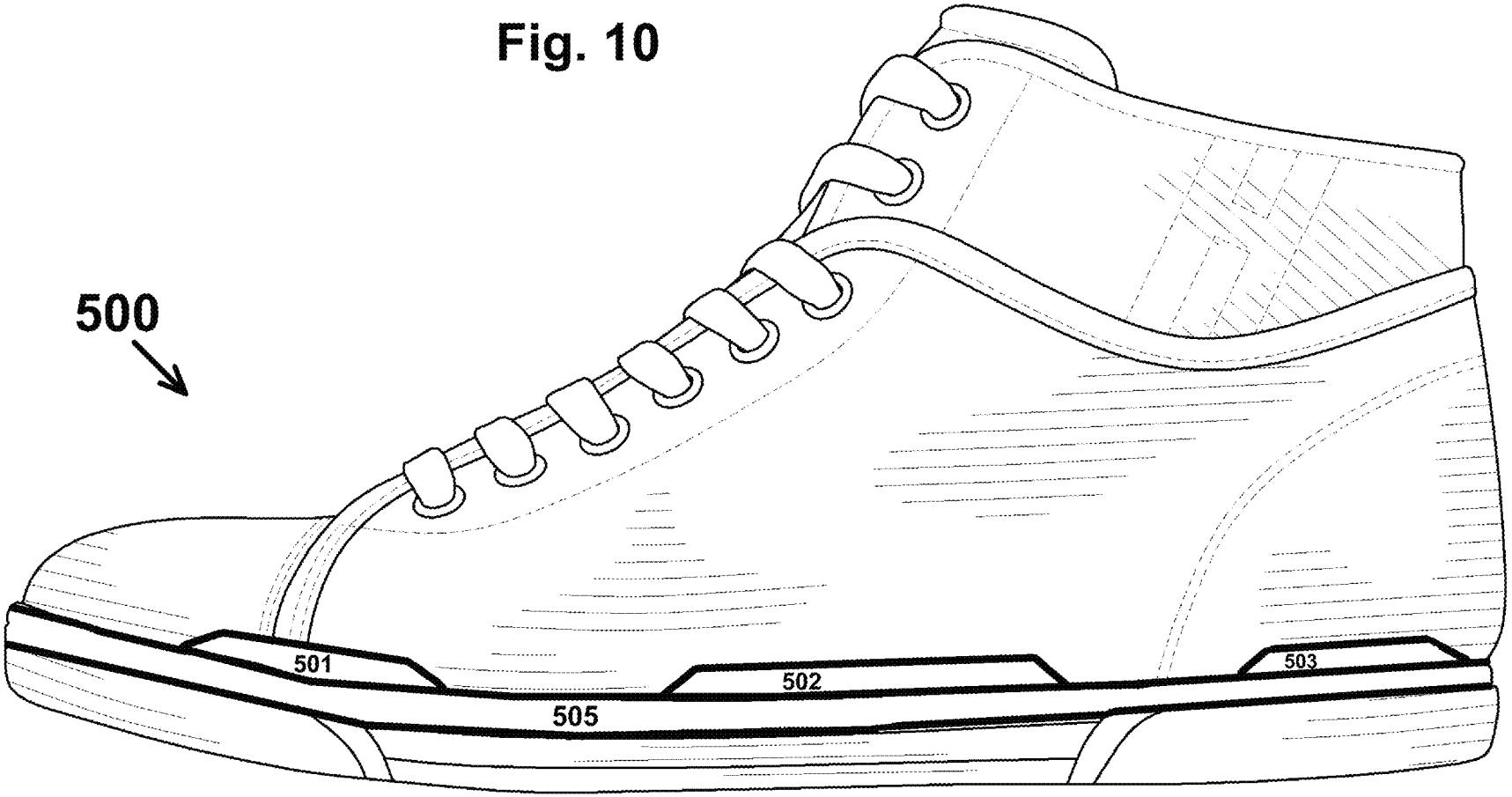
FIG. 10 is a schematic illustration of a side view of a shoe, in accordance with some demonstrative embodiments of the present invention.

Reference is made to FIG. 10, which is a schematic illustration of a side view of a shoe 500, in accordance with some demonstrative embodiments of the present invention. Shoe 500 may comprise therein an integrated or built-in or non-removable set of pockets or chambers 501-503; each such pocket or chamber (501, 502, 503) storing or containing the mixture of particulate materials described above or herein. For demonstrative purposes, three such pockets 501-503 are shown, as a front-side pocket 501 (e.g., under the fore-foot), a central pocket 502 (e.g., under the medial arch), and a rear pocket 503 (e.g., under the heel). The pockets 501-503 may be mounted or attached onto one or more of the layers 505 of the sole of the shoe. Such pockets 501-503, and the sole layer 505 to which they are connected, are depicted in thicker black lines, for demonstrative purposes; and may not necessarily be visible to a viewer that looks at the shoe from the side. Embodiments of the present invention include also other types of shoes or footwear, and are not limited to the structure or type of shoe that is depicted in this demonstrative example.

Figure 11:
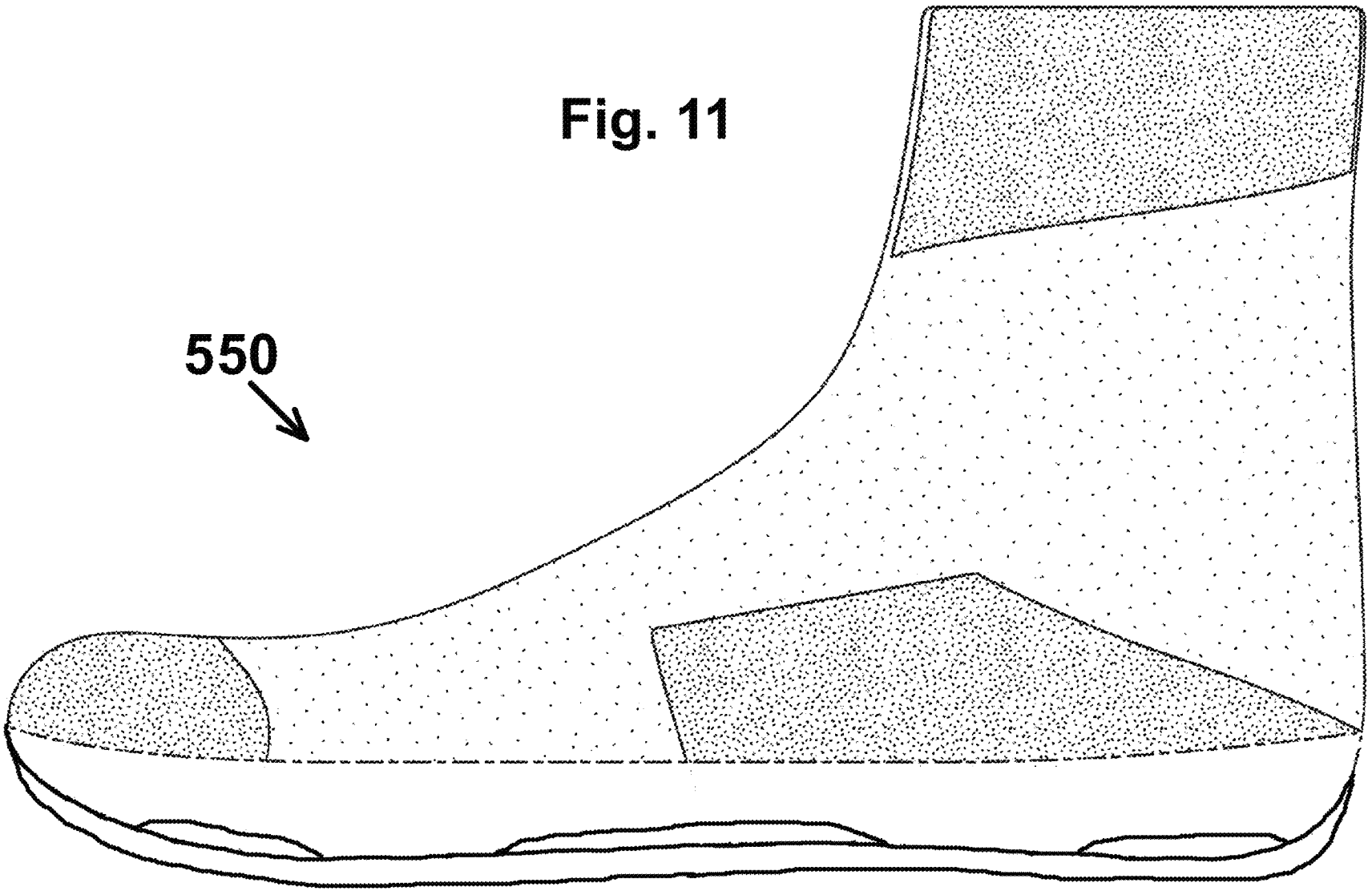
FIG. 11 is a schematic illustration of a side view of a sock, in accordance with some demonstrative embodiments of the present invention.

Reference is made to FIG. 11, which is a schematic illustration of a side view of a sock 550, in accordance with some demonstrative embodiments of the present invention. Sock 550 may comprise therein an integrated or built-in or non-removable set of pockets or chambers, or alternatively, the insole of the present invention which may be removable from the sock and/or replaceable; each such pocket or chamber storing or containing the mixture of particulate materials described above or herein. For demonstrative purposes, three such pockets are shown, as a front-side pocket (e.g., under the fore-foot), a central pocket (e.g., under the medial arch), and a rear pocket (e.g., under the heel). The pockets may be mounted or attached or glued or bonded onto one or more of the internal layers of the sock, such as, onto an internal fabric layer of the sock; or, the pockets may be integrated in an insole (e.g., formed of Foamed Latex or Latex Foam), and the insole itself may be inserted into a fabric sock and may be glued or bonded or attached to it internally and fixedly and non-removably. In some embodiments, optionally, the insole may be knitted or stitched internally within the sock, using fabric threads or yarn or stitches or knitting. Such pockets, and the insole layer to which they are connected internally within the sock, are depicted in thicker black lines, for demonstrative purposes; and may not necessarily be visible to a viewer that looks at the sock from the side. Embodiments of the present invention include also other types of socks or stockings, and are not limited to the structure or type of sock that is depicted in this demonstrative example.

In some embodiments, the sock may be elastic, and/or may enable human sweat to evaporate. Within the sock, at the floor or the bottom side of the sock, internally, the insole of the present invention is located. The insole may be fixedly connected to the sock, or may be detachably attached to the sock in a manner that enables the user to remove the insole and replace it (e.g., in order to wash the sock separately from the insole; although, in some embodiments, the sock with the internal insole and its pockets may be washed together as a unified item). Optionally, the bottom side of the sock, at its external side, may comprise three-dimensional protrusions of ribs, formed of fabric and/or silicon and/or rubber, to increase friction and/or to reduce risk of slipping. Optionally, the sock may include particular marks or markings or printed indicators or knitted indicators or color-coded fabric elements, to indicate to the user the correct location for placement of the insole, in the case of a removable/replaceable insole.

The integrated sole within the sock, may stimulate the human foot and its muscles and nerves and bones, and may trigger the human foot to fidget with the pockets and/or to engage with the pockets; thereby triggering or stimulating the wearer to shrink and expand his toes or phalanges, even while the user is sitting or standing still or lying down; thereby increasing blood flow to or from or within the foot, and mitigating or preventing thrombosis or deep vein thrombosis (DVT), particularly in situations in which the user is generally non-moving (e.g., in a long flight, in a long car trip, or the like).

Figure 12:
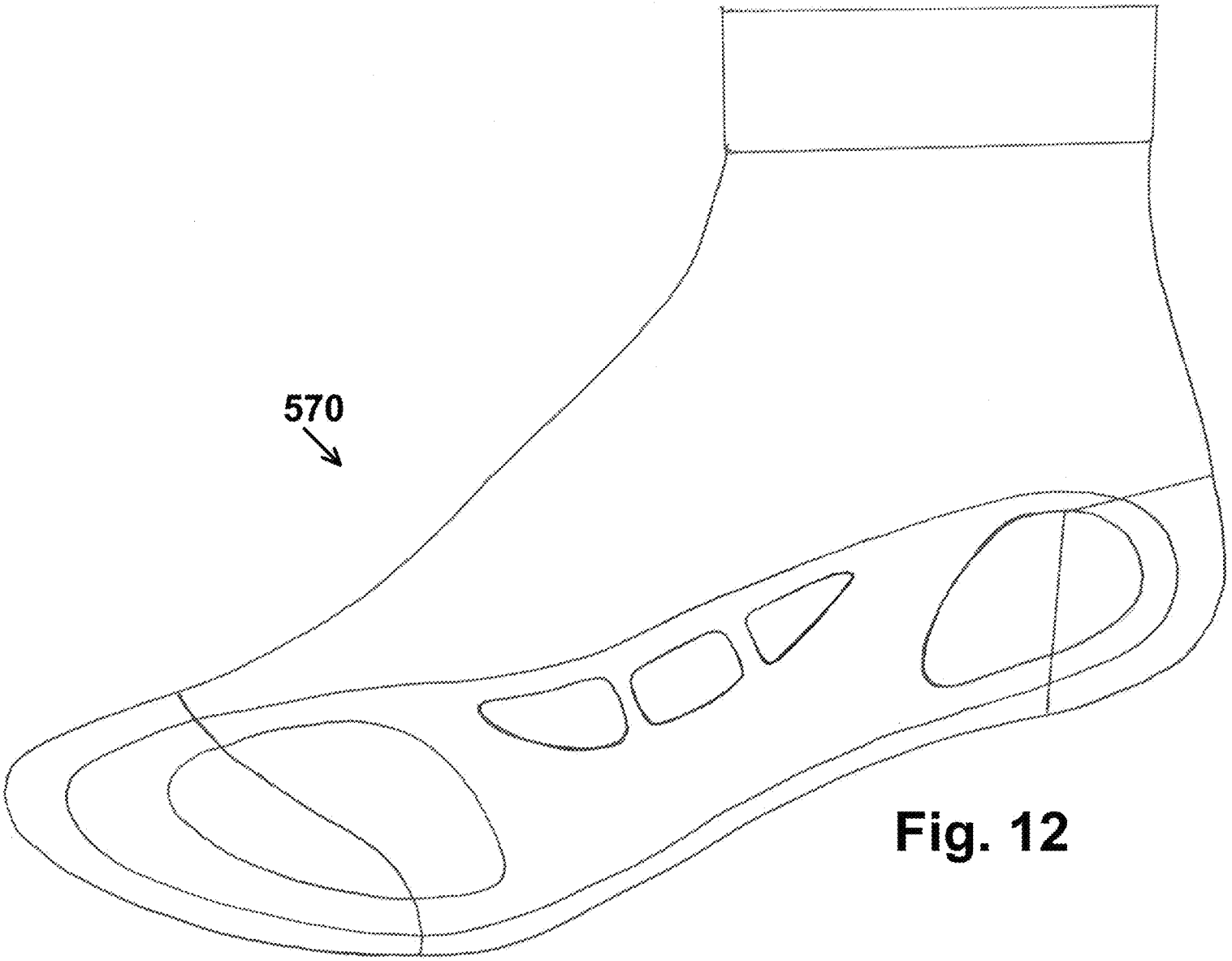
FIG. 12 is a schematic illustration of a sock, in accordance with some demonstrative embodiments of the present invention.

Reference is made to FIG. 12, which is a schematic illustration of a sock 570, in accordance with some demonstrative embodiments of the present invention. Sock 570 may include the insole with pockets storing the mixture of materials in accordance with the present invention. Optionally, the bottom side of the insole itself, and/or the bottom side of the sock, may comprise three-dimensional protrusions or ribs or knitting or a knitted pattern or portions of added fabric or foamed bubbles or foamed bubble-like structures made of latex or other material, in order to increase friction and/or make the insole less slippery and/or make the sock less slippery. The sock may be knitted or formed of one or more suitable materials; for example, cotton, wool, silk, polyester, Spandex, Lycra, Elastane, polyamide, or the like.

Some embodiments of the present invention provide an article comprising: an insole comprising at least a base layer, and a plurality of discrete clastic shape-shifting pockets that are attached to said base layer and are protruding upwardly relative to said base layer; wherein each one of the plurality of elastic shape-shifting pockets stores a mixture of two or more particulate materials which comprise at least: (i) one or more materials selected from group A which consists of: natural sand, synthetic sand, artificial sand, kinetic sand, silica, quartz; and (ii) one or more materials selected from group B which consists of: powdered aluminum, powdered titanium, powdered zinc, powdered magnesia, powdered silver, powdered anti-bacterial agent, powdered metal, powdered talcum, grained cork, grained coal, grained wood.

In some embodiments, content of a first pocket of said plurality of pockets, remains separate from and does not mix with content of any other pocket of said plurality of pockets.

In some embodiments, said insole comprises a top layer of fabric that ensures that content stored in any pocket of said plurality of pockets, remains separate from and does not directly touch a foot of a wearer who places his foot directly on said insole.

In some embodiments, each pocket of said plurality of pockets dynamically compresses in response to applied force by a human foot, and dynamically expands back to a non-compressed position upon removal or reduction of said force by the human foot.

In some embodiments, each pocket of said plurality of pockets comprises a cavity that is defined by: (I) said base layer of said insole operating as a lower panel of said pocket, and (II) a top layer of said insole operating as an upper panel of said pocket, and (III) a middle layer of said insole which is sandwiched between the base layer and the top layer of the insole, wherein a cut-out in said middle layer defines a cavity in which said mixture is stored, and wherein said middle layer operates as side panels of said pocket.

In some embodiments, said top layer of said insole comprises a fabric selected from the group consisting of: Spandex, Lycra, Elastane, elastic fabric, semi-elastic fabric; wherein said fabric locks-in the plurality of pockets and prevents said mixture from directly touching a foot of a human wearer.

In some embodiments, said plurality of pockets comprises exactly two pockets; wherein a first pocket of said plurality of pockets is a front-side pocket, located at a front side of said insole and positioned to support a fore-foot of a human wearer; wherein a second pocket of said plurality of pockets is a rear-side pocket, located at a rear side of said insole and positioned to support a heel of said human wearer.

In some embodiments, said plurality of pockets comprises exactly three pockets; wherein a first pocket of said plurality of pockets is a front-side pocket, located at a front side of said insole and positioned to support a fore-foot of a human wearer; wherein a second pocket of said plurality of pockets is a rear-side pocket, located at a rear side of said insole and positioned to support a heel of said human wearer; wherein a third pocket of said plurality of pockets is a side pocket, located at a non-front non-rear side of said insole and positioned to support a medial arch of said human wearer.

In some embodiments, wherein said plurality of pockets comprises at least three pockets; wherein a first pocket of said plurality of pockets is a front-side pocket, located at a front side of said insole and positioned to support a fore-foot of a human wearer; wherein a second pocket of said plurality of pockets is a rear-side pocket, located at a rear side of said insole and positioned to support a heel of said human wearer; wherein a third pocket of said plurality of pockets is a side pocket, located at a non-front non-rear side of said insole and positioned to support a medial arch of said human wearer, wherein said side pocket is comprised of two or more discrete pockets which store said mixture separate from each other and which are able to shape-shift independently from each other.

In some embodiments, said plurality of pockets comprises at least three pockets; wherein a first pocket stores said mixture at a first weight in the range of 5 to 40 grams; wherein a second pocket stores said mixture at a second weight in the range of 5 to 50 grams; wherein a third pocket stores said mixture at a third weight in the range of 2 to 30 grams.

In some embodiments, each pocket of said plurality of pockets is capable of moving (e.g., changing its spatial organization or its spatial arrangement or its spatial height) and shape-shifting (e.g., changing from a high-height semi-sphere to a low-height portion-of-sphere), in response to force applied by a human foot, independently of movement or shape-shifting of any other pockets of said plurality of pockets.

In some embodiments, a first pocket of said plurality of pockets stores a first mixture of particulate materials; wherein a second pocket of said plurality of pockets stores a second, different, mixture of particulate materials.

In some embodiments, a first pocket of said plurality of pockets stores a first mixture of particulate materials; wherein a second pocket of said plurality of pockets stores a second, different, mixture of particulate materials; wherein the first mixture comprises a first set of particulate materials; wherein the second mixture comprises a second, different, set of particulate materials.

In some embodiments, a first pocket and a second pocket of said plurality of pockets store a same set of particulate materials but at different mixture ratios.

In some embodiments, a first pocket and a second pocket of said plurality of pockets store a same set of particulate materials but at different mixture weights.

In some embodiments, any one pocket of said plurality of pockets stores not more than 50 grams of mixture of particulate materials; wherein all of said plurality of pockets, store in aggregate not more than 100 grams of mixture of particulate materials.

In some embodiments, by weight, at least 50 percent of said mixture is one or more particulate materials from group A; and, a remainder of said mixture is one or more particulate materials from group B.

In some embodiments, by weight, at least 70 percent of said mixture is one or more particulate materials from group A; and, a remainder of said mixture is one or more particulate materials from group B.

In some embodiments, by weight, at least 90 percent of said mixture is one or more particulate materials from group A; and, a remainder of said mixture is one or more particulate materials from group B.

In some embodiments, by volume, at least 50 percent of said mixture is one or more particulate materials from group A; and, a remainder of said mixture is one or more particulate materials from group B.

In some embodiments, by volume, at least 70 percent of said mixture is one or more particulate materials from group A; and, a remainder of said mixture is one or more particulate materials from group B.

In some embodiments, by volume, at least 90 percent of said mixture is one or more particulate materials from group A; and, a remainder of said mixture is one or more particulate materials from group B.

In some embodiments, the article is said insole which is insertable into a shoe and is removable from said shoe.

In some embodiments, the article is a shoe, wherein said insole is an integrated layer of a sole of said shoe.

In some embodiments, the article is a sock, wherein said insole is fixedly and non-removably attached to an internal fabric of said sock.

In some embodiments, the article is a sock, wherein said insole is detachably attached to an internal fabric of said sock and is removable from said sock without damaging said sock.

In some embodiments, the article is a cuttable item having an insert with said multiple pockets embedded therein and being cuttable to produce a foot-shaped insert.

Ranges of values that are detailed above, include therein also the margin values themselves of such ranges. For example, the term "in the range of M to N", includes therein also the value M and the value N.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments", "some embodiments", and/or similar terms, may indicate that the embodiment(s) so described may optionally include a particular feature, structure, or characteristic, but not every embodiment necessarily includes the particular feature, structure, or characteristic. Furthermore, repeated use of the phrase "in one embodiment" does not necessarily refer to the same embodiment, although it may. Similarly, repeated use of the phrase "in some embodiments" does not necessarily refer to the same set or group of embodiments, although it may.

As used herein, and unless otherwise specified, the utilization of ordinal adjectives such as "first", "second", "third", "fourth", and so forth, to describe an item or an object, merely indicates that different instances of such like items or objects are being referred to; and does not intend to imply as if the items or objects so described must be in a particular given sequence, either temporally, spatially, in ranking, or in any other ordering manner.

Figure 15:
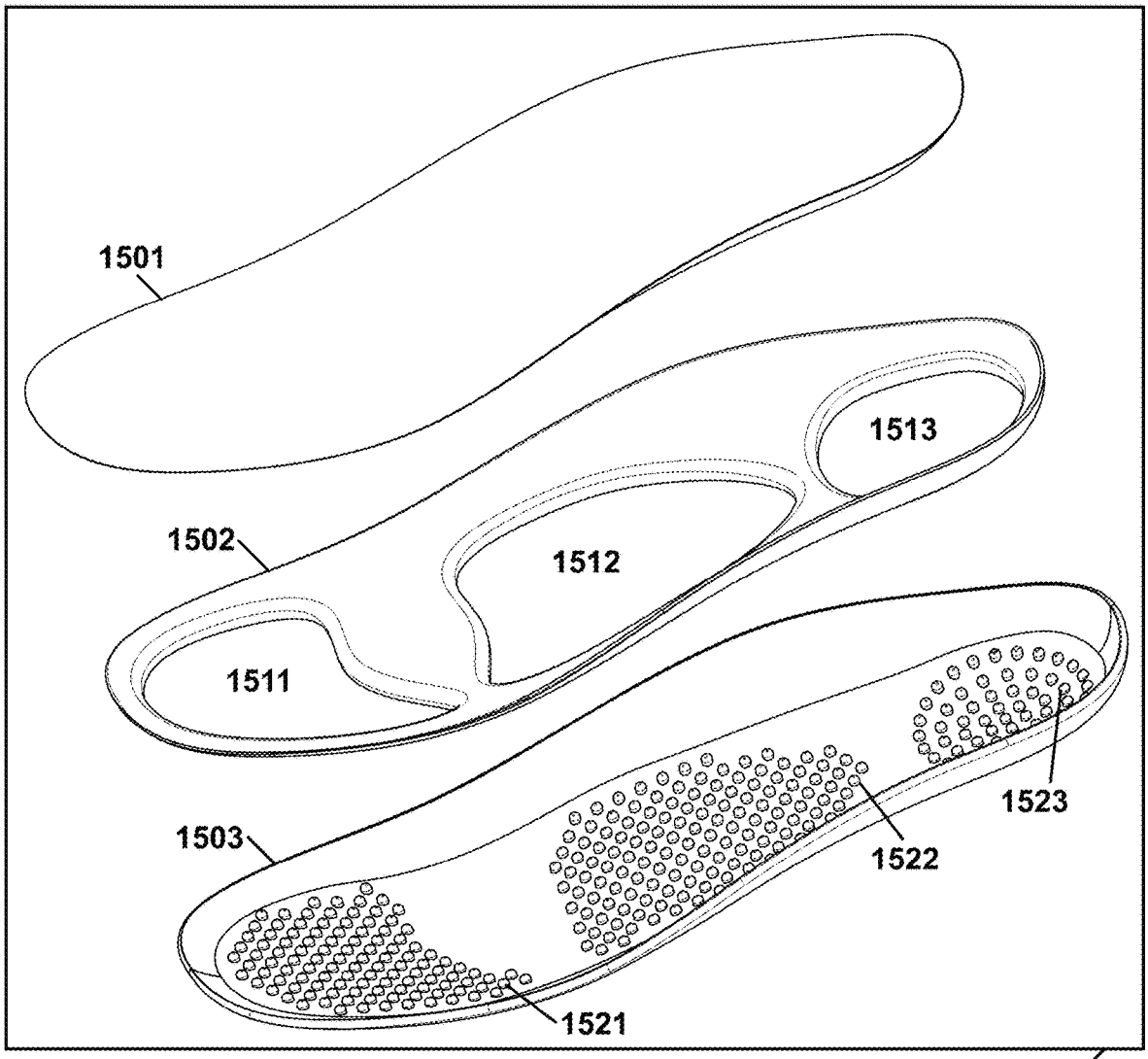
FIG. 15 is a schematic illustration of a set of three layers of an insole, in accordance with some demonstrative embodiments of the present invention.

Reference is made to FIG. 15, which is a schematic illustration of a set 1500 of three layers of an insole, in accordance with some demonstrative embodiments of the present invention; the insole comprising at least such three layers, and optionally comprising one or more additional layers, such as glue layer(s), bonding layer(s), support layer(s), protrusions layer(s), or the like. The multiple layers of the insole may be connected or bonded or glued to each other, using one or more connection mechanisms or bonding mechanisms, such as glue, bonding material, heat-press, double-sided glue, single-sided glue, glue layer(s), or the like.

The present invention may comprise an insole comprising multiple layers, such as 3 or 4 or 5 layers; wherein the insole comprise one or more regions or pockets or chambers that store a mixture of sand with one or more other particulate material(s) or fine-grained material(s), and especially with an anti-bacterial agent or material in such mixture. The mixture may be within dedicated pockets or chambers that are part of a particular layer of the insole; and/or the mixture may be within cavities that are formed between two adjacent layers of the insole due to their three-dimensional structure which traps or holds in place such mixture.

For example, a first layer 1501 ("top layer") of the insole may be the top-most layer. It may be formed of a polymer or a co-polymer, or from a fabric, or from a thin non-knitted fabric, or from a polyester based fabric or a synthetic fabric, or from an clastic fabric that can withstand friction and physical forces. In some embodiments, the first layer of the insole may include two, or three, of the above-mentioned synthetic fabric, in order to reduce or decrease the friction between the foot of the human wearer and the stored mixture of sand and other material(s); wherein such two (or three) layers of fabric may be glued or bonded to each other. In other embodiments, the first layer of the insole may include one such layer of synthetic fabric, which may be formed as having thickness that is equivalent to two or three conventional layers of that fabric.

The thickness of the first layer of the insole may be, for example: 1 millimeter; or 1.5 millimeters; or 2 millimeters; or 3 millimeters; or 0.5 millimeter; or may be in the range of 1 to 2 millimeters; or may be in the range of 1 to 3 millimeters; or may be in the range of 0.5 to 2 millimeters; or may be in the range of 0.5 to 3 millimeters; or may be in the range of 0.5 to 1 millimeters; or may be in the range of 0.5 to 1.5 millimeters. In some embodiments, the first layer of the thickness has uniform thickness. In other embodiments, optionally, the first layer of the insole has differential thickness, such that one or more regions of the first layer have a first thickness, whereas one or more other regions of that first layer have a second, different, thickness; for example, providing a greater thickness of the first layer fabric in regions that are located immediately above the stored mixture.

A second layer 1502 ("middle layer") of the insole is located under or beneath the first layer. The second layer is formed of an Ethylene-Vinyl Acetate (EVA) polymer. The second layer of the insole has two or three or four cavities or holes or apertures, such as apertures 1511, 1512 and 1513; which are then filled with (or, which store therein) the unique mixture of the present invention, of sand with anti-bacterial agent(s) and with other particulate or granular material(s). In some embodiments, such holes or apertures or cavities in the second layer of the insole may comprise, for example: (i) a first cavity located at or under the toes area; (ii) a second cavity located at or under the human sole area and/or the human instep area and/or the arch of the foot; (iii) a third cavity located at or under the heel area.

In some embodiments, the average thickness of the second layer of the insole, may be greater than the average thickness of the first layer of the insole. In some embodiments, the average thickness of the second layer of the insole, may be at least 1.5 times the average thickness of the first layer of the insole. In some embodiments, the average thickness of the second layer of the insole, may be at least 2 times the average thickness of the first layer of the insole. In some embodiments, the average thickness of the second layer of the insole, may be at least 2.5 times the average thickness of the first layer of the insole. In some embodiments, the average thickness of the second layer of the insole, may be at least 3 times the average thickness of the first layer of the insole.

In some embodiments, the average thickness of the second layer of the insole, may be greater than the uniform thickness of the first layer of the insole which has a uniform thickness. In some embodiments, the average thickness of the second layer of the insole, may be at least 1.5 times the uniform thickness of the first layer of the insole which has a uniform thickness. In some embodiments, the average thickness of the second layer of the insole, may be at least 2 times the uniform thickness of the first layer of the insole which has a uniform thickness. In some embodiments, the average thickness of the second layer of the insole, may be at least 2.5 times the uniform thickness of the first layer of the insole which has a uniform thickness. In some embodiments, the average thickness of the second layer of the insole, may be at least 3 times the uniform thickness of the first layer of the insole which has a uniform thickness.

In some embodiments, the average thickness of the second layer of the insole may be, for example: 1 millimeter; or 1.5 millimeters; or 2 millimeters; or 3 millimeters; or 4 millimeters; or 5 millimeters or 6 millimeters; or 7 millimeters.

In some embodiments, the maximum thickness of the second layer of the insole may be, for example: 2 millimeters; or 3 millimeters; or 4 millimeters; or 5 millimeters or 6 millimeters; or 7 millimeters.

In some embodiments, the second layer of the insole is thicker at its central region and is thinner at is marginal regions. For example, the maximum thickness of a central core or a central region of the second layer of the insole, may be 4 or 5 or 6 millimeters; whereas, the maximum thickness of one or more marginal or margin-neighboring region(s) of the second layer of the insole may be 1 or 2 millimeters. In some embodiments, the maximum thickness of a central region of the second layer of the insole, is at least 2 or 2.5 or 3 times the maximum thickness of the marginal region(s) of the second layer of the insole.

In some embodiments, the second layer of the insole may have a thicker central region and thinner margins or marginal regions, in order to enable the creation of cavities or holes in the second layer that would have sufficient volume to store therein a sufficient quantity of the unique mixture; and/or such that the margins of the second layer of the insole may operate as "wing" structure that assist in anchoring the insole to a shoe or to other footwear; and/or such that the marginal regions or the margins of the insole may allow an increased area for gluing or bonding of the insole layers and thus improved trapping or improved sandwiching of the special mixture within the cavities of the second layer, and preventing an escape of the special mixture away from those cavities.

An optional additional layer of the insole may located under or beneath the second layer. This optional layer is a layer of glue, or double-sided glue, or other bonding material or gluing material or double-sided gluing material or gluing element. The optional layer may assist in one or more functions; for example, in bonding together or holding together the multiple layers of the insole; in trapping or sandwiching the special mixture within the cavities; in facilitating the production process of the multi-layer insole; or the like.

A third layer 1503 ("the bottom layer", or the lowest layer) of the insole is located under or beneath the second layer; or, it may be located beneath the optional glue layer if such optional layer is included immediately beneath the second layer. The third layer is formed of an Ethylene-Vinyl Acetate (EVA) polymer.

While the Second layer (the middle layer) of the insole is formed of an EVA polymer and is generally smooth, and lacks any protrusions or ribs, the Third layer (the bottom layer) of the insole is formed of an EVA polymer but is non-smooth, and has three-dimensional protrusions or ribs or craters.

Specifically, the Third layer (the bottom layer, or the lowest layer) of the insole comprises integrated upwardly-facing protrusions or ribs that are protruding upwardly towards the second layer, and that are located specifically underneath the cavities that store the special mixture. For example, regions of the bottom layer of the insole (e.g., regions 1521, 1522, and 1523), which are vertically underneath the mixture-storing cavities of the middle layer of the insole, have those integral or integrated upwardly-facing protrusions or ribs; whereas, regions of the bottom layer of the insole, which are not vertically underneath the mixture-storing cavities of the middle layer of the insole, lack such upwardly-facing protrusions or ribs.

The upwardly-facing or upwardly-pointing protrusions or ribs, in the bottom layer of the insole, may perform one or more functions; for example, they may assist in creating a desired friction between the human foot and the stored mixture, and/or they may reduce movement of the special mixture within the cavity that stores it. It is noted that the bottom-side or the bottom-facing side of the third layer of the insole, is smooth and lacks protrusions or ribs.

Some embodiments of the present invention include an article comprising: a stand-alone insole, which is insertable into a shoe and is removable from said shoe; the insole comprising at least: a bottom layer formed of Ethylene-Vinyl Acetate (EVA) polymer; a middle layer formed of Ethylene-Vinyl Acetate (EVA) polymer; and a top layer formed of a co-polymer; wherein the middle layer comprises apertures therein; wherein said apertures in the middle layer, with corresponding portions of the top layer that are above said apertures, and with corresponding portions of the bottom layer that are beneath said apertures, define two or more internal discrete storage chambers within said insole; wherein each of said internal discrete storage chambers stores therein a mixture of two or more particulate materials which comprise at least: (i) one or more materials selected from Group A, wherein Group A consists of: natural sand, synthetic sand, artificial sand, kinetic sand, silica, quartz; and (ii) one or more materials selected from Group B, wherein Group B consists of: powdered aluminum, powdered titanium, powdered zinc, powdered magnesia, powdered silver, powdered anti-bacterial agent, powdered metal, powdered talcum, grained cork, grained coal, grained wood.

In some embodiments, content of a first storage chamber of the insole, remains separate from and does not mix with content of any other storage chamber of said insole.

In some embodiments, each storage chamber of the insole dynamically compresses in response to applied force by a human foot, and dynamically expands back to a non-compresses position upon removal or reduction of said applied force.

In some embodiments, each storage chamber of the insole is capable of shape-shifting, in response to force applied by the human foot, independently of shape-shifting of any other storage chamber of the insole.

In some embodiments, said storage chambers are exactly two storage chambers; wherein a first storage chamber is a front-side storage chamber, and is located at a front side of the insole, and is positioned to support a fore-foot of a human wearer; wherein a second storage chamber is a rear-side storage chamber, and is located at a rear side of the insole, and is positioned to support a heel of said human wearer; wherein each one of the first storage chamber and the second storage chamber is capable of shape-shifting, independently of any other storage chamber, in response to applied force by the human foot.

In some embodiments, said storage chambers are exactly three storage chambers;

wherein a first storage chamber is a front-side storage chamber, and is located at a front side of the insole, and is positioned to support a fore-foot of a human wearer; wherein a second storage chamber is a rear-side storage chamber, and is located at a rear side of the insole, and is positioned to support a heel of said human wearer; wherein a third storage chamber is a side storage chamber, and is located at a non-front non-rear side of the insole, and is positioned to support a medial arch of said human wearer; wherein each one of the first storage chamber, the second storage chamber, and the third storage chamber is capable of shape-shifting, independently of any other storage chamber, in response to applied force by the human foot.

In some embodiments, said storage chambers comprise at least four storage chambers; wherein a first storage chamber is a front-side storage chamber, and is located at a front side of the insole, and is positioned to support a fore-foot of a human wearer; wherein a second storage chamber is a rear-side storage chamber, and is located at a rear side of the insole, and is positioned to support a heel of said human wearer; wherein a third storage chamber and a fourth storage chamber are two discrete side storage chambers, and are located at a non-front non-rear side of the insole, and are positioned to support a medial arch of said human wearer; wherein each one of the first storage chamber, the second storage chamber, the third storage chamber, and the fourth storage chamber, is capable of shape-shifting, independently of any other storage chamber, in response to applied force by the human foot.

In some embodiments, said storage chambers comprise at least three discrete storage chambers; wherein a first storage chamber stores said mixture at a first weight in the range of 5 to 40 grams; wherein a second storage chamber stores said mixture at a second weight in the range of 5 to 50 grams; wherein a third storage chamber stores said mixture at a third weight in the range of 2 to 30 grams.

In some embodiments, the top layer of the insole comprises a fabric selected from the group consisting of: Spandex, Lycra, Elastane, clastic fabric, semi-elastic fabric; wherein said fabric locks-in each of said storage chambers, and prevents said mixture from directly touching the foot of the human wearer, and prevents said mixture from escaping out of said storage chambers.

In some embodiments, a first storage chamber of the insole stores therein a first mixture of particulate materials; wherein a second storage chamber of the insole stores therein a second, different, mixture of particulate materials.

In some embodiments, a first storage chamber of the insole stores therein a first mixture of particulate materials; wherein a second storage chamber of the insole stores therein a second, different, mixture of particulate materials; wherein the first mixture comprises a first combination of particulate materials; wherein the second mixture comprises a second, different, combination of particulate materials.

In some embodiments, a first storage chamber of the insole and a second storage chamber of the insole store a same set of particulate materials but at different mix ratios; wherein the first storage chamber stores the mixture having a first mix ratio R1; wherein the second storage chamber stores the mixture having a second, different, mix ratio R2.

In some embodiments, a first storage chamber of the insole and a second storage chamber of the insole store a same set of particulate materials but at different weights; wherein the first storage chamber stores the mixture having a first weight W1; wherein the second storage chamber stores the mixture having a second, different, weight W2.

In some embodiments, any one storage chamber of the insole stores not more than 50 grams of mixture of particulate materials; wherein all the storage chambers of the insole store in aggregate not more than 100 grams of mixture of particulate materials.

In some embodiments: by weight, at least 50 percent of said mixture is one or more particulate materials from Group A; wherein a remainder of said mixture is one or more particulate materials from Group B.

In some embodiments: by volume, at least 50 percent of said mixture is one or more particulate materials from Group A; wherein a remainder of said mixture is one or more particulate materials from Group B.

In some embodiments, the top layer has generally smooth surfaces; wherein the middle layer has generally smooth surfaces (lacks protrusions); wherein the bottom layer has a bottom surface that is generally smooth (lacks protrusions); wherein the bottom layer has an upper-facing surface having integrated upwardly-pointing protrusions.

In some embodiments, the top layer has generally smooth surfaces (lacks protrusions); wherein the middle layer has generally smooth surfaces (lacks protrusions); wherein the bottom layer has a bottom surface that is generally smooth (lacks protrusions); wherein the bottom layer has an upper-facing surface, which has integrated upwardly-pointing protrusions that are located only at regions that are beneath said apertures of the middle layer of the insole.

In some embodiments, the insole further comprises a fourth layer, which is formed of glue, and is located between the middle layer and the bottom layer.

In some embodiments, the top layer has a uniform thickness which is in the range of 1 millimeter to 2 millimeters; wherein the middle layer has differential non-uniform thickness; wherein an average thickness of the middle layer is greater than the uniform thickness of the top layer; wherein a central region of the middle layer has a thickness that is greater than the thickness of marginal regions of the middle layer.

Figure 16A:
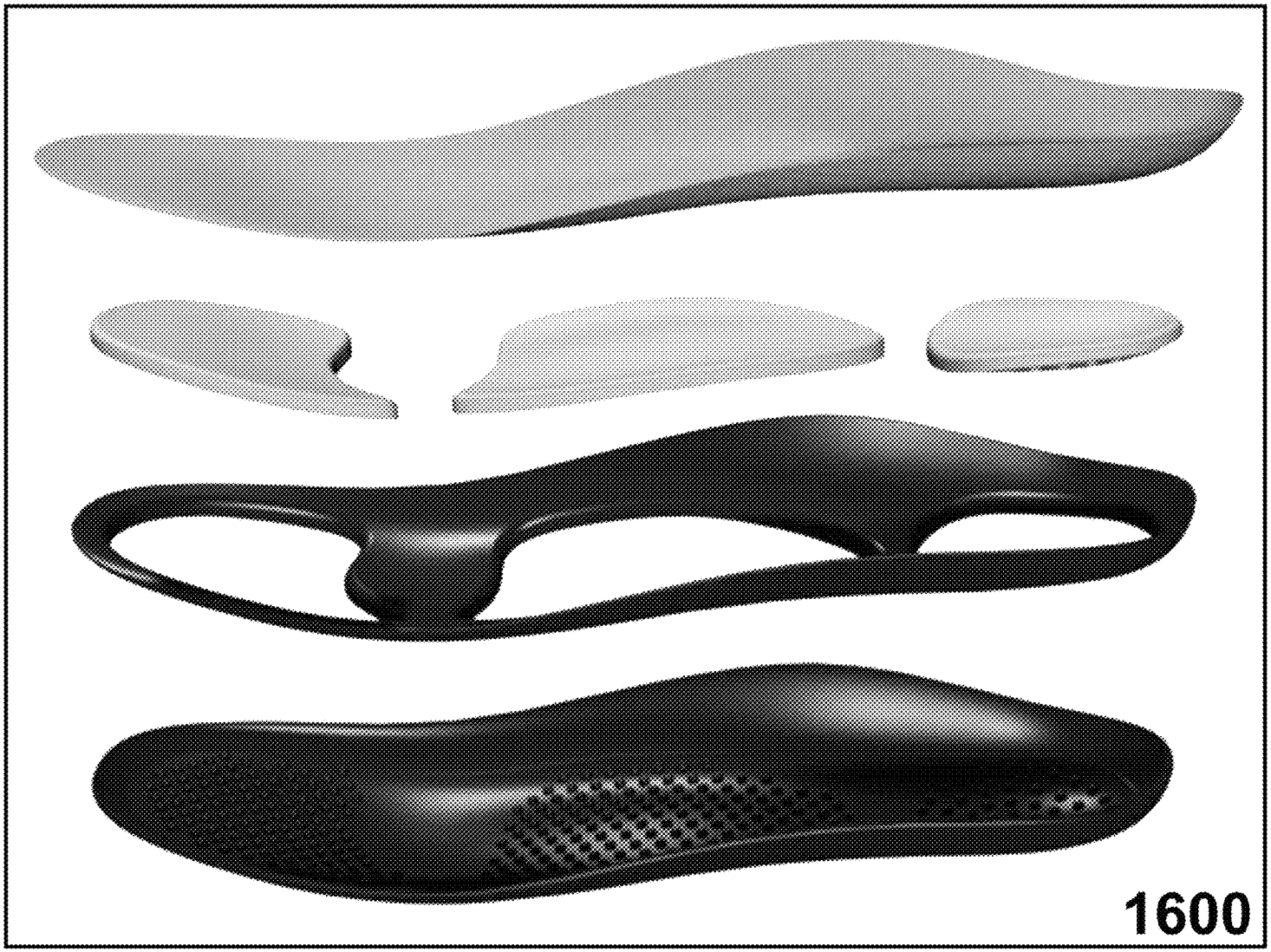
FIGS. 16A and 16B are schematic illustrations of a set of components that together form (or can be assembled to form) an insole or a sole of a shoe or a footwear, in accordance with some demonstrative embodiments.
Figure 16B:
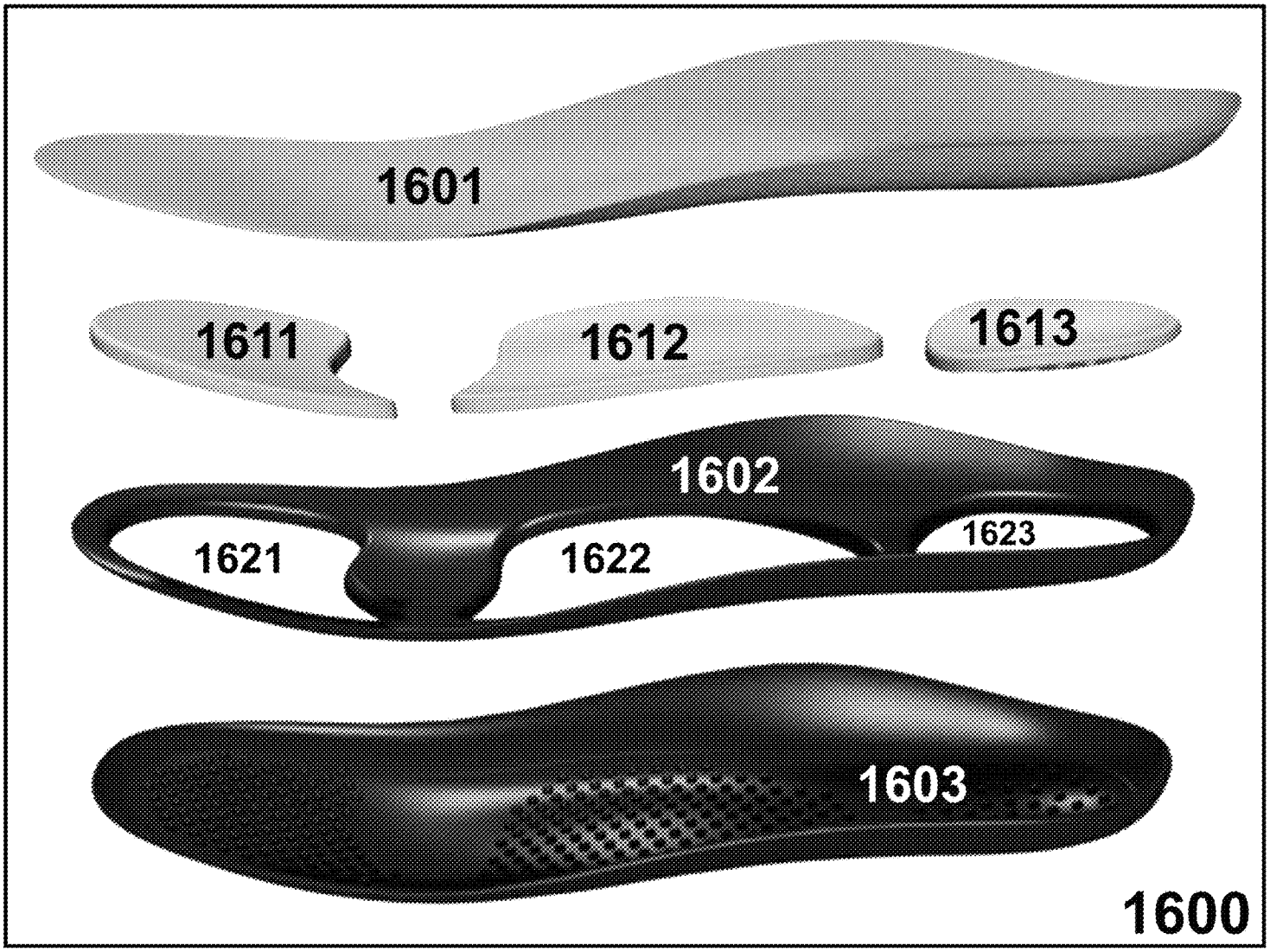

Reference is made to FIGS. 16A and 16B, which are schematic illustrations of a set 1600 of components that together form an insole in accordance with some embodiments. A top layer 1601 and a bottom layer 1603 are provided, and they sandwich or trap between them a central 1602 (or a middle layer) which has three cavities or apertures 1621, 1622 and 1623. Each aperture accommodates and holds therein a pocket or chamber that is filled with one or more materials or a particular mixture or blend of materials; for example, pocket 1611 fits into aperture 1621; pocket 1612 fits into aperture 1622; pocket 1613 fits into aperture 1623.

In some embodiments, the bottom layer 1603 is formed of a material selected from the group consisting of: Ethylene-Vinyl Acetate (EVA) polymer, sponge, foamed polyurethane.

In some embodiments, the middle layer 1603 is formed of a material selected from the group consisting of Ethylene-Vinyl Acetate (EVA) polymer, sponge, foamed polyurethane.

In some embodiments, the top layer 1601 is formed of a co-polymer.

In accordance with some embodiments, the apertures 1621 to 1623 in the middle layer 1602, with corresponding portions of the top layer 1601 that are above said apertures, and with corresponding portions of the bottom layer 1603 that are beneath said apertures, define two or more internal discrete storage chambers within the insole. For demonstrative purposes, three such apertures are shown, creating or defining three such internal and discrete storage chambers within the insole; however, some embodiments may have exactly two such apertures/pockets/chambers (and not three), or may have four (or more) such apertures/pockets/chambers in the insole.

In accordance with some embodiments, each of such internal discrete storage chambers stores therein a mixture of two or more particulate materials, which comprise at least: (I) one or more materials selected from Group A, wherein Group A consists of: natural sand, synthetic sand, artificial sand, silica, quartz; and also, (II) one or more materials selected from Group B, wherein Group B consists of: powdered aluminum, powdered titanium, powdered zinc, powdered magnesia, powdered silver, powdered anti-bacterial agent, powdered metal, powdered talcum, silicone oil.

Some embodiments provide an innovative shoe or other footwear, which includes advanced functionalities that can achieve medical and/or therapeutic goals, and/or that can assist in obtaining comprehensive foot health management. Some embodiments may enable early and/or efficient detection or estimation of foot health problems, and/or for analysis of biomechanics of foot movement, and/or for detection/diagnosis/estimation/evaluation/prevention/mitigation/alleviation of muscular or bone-related or neurological or neuro-muscular problems or symptoms or conditions or abnormalities, and/or comprehensive management or treatment or alleviation or mitigation or prevention foot health problems, which are often precursors to other medical problems and/or more serious medical conditions. Some embodiments innovatively transform the management of foot health by providing a solution that extends beyond just symptom relief.

In accordance with some embodiments, the insole or sole or shoe or footwear includes one or more electromyogram (EMG) sensors or EMG units or EMG pads or EMG patches, that are configured to detect or sense or measure electrical activity from a muscle; such as, using conductive pads or conductive patches or conductive elements that are placed in proximity to the skin or the foot. The EMG sensors measure or sense or estimate the functionality of the muscles and nerves through electromyographic activity, particular during movement of the foot (e.g., walking, running). In some embodiments, the accuracy or efficiency of the EMG sensors is improved or increased, due to (I) the stimulation that the sand or other materials provide to the foot from the storage chambers or pockets within the insole, and/or (II) one or more Transcutaneous Electrical Nerve Stimulation (TENS) units or electrodes that are similarly integrated in or on the shoe/sole/insole/footwear and provide a low-voltage electrical current stimulation to the muscles and/or nerves of the human wearer.

In some embodiments, the insole or sole or shoe or footwear includes: (A) integrated EMG sensors are configured to sense and monitor muscle activity; and/or (B) integrated pressure sensors, that are configured to sense/measure/monitor pressure and thus to enable gait analysis, such as air pressure sensor, piezoelectric sensors, capacitive pressure sensors and/or resistance sensors, that can map the distribution of foot pressure by converting mechanical power into electrical signals; and/or (C) temperature sensors or miniature thermometers, or one or more thermistor units (e.g., thermal resistor that changes its resistance based on temperature) and/or infrared (IR) sensors and/or semiconductor sensors that can measure accurate foot temperature, which in turn can indicate normal/abnormal blood flow and/or risk of inflammation, and/or that are configured to sense and monitor temperature of the nearby foot and to thus enable analysis and assessment of blood flow; and/or (D) humidity sensors or miniature hygrometers or Relative Humidity (RH) sensors able to sense humidity or Relative Humidity (RH) at or near the foot, thus enabling estimation of human sweat level and/or other parameters; and/or (E) tri-axial accelerometers, configured to measure acceleration/deceleration and to thus enable identification of gait characteristics and potential biomechanical irregularities or injury risks; and/or (F) Electrodermal Activity (EDA) sensors and/or Galvanic Skin Response (GSR) sensors, configured to measure the electrical conductance of the skin and/or for measuring electro-cutaneous activity or galvanic skin response, translating skin conductance or electrical conductivity changes into electrical signals for further analysis; and/or (G) sweat sensors, configured to detect or to assess moisture, glucose levels, skin health, and/or infection risks, or configured to sense data that can then be processed to determine such skin problems or health problems.

The readings or measurements from such sensors, which are integrated within or on or at or beneath the sole or insole or shoe or footwear, can be processed locally by a processor and memory unit within the shoe. Additionally or alternatively, such readings or measurements from the sensors (and/or any in-shoe processed data or processing results) may be wirelessly transmitted from the shoe over a short-distance communication link (e.g., Bluetooth, Bluetooth Low Energy (BLE), Zigbee, Wi-Fi) to a nearby electronic device (e.g., smartphone, tablet, smart-watch, fitness watch, desktop computer, laptop computer) that receives the data from the shoe and processes it, and/or that further relays the data to a remote server or a cloud-computing server (e.g., over an Internet connection, over Wi-Fi, over a cellular communication link, over HTTP, over HTTPS, over TLS/SSL, or the like) that receives the sensed data and/or the fully-processed data and/or the partially-processed data and further stores and analyzes the data and generates insights and notifications that are then conveyed to the user (e.g., the wearer of the shoe; a physician, a nurse, a medical professional; a healthcare provider; a sports trainer; a physical therapy professional; an occupational therapy professional; a rehabilitation service provider).

In some embodiments, the analysis of the sensed data may be performed based on a pre-defined set of rules of conditions, and/or based on comparison to pre-defined threshold values and/or maximum values and/or minimum values and/or acceptable (or non-abnormal) ranges-of-values. For example, the processing unit may apply Rule 1 which may define that: if the sensed temperature is above threshold value T1, and the sensed Relative Humidity (RH) is above threshold value R1, and the sensed EMG reading is above threshold level E1, and the sensed pressure value is above threshold value E1, then the processing unit determines or estimates that Medical Condition M1 exists for this wearer. Similarly, the processing unit may apply Rule 1 which may define that: if the sensed temperature is below threshold value T2, and the sensed Relative Humidity (RH) is between threshold values R2 and R3, and the sensed EMG reading is below threshold level E2, and the sensed pressure value is between threshold values E2 and E3, then the processing unit determines or estimates that Medical Condition M2 exists, or that Medical Condition M3 is estimated to be negated or is estimated to not exist for this wearer. Similarly, rules or conditions or threshold values or threshold ranges-of-values may be defined and used for other sensed data, as sensed or measured or estimated by one or more of the sensor units mentioned above.

In some embodiments, the analysis of the sensed data may be performed based on a processing unit that utilizes Artificial Intelligence (AI) and/or Machine Learning (ML) and/or Deep Learning (ML) and/or Neural Network (NN), which generates insights or detection results or estimation results or predictions. For example, an AI/ML/DL/NN model or unit or engine may be trained on a large dataset that includes sensed or measured data (e.g., temperature, pressure, EMG data, pressure data) as well as corresponding diagnosis results/labeled conditions (e.g., a particular medical condition or disease; a particular type of gait abnormality).

The training of the AI/ML/DL/NN model or unit or engine may be performed by using a pre-provided dataset that can be obtained from a hospital or a health center, and which can be generally anonymized in advance to remove Personally Identifiable Information (PII), and which may optionally retain class information such as gender and age or age-range. The trained AI/ML/DL/NN model or unit or engine can then predict or classify or estimate the existence, or the lacking of, or the severity or intensity of, a particular medical condition or physiological condition or muscular condition or neuro-muscular condition or neurological condition, based on an actual set of sensed data from a particular shoe of a particular human wearer. Some embodiments may thus utilize AI/ML/DL/NN models analyze sensor data, identify patterns in neural functions, and aid in diagnostic accuracy and in generation of insights from the sensed data.

In some embodiments, such AI/ML/DL/NN model or unit or engine may periodically be fine-tuned or re-configured or re-trained, based on a feedback loop that provides subsequent feedback from the wearer himself and/or from medical professionals, that confirm or deny previous estimations made by the AI/ML/DL/NN model or unit or engine; such that the AI/ML/DL/NN model or unit or engine gradually learns from its own mistakes to reach more accurate classification results and insights. Some embodiments may thus utilize AI-driven data analysis in order to prevent, detect, mitigate and/or treat muscle disorders and/or and nerve disorders, as they occur and even at an early stage and before they are apparent to the wearer himself and/or to medical professionals. This proactive approach may improve the quality of life of those at risk for foot-related problems.

Optionally, the sole or insole or shoe or footwear of some embodiments may further include one or more Transcutaneous Electrical Nerve Stimulation (TENS) Units or electrodes, configured to provide electric current and/or low-voltage electric stimulation, in order to stimulate particular regions or areas or muscles or nerves, and/or in order to treat or relieve or mitigate pain. In some embodiments, the TENS unit(s) that are integrated in or on the sole or insole or shoe or footwear of may further cause a stimulation that enables better or improved or effective or more efficient sensing of the electromyographic activity during movement. Additionally or alternatively, the sand and/or sand mixture and/or other particulate materials and/or other granular materials that are stored within the two or three or more storage chambers or pockets within the sole or the insole, further provide stimulation to muscles and/or nerves, and may further enable better or improved or effective or more efficient sensing of the electromyographic activity during movement. In some embodiments, optionally, at least one of the TENS units is located within a storage pocket, in proximity to or mixed within the sand mixture and/or other granular materials and/or other particulate materials. In other embodiments, optionally, at least one of the TENS units is located in the sole or insole or shoe or footwear, but externally to the storage pocket(s) that store therein sand and/or sand mixture and/or other granular materials and/or other particulate materials. In some embodiments, optionally, at least one of the TENS unit is located at, or on, an external side of a storage pocket that stores therein sand and/or sand mixture and/or other granular materials and/or other particulate materials. In some embodiments, a plurality of discrete and separate TENS units may be placed at a combination of two or more of the above-mentioned locations, to further increase their operational benefits and/or effectiveness.

Some embodiments may thus utilize biometric analysis with energy efficient microcontrollers or processors, for local (in shoe) processing or partial processing of sensor data, including signal filtering, data aggregation, and at least preliminary or partial analysis; optionally assisted or augmented by further processing at a nearby electronic device and/or a remote server or a cloud-computing server or platform that facilitates data synchronization, extensive storage, and advanced AI-driven analytics accessible to the user and/or to third parties (e.g., medical professionals) from any Internet-connected device.

Some embodiments may provide therapeutic properties, and user-tailored and targeted electrical stimulation; for example, using precision electrodes or TENS units that deliver adjustable or pre-programmed electrical pulses or electric stimulation based on therapeutic needs and by taking into account sensor feedback in real time or in near real time. Optionally, user-specific or custom settings may be configured or modified via an application or "app", which communicates back with the shoe/sole/insole/footwear to adjust the settings of the electrical stimulation (e.g., intensity; frequency; time-length; locations; pattern; time-gaps; or the like).

The system is configured to ensure secure data storage and management, compliant with privacy regulations, ensuring security and control of user data. The shoe or footwear integrated the various sensors with a microcontroller or processor for data acquisition and optionally at least partial in-shoe processing of sensed/raw data. A battery or a replaceable battery or a rechargeable battery or power cell may further be integrated within the shoe/sole/insole/footwear, and can provide electric power to the various sensors, stimulation units, processor, memory unit, and wireless transceiver(s). In some embodiments, such in-shoe battery or power cell is rechargeable via a wired connection or port or socket (e.g., USB or Micro-USB or Mini-USB port); additionally or alternatively, such in-shoe battery or power cell is rechargeable via a wireless charging mechanism.

In some embodiments, the functionality of the above-mentioned components, as well as the insights generated by the processing unit(s), can be accessed by the user via an application or "app", which enables user-tailored customization as well as efficient visualization of health metrics or health concerns or insights. For example, detection of excessive sweating can be accompanied by a textual alert message or a red color alert message, and/or via an audible alert or warning, or an animated message that the user can see or hear or consume via a smartphone or other electronic device.

Some embodiments may be particularly useful for treating or assisting particular groups or subsets of the population; and optionally, the AI/ML/DL/NN model or unit or engine may be particular trained or re-trained or fine-tuned based on dataset(s) that correspond to such particular group(s) of population; for example: (A) For the treatment of diabetic foot, and/or for managing complications such as diabetic neuropathy and peripheral artery disease; (B) For aging population, improving proprioception and balance, reducing the risk of falling, and managing age-related pain; (C) For chemotherapy patients or cancer patients, providing relief of neuropathic symptoms using controlled and targeted electrical stimulation; (D) For diagnosis by healthcare providers, offering a diagnostic tool that is non-invasive, with immediate or real time assessment during routine examinations and/or even while the patient (the wearer) is away from the healthcare provider; (E) For remote patient monitoring, enabling real-time data sharing with healthcare professionals for personalized treatment plans and for real-time alerts about abnormal conditions; (F) For treatment of chronic pain, particularly using TENS units as an alternative or addition to medicines; (G) For detection, prevention and/or mitigation of Deep Vein Thrombosis (DVT), and/or for improving blood flow in the lower extremities for those at risk of DVT or similar conditions; (H) For post-surgery patients or for patients recovering from surgery or injury, ensuring correct or desired weight distribution, and/or otherwise assisting in rehabilitation through biofeedback.

Figure 16C:
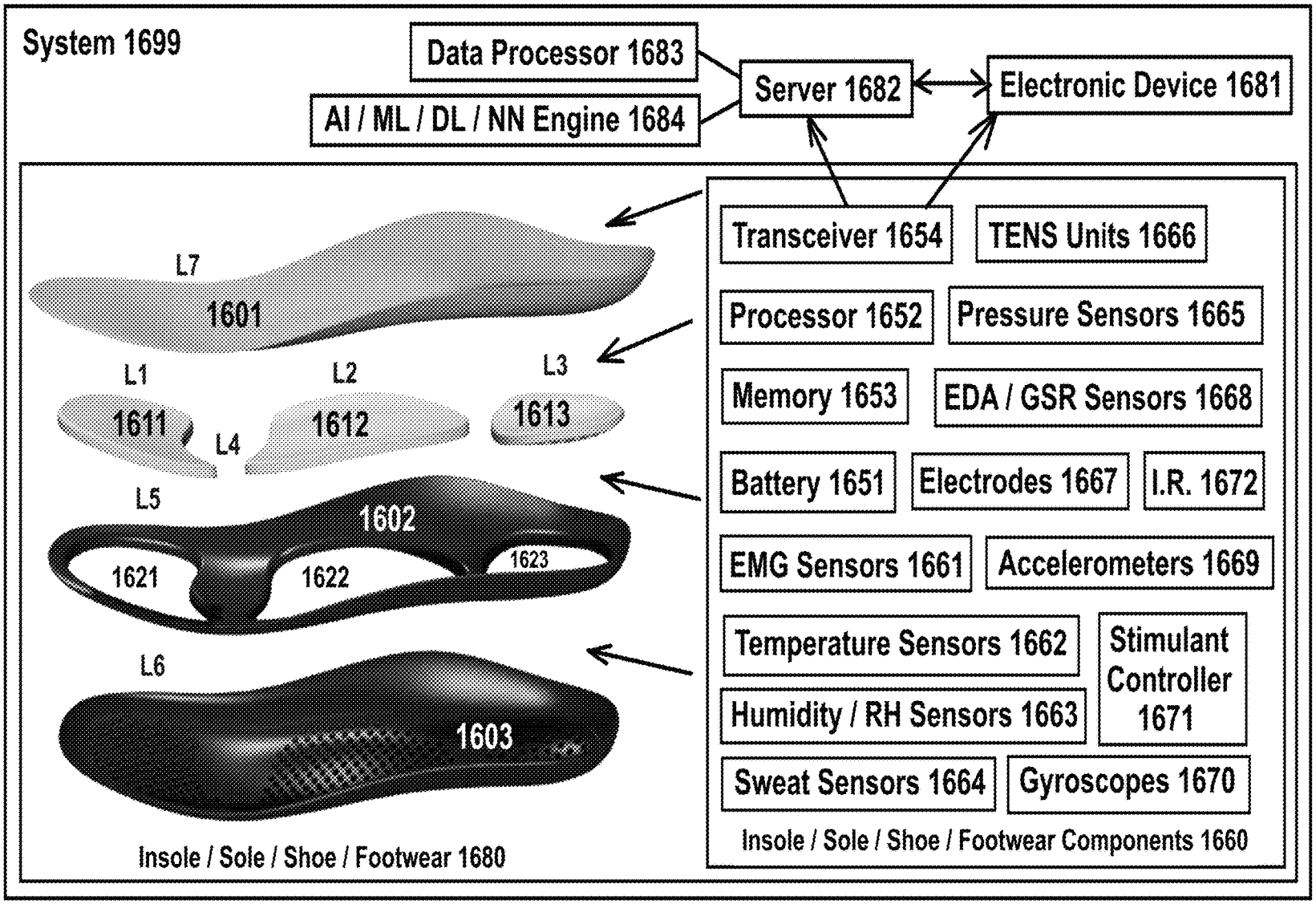
FIG. 16C is a schematic illustration of a system, in accordance with some demonstrative embodiments.

Reference is made to FIG. 16C, which is a schematic illustration of a system 1699 in accordance with some embodiments. System 1699 includes an article 1680, which can a stand-alone or removable or replaceable or insertable or detachable insole, or can be a non-removable/non-replaceable insole, or can be an insole integrated in a shoe or other footwear, or can be a sole of a shoe or other footwear, or article 1680 can be a shoe or other footwear; article 1680 may thus be referred to herein as "Insole/Sole/Shoe/Footwear 1680".

In accordance with some embodiments, Insole/Sole/Shoe/Footwear 1680 includes: the three layers mentioned above (top layer 1601, bottom layer 1603, middle layer 1602 having at least two discrete and separate apertures or cavities and holding at least two discrete and separates pockets storing particulate or granular materials as discussed above. Insole/Sole/Shoe/Footwear 1660 includes one, or some, or most, or all of the components that are shown as "Insole/Sole/Shoe/Footwear Components 1660".

In accordance with some embodiments, the Insole/Sole/Shoe/Footwear Components 1660 may include: a Battery 1651 and optionally an associated charging unit or charging mechanism that can charge or re-charge the battery with electricity that is provided via a wire or cable and/or via a port or socket and/or via a wireless charging mechanism. Battery 1651 provides electric power/current/voltage to one or more of the Insole/Sole/Shoe/Footwear Components 1660.

In accordance with some embodiments, the Insole/Sole/Shoe/Footwear Components 1660 may include: a Processor 1652, such as a hardware processor, processing core(s), micro-processor, micro-controllers, Central Processing Unit (CPU), Graphics Processing Unit (GPU), Digital Signal Processor (DSP), controller(s), micro-controllers, Integrated Circuit (IC), Application-Specific Integrated Circuit (ASIC), logic gate(s), and/or other components configured to execute code or machine-readable instruction. Processor 1652 may control the operation of one or more, or most, or all the other components of the Insole/Sole/Shoe/Footwear Components 1660; and/or may modify or adjust or change or increase or decrease or set or reset one or more of the operational properties or the operational characteristics of the Insole/Sole/Shoe/Footwear Components 1660 (e.g., via a command to increase/decrease the electric current that is provided to a particular component; or by providing an input signal to a particular component), and/or may read or collect data or output signals that is sensed and/or generated by one or more of the Insole/Sole/Shoe/Footwear Components 1660, and/or may perform partial or complete in-shoe/in-footwear/in-insole/in-sole local processing of sensed data, and/or may control the wireless transmission of raw data and/or sensed data and/or processed data to an external device; and/or may perform or command to perform other operations, based on a pre-programmed code or software or firmware and/or based on upgradeable or modifiable code or program.

In accordance with some embodiments, the Insole/Sole/Shoe/Footwear Components 1660 may include: a Memory Unit 1653 configured to store, for short term or for long term, data and/or sensed data and/or measured data and/or raw data and/or processed data and/or incoming commands and/or incoming messages (e.g., received wirelessly) and/or program code and/or instructions that the processor can execute. Memory Unit 1653 may include, for example, Random Access Memory (RAM), Read-Only Memory (ROM), Flash memory, non-volatile memory, Secure Digital (SD) card or Micro-SD card or SDHC or SDXC or SDUC card.

In accordance with some embodiments, the Insole/Sole/Shoe/Footwear Components 1660 may include: a Wireless Transceiver 1654 or a wireless transmitter or receiver or transmitter-receiver, configured to wireless transmit data or signals and/or to wireless receive data or signals; for example, a Wi-Fi transceiver, a Bluetooth transceiver, a BLE transceiver, a Zigbee transceiver, a cellular transceiver (e.g., associated with a co-located Subscriber Identity Module (SIM) card), or the like.

In accordance with some embodiments, the Insole/Sole/Shoe/Footwear Components 1660 may include: one or more EMG Sensors 1661. In a demonstrative embodiment, the Insole/Sole/Shoe/Footwear has N discrete pockets (or chambers) that contain sand and/or other granular or particulate materials; and there are N (or, there are at least N) corresponding EMG sensors, such that each EMG sensor is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding EMG sensors, wherein M is a positive integer, such that each group of M units of EMG sensors is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding EMG sensors, such that each EMG sensor is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding EMG sensors, such that each EMG sensor is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding EMG sensors, such that each EMG sensor is located above or within or beneath or under a corresponding pocket (or chamber). Other number of EMG sensors may be used.

In accordance with some embodiments, the Insole/Sole/Shoe/Footwear Components 1660 may include: one or more Temperature Sensors 1662 or miniature thermometers or thermistor units or thermal resistor units, configured to sense temperature.

In accordance with some embodiments, the Insole/Sole/Shoe/Footwear Components 1660 may include: one or more Humidity or Relative Humidity (RH) Sensors 1663 or miniature hygrometer units, configured to sense humidity or relative humidity. Additionally or alternatively, one or more Sweat Controllers or Sweat Sensors 1664 may be included, configured to sense or measure or detect human sweat or bodily liquids or bodily fluids, and/or configured to perform chemical analysis of such human sweat and/or liquids and/or fluids.

In accordance with some embodiments, the Insole/Sole/Shoe/Footwear Components 1660 may include: one or more Pressure Sensors 1665, configured to measure or sense or monitor pressure applied on them. In a demonstrative embodiment, the Insole/Sole/Shoe/Footwear has N discrete pockets (or chambers) that contain sand and/or other granular or particulate materials; and there are N (or, there are at least N) corresponding Pressure Sensors, such that each Pressure Sensor is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding Pressure Sensors, wherein M is a positive integer, such that each group of M units of Pressure Sensors is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding Pressure Sensors, such that each Pressure Sensor is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding Pressure Sensors, such that each Pressure Sensor is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding Pressure Sensors, such that each Pressure Sensor is located above or within or beneath or under a corresponding pocket (or chamber). Other number of Pressure Sensors may be used.

In accordance with some embodiments, the Insole/Sole/Shoe/Footwear Components 1660 may include: one or more EDA/GSR Sensors 1668. In a demonstrative embodiment, the Insole/Sole/Shoe/Footwear has N discrete pockets (or chambers) that contain sand and/or other granular or particulate materials; and there are N (or, there are at least N) corresponding EDA/GSR Sensors, such that each EDA/GSR Sensor is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding EDA/GSR Sensors, wherein M is a positive integer, such that each group of M units of EDA/GSR Sensors is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding EDA/GSR Sensors, such that each EDA/GSR Sensor is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding EDA/GSR Sensors, such that each EDA/GSR Sensor is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding EDA/GSR Sensors, such that each EDA/GSR Sensor is located above or within or beneath or under a corresponding pocket (or chamber). Other number of EDA/GSR Sensors may be used.

In accordance with some embodiments, the Insole/Sole/Shoe/Footwear Components 1660 may include: one or more TENS Units 1666. In a demonstrative embodiment, the Insole/Sole/Shoe/Footwear has N discrete pockets (or chambers) that contain sand and/or other granular or particulate materials; and there are N (or, there are at least N) corresponding TENS Units, such that each TENS Unit is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding TENS Units, wherein M is a positive integer, such that each group of M units of TENS Units is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding TENS Units, such that each TENS Unit is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding TENS Units, such that each TENS Unit is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding TENS Units, such that each TENS Unit is located above or within or beneath or under a corresponding pocket (or chamber). Other number of TENS Unit may be used.

In accordance with some embodiments, the Insole/Sole/Shoe/Footwear Components 1660 may include: one or more Stimulating Electrodes 1667. In a demonstrative embodiment, the Insole/Sole/Shoe/Footwear has N discrete pockets (or chambers) that contain sand and/or other granular or particulate materials; and there are N (or, there are at least N) corresponding Stimulating Electrodes, such that each Stimulating Electrode is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding Stimulating Electrodes, wherein M is a positive integer, such that each group of M units of Stimulating Electrodes is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding Stimulating Electrodes, such that each Stimulating Electrode is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding Stimulating Electrodes, such that each Stimulating Electrode is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding Stimulating Electrodes, such that each Stimulating Electrode is located above or within or beneath or under a corresponding pocket (or chamber). Other number of Stimulating Electrodes may be used.

In accordance with some embodiments, the Insole/Sole/Shoe/Footwear Components 1660 may include: one or more Infrared (IR) Radiation Units 1672, configured to selectively and/or discretely and/or separately and/or concurrently and/or in concert and/or sequentially generate IR radiation at pre-defined intensity/amplitude/frequency/radiation characteristics, particularly for therapeutic goals and/or as a stimulant for diagnostic goals. In a demonstrative embodiment, the Insole/Sole/Shoe/Footwear has N discrete pockets (or chambers) that contain sand and/or other granular or particulate materials; and there are N (or, there are at least N) corresponding Infrared Radiation Units, such that each Infrared Radiation Unit is located above or within or beneath or under a corresponding pocket (or chamber). In another demonstrative embodiment, the Insole/Sole/Shoe/Footwear has N discrete pockets (or chambers) that contain sand and/or other granular or particulate materials; and there are N times M (or, there are at least N times M) corresponding Infrared Radiation Units, wherein M is a positive integer, such that each group of M units of Infrared Radiation Units is located above or within or beneath or under a corresponding pocket (or chamber). In another demonstrative embodiment, the Insole/Sole/Shoe/Footwear has 2 discrete pockets (or chambers) that contain sand and/or other granular or particulate materials; and there are 2 (or, at least 2) corresponding Infrared Radiation Units, such that each Infrared Radiation Unit is located above or within or beneath or under a corresponding pocket (or chamber). In another demonstrative embodiment, the Insole/Sole/Shoe/Footwear has 3 discrete pockets (or chambers) that contain sand and/or other granular or particulate materials; and there are 3 (or, at least 3) corresponding Infrared Radiation Units, such that each Infrared Radiation Unit is located above or within or beneath or under a corresponding pocket (or chamber). In another demonstrative embodiment, the Insole/Sole/Shoe/Footwear has 4 discrete pockets (or chambers) that contain sand and/or other granular or particulate materials; and there are 4 (or, at least 4) corresponding Infrared Radiation Units, such that each Infrared Radiation Unit is located above or within or beneath or under a corresponding pocket (or chamber). Other number of Infrared Radiation Unit may be used.

In accordance with some embodiments, the Insole/Sole/Shoe/Footwear Components 1660 may include: a Stimulant Controller 1671, configured or programmed to selectively control and/or modify and/or activate and/or deactivate one or more of the various stimulant units of the Insole/Sole/Shoe/Footwear, such as the TENS units 1666, the Electrodes 1667, the Infrared Radiation Units 1672, and/or other stimulation-generating components. The Stimulant Controller 1671 may control the time-length of operation of each such stimulant component; the time-gaps or time intervals between operations; a pattern or order of stimulation(s); frequency of stimulation(s); intensity of stimulation(s), such as by modifying the electric current/voltage/power provided to a particular stimulation component; and/or other operational characteristics. In some embodiments, the Stimulant Controller 1671 may be re-programmed or re-configured to tailor the particular needs or preferences of a particular user; for example, via firmware or via parameters that are stored in the non-volatile Memory Unit 1653, and such modification may be performed by the Processor 1652 based on locally-sensed data and/or based on locally-processed data and/or based on modification commands that are wirelessly received from an external device over wireless communication via the Wireless Transceiver 1654.

In accordance with some embodiments, the Insole/Sole/Shoe/Footwear Components 1660 may include: one or more Accelerometers 1669, or one accelerometer, or two accelerometers, or three accelerometers, or a tri-axial or tri-axis accelerometer or a set of three accelerometers that are configured to sense acceleration and deceleration along an X axis and a Y axis and a Z axis that are perpendicular to each other. Optionally, one or more Gyroscope Units 1670 may further be included, or three such Gyroscope Units may be included, to sense and provide spatial orientation data; for example, enabling the system to detect that the foot is generally horizontal (e.g., the wearer is standing), or that the foot is generally vertical (e.g., the wearer is lying in bed), or that the foot is generally diagonal or slanted (e.g., the wearer is walking or running or exercising), or the like.

Data that is sensed and/or measured and/or collected and/or processed (partially and/or completely) by one or more of the Insole/Sole/Shoe/Footwear Components 1660, may be wirelessly transmitted via the Wireless Receiver 1654; to a nearby or a remote Electronic Device 1681 (e.g., smartphone, tablet, smart-watch, fitness watch, desktop computer, laptop computer), and/or to a Server Computer 1682 (e.g., a nearby server; a remote server; a cloud-computing server) either directly or via such intermediate Electronic Device 1681 that may relay and/or re-package and/or re-transmit the data to such Server Computer 1682.

Server Computer 1682 and/or Electronic Device 1681 may include, or may be operably associated with: a Data Processor Device 1683 that may process the data based on a pre-defined set of rules and/or conditions and/or programmed code; and/or an AI/ML/DL/NN Engine 1684 that may generate AI/ML/DL/NN driven or AI/ML/DL/NN based insights or predictions or classifications or estimations or determination based on inputs that include such sensed/measured/collected data. Optionally, Server Computer 1682 and/or Electronic Device 1681 may generate commands or operational commands or operation modification commands, that can be wirelessly transmitted back to the Insole/Sole/Shoe/Footwear, such as, a command to increase or decrease the electric power/voltage/current that is provider to a particular Stimulant Electrode or TENS unit or Infrared Radiation Unit, or a command to activate or deactivate a particular component of the Insole/Sole/Shoe/Footwear Components 1660, or a command to modify an operational characteristic of a particular component of the Insole/Sole/Shoe/Footwear Components 1660, or the like. Optionally, Server Computer 1682 and/or Electronic Device 1681 may generate alerts, messages and/or notifications to the user or to a remote user or to a remote recipient, indicating a detected/estimated/predicted/determined/suspected abnormality or anomaly or disease or medical condition or physiological condition or neurological condition or muscular condition, or conversely indicating a detected/estimated/predicted/determined improvement in such condition or a mitigation or alleviation of such condition.

In accordance with some embodiments, one, or some, or most, or all of the Insole/Sole/Shoe/Footwear Components 1660, may be located at one or more suitable places or locations of the Insole/Sole/Shoe/Footwear Components 1660; for example, at Location L7 (e.g., above or over the upper layer 1601), and/or within the upper layer 1601, and/or at Location L1 (e.g., above a front-side pocket or chamber), or within a front-side pocket or chamber, and/or at Location L2 (e.g., above a central pocket or chamber), or within a central pocket or chamber, and/or at Location L3 (e.g., above a rear-side pocket or chamber), or within a rear-side pocket or chamber, and/or at Location L4 (e.g., between or among or near or next to or neighboring to or bordering with one or more of the pockets or chambers), and/or at Location L5 (e.g., above or over or near or bordering or neighboring the middle layer 1602), and/or at Location L6 (e.g., above or over or near or bordering or neighboring the bottom layer 1603); and/or at other suitable places.

In some embodiments, one, or some, or most, or all of the Insole/Sole/Shoe/Footwear Components 1660, may optionally be implemented as miniature components that are not damaged and/or are not adversely affected when they are stepped upon, and/or may be implemented as surrounded by or encapsulated by a flexible or elastic or shock-absorbing or forces-absorbing or force-dissipating or shock-dissipating layer(s) or coating(s) that may reduce or prevent operational damage or mechanical damage to such components even when placed in a shoe or footwear that is stepped on by a human. It is noted that shoes that include flashing lights are known in the art, hence it is possible to produce and to use shoes or other footwear that safely and securely contain and operational battery that can provide power to electrical components, which in turn do not break or are not damaged when stepped upon.

In some embodiments, one or more of the storage pockets/chambers may store only granular material(s) or only particulate material(s) or only powdered material(s), or only a mixture of such granular/particular/powdered material. In other embodiments, instead of or in addition to such materials, one or more of the storage pockets/chambers may store a paste or other material(s) which may not necessarily be in the form of powder/granules/particles; for example, a paste that includes a mixture of dry particles in a liquid, a glue paste, an adhesive paste, an epoxy paste, a resin paste, an epoxy resin, or the like. In some embodiments, one or more storage pockets/chambers may store granular/particular/powdered material(s), whereas one or more other, nearby or co-located, storage pockets/chamber may store a paste or may store non-granular/non-particulate/non-powdered material(s). Such combinations may be utilized innovatively in order to provide a differential level or type of stimulation to different parts of the human foot; for example, by placing granular or particulate materials in a storage pocket located beneath the rear of the foot (e.g., for increased stimulation to that foot-region), while placing paste material(s) in a storage pocket located beneath the front of the foot (e.g., for reduced stimulation or for a different type of stimulation to that foot-region). Other suitable configurations may be used.

In some embodiments, the footwear may be worn by a human wearer without socks and/or without a foot-covering garment; to enable direct touch of the skin/muscles of the foot with the insole or the footwear and its sensor units and/or stimulant units; and/or to enable better or more accurate or more efficient stimulation by the stimulant unit(s); and/or to enable better or more accurate or more efficient data collection or sensing by the sensing components of the insole or footwear.

In some embodiments, one, or some, or most, or all of the Insole/Sole/Shoe/Footwear Components 1660, may be placed or added or positioned in non-sole and/or non-insole region(s) of the shoe or footwear; for example, in or at or within or near side-panels or side-walls or side-fabrics of the shoe or footwear, or upper-side fabric/region/panel/flap of the shoe or footwear; to optionally enable sensing and data collection and data measurements in those areas as well, and/or to optionally enabling electric stimulation/TENS stimulation/IR stimulation in those areas as well. Data collected from those areas may similarly be stored in Memory Unit 1653, and/or may similarly be used or processed by Processor 1652, and/or may similarly be transmitted wirelessly by Wireless Transceiver 1654 to external device(s). The operational characteristics of such sensors or stimulation units, that may be optionally located in those non-insole/non-sole regions of the shoe or foot, may similarly be controlled or adjusted or modified by the Processor 1652 and/or by the Stimulant Controller 1671.

Some embodiments provide a wearable article comprising a footwear having an integral and non-removable insole (or sole). The insole (or the sole) comprises at least: a bottom layer formed of Ethylene-Vinyl Acetate (EVA) polymer; a middle layer formed of Ethylene-Vinyl Acetate (EVA) polymer; and a top layer formed of one or more materials selected from the group consisting of: a co-polymer, a fabric, a textile, a polyether-polyurea copolymer, an elastic plastic layer, an elastomer, a stretchable plastic layer, an elastic rubber layer, a stretchable nylon layer, silicon, silicone, silicon glue, silicone glue. In some embodiments, the top layer may be or may include a thin cover or a thin stretchable/elastic material, or a thin layer of silicon or silicone or silicone glue or silicon glue or other lamination layer or lamination material or encapsulation material. In some embodiments, the bottom layer may be or may include a thin cover or a thin stretchable/elastic material, or a thin layer of silicon or silicone or silicone glue or silicon glue or other lamination layer or lamination material or encapsulation material.

In some embodiments, the middle layer comprises apertures therein. The apertures in the middle layer, with corresponding portions of the top layer that are above said apertures, and with corresponding portions of the bottom layer that are beneath said apertures, define two or more internal discrete storage chambers (or storage pockets) within said insole.

In some embodiments, each of said internal discrete storage chambers stores therein a mixture of two or more particulate materials which comprise at least: (i) one or more materials selected from Group A, wherein Group A consists of: natural sand, synthetic sand, artificial sand, kinetic sand, silica, quartz; and also (ii) one or more materials selected from Group B, wherein Group B consists of: powdered aluminum, powdered titanium, powdered zinc, powdered magnesia, powdered silver, powdered anti-bacterial agent, powdered metal, powdered talcum, grained cork, grained coal, grained wood, carbon nanotubes, carbon nanofibers, ground carbon, carbon powder, black carbon particles, charcoal particles, graphite, ground graphite, stainless steel powder, stainless steel particles, silicone glue, silicone caulk, Room Temperature Vulcanizing (RTV) silicone.

In some embodiments, said footwear comprises: one or more electromyogram (EMG) sensors, that are integrated in said footwear, and that are configured to sense electrical activity from one or more muscles of a foot of a human wearer of said footwear, in response to stepping on said internal discrete storage chambers that store therein said mixture.

In some embodiments, said footwear further comprises: one or more Transcutaneous Electrical Nerve Stimulation (TENS) units, that are integrated in said footwear, and that are configured to provide electrical current stimulation to the foot of the human wearer; wherein the one or more electromyogram (EMG) sensors, that are integrated in said footwear, are configured to sense electrical activity from one or more muscles of the foot, in response to both (I) stepping on said internal discrete storage chambers that store therein said mixture and (II) provision of electrical current stimulation by said one or more TENS units to said foot.

In some embodiments, said footwear further comprises: one or more Electrodes, that are integrated in said insole, and that are configured to provide electrical current stimulation to the foot of the human wearer; wherein the one or more Electrodes, that are integrated in said footwear, are configured to sense electrical activity from one or more muscles of the foot, in response to both (I) stepping on said internal discrete storage chambers that store therein said mixture and (II) provision of electrical current stimulation by said one or more Electrodes to said foot.

In some embodiments, said footwear further comprises: one or more Infrared Radiation Units, that are integrated in said footwear, and that are configured to provide Infrared Radiation stimulation to the foot of the human wearer; wherein the one or more electromyogram (EMG) sensors, that are integrated in said footwear, are configured to sense electrical activity from one or more muscles of the foot, in response to both (I) stepping on said internal discrete storage chambers that store therein said mixture and (II) provision of electrical current stimulation by said one or more Infrared Radiation Units to said foot.

In some embodiments, said footwear further comprises: a Stimulant Controller, configured to separately and selectively control one or more operational properties of said one or more TENS units and said one or more Electrodes and said one or more Infrared Radiation Units.

In some embodiments, said footwear further comprises: a Wireless Transceiver configured to wireless transmit to an external electronic device, over a wireless communication link, data sensed by said one or more electromyogram (EMG) sensors in response to stepping on said internal discrete storage chambers that store therein said mixture.

In some embodiments, said footwear further comprises: a Wireless Transceiver configured to wireless transmit to an external electronic device, over a wireless communication link, data sensed by said one or more electromyogram (EMG) sensors in response to both (I) stepping on said internal discrete storage chambers that store therein said mixture and (II) provision of electrical current stimulation by an electric stimulation unit of said footwear to said foot.

In some embodiments, said footwear further comprises: one or more Temperature Sensors that are integrated in said footwear, and that are configured to sense temperature at one or more locations that are in proximity to said foot; wherein said footwear is operably associated with a Data Processor, that is configured to process both (I) data sensed by the one or more electromyogram (EMG) sensors that are integrated in said footwear, and (II) data sensed by the one or more Temperature Sensors that are integrated in said footwear; wherein said Data Processor is configured to generate at least one of: (i) a signal indicating an estimated abnormal medical condition of said human wearer, (ii) a signal indicating a command to selectively modify an operational characteristic of at least one component of said footwear.

In some embodiments, said footwear further comprises: one or more Pressure Sensors that are integrated in said footwear, and that are configured to sense pressure at one or more locations that are in proximity to said foot; wherein said footwear is operably associated with a Data Processor, that is configured to process both (I) data sensed by the one or more electromyogram (EMG) sensors that are integrated in said footwear, and (II) data sensed by the one or more Pressure Sensors that are integrated in said footwear; wherein said Data Processor is configured to generate at least one of: (i) a signal indicating an estimated abnormal medical condition of said human wearer, (ii) a signal indicating a command to selectively modify an operational characteristic of at least one component of said footwear.

In some embodiments, said footwear further comprises: one or more Humidity Sensors that are integrated in said footwear, and that are configured to sense humidity at one or more locations that are in proximity to said foot; wherein said footwear is operably associated with a Data Processor, that is configured to process both (I) data sensed by the one or more electromyogram (EMG) sensors that are integrated in said footwear, and (II) data sensed by the one or more Humidity Sensors that are integrated in said footwear; wherein said Data Processor is configured to generate at least one of: (i) a signal indicating an estimated abnormal medical condition of said human wearer, (ii) a signal indicating a command to selectively modify an operational characteristic of at least one component of said footwear.

In some embodiments, said footwear further comprises: one or more Electrodermal Activity (EDA)/Galvanic Skin Response (GSR) Sensors that are integrated in said footwear, and that are configured to sense electric conductivity at one or more regions of said foot; wherein said footwear is operably associated with a Data Processor, that is configured to process both (I) data sensed by the one or more electromyogram (EMG) sensors that are integrated in said footwear, and (II) data sensed by the one or more EDA/GSR Sensors that are integrated in said footwear; wherein said Data Processor is configured to generate at least one of: (i) a signal indicating an estimated abnormal medical condition of said human wearer, (ii) a signal indicating a command to selectively modify an operational characteristic of at least one component of said footwear.

In some embodiments, said footwear is operably associated with a Data Processor, that is configured to process both (I) data sensed by the one or more electromyogram (EMG) sensors in response to stepping on said internal discrete storage chambers that store therein said mixture, and (II) data sensed by one or more other sensors that are integrated in said footwear; wherein said Data Processor is configured to generate at least one of: (i) a signal indicating an estimated abnormal medical condition of said human wearer, (ii) a signal indicating a command to selectively modify an operational characteristic of at least one component of said footwear.

In some embodiments, the Data Processor applies a Machine Learning (ML) algorithm that estimates whether or not said human wearer has a particular medical condition, based on data collected by the one or more electromyogram (EMG) sensors in response to stepping on said internal discrete storage chambers that store therein said mixture.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more other sensors that are integrated in said footwear.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Pressure Sensors that are integrated in said footwear.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Temperature Sensors that are integrated in said footwear.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Humidity Sensors that are integrated in said footwear.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more EDA/GSR Sensors that are integrated in said footwear.

In some embodiments, said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Accelerometers that are integrated in said footwear.

In some embodiments, said footwear further comprises: one or more Sweat Sensors that are integrated in said footwear, and that are configured to sense sweat at one or more locations that are in proximity to said foot; wherein said footwear is operably associated with a Data Processor, that is configured to process both (I) data sensed by the one or more electromyogram (EMG) sensors that are integrated in said footwear, and (II) data sensed by the one or more Sweat Sensors that are integrated in said footwear.

In some embodiments, said Data Processor is configured to process data that was sensed or measured or estimated by one or more, or a particular combination of, the various sensors of the footwear; and based on such processing, such as by using comparison of sensed/measured values to threshold values or to threshold ranges-of-values, to generate at least one of: (i) a signal indicating an estimated abnormal medical condition of said human wearer, (ii) a signal indicating a command to selectively modify an operational characteristic of at least one component and/or stimulating component and/or sensor of said footwear.

In some embodiments, said footwear is a footwear selected from the group consisting of: casual shoes, formal shoes, dress shoes, athletic shoes, sports shoes, sneaker shoes, footwear formed of leather, footwear formed of rubber, footwear formed of plastic materials, footwear formed of fabric, slip-on shoes, high-heel shoes, mule shoes, sling-back shoes, clogs, platform shoes, sandals, open-toe shoes, closed-toe shoes, boat shoes, slippers, high heel shoes, demi heel shoes, shoes for indoor use, shoes for outdoor use, loafers, flats, boots, rain-boots, ski boots, hiking boots, dance shoes, tap shoes, military shoes, orthopedic shoes, flip-flops.

Some embodiments provide a shoe or other footwear has a non-removable multi-layer insole. For example, a middle layer of the insole has apertures that define several discrete storage chambers within the insole. Each storage chamber stores a mixture of particulate or granular materials, such as sand, powdered titanium, powdered aluminum, powdered talcum, powdered zinc. The insole or footwear further includes integrated components such as: electromyogram (EMG) sensors, temperature sensors, pressure sensors, humidity sensors, sweat sensors. The insole or footwear further includes integrated stimulating units, such as: Transcutaneous Electrical Nerve Stimulation (TENS) units, electrodes, infrared radiation units. Data is sensed by the sensors integrated in the insole or footwear, in response to a human foot stepping on the discrete storage chambers that store the particulate or granular materials, and optionally in response to stimulation operations. Data is processed to detect or estimate a medical condition, and to selectively modify operational properties of the stimulation units.

Functions, operations, components and/or features described herein with reference to one or more embodiments of the present invention, may be combined with, or may be utilized in combination with, one or more other functions, operations, components and/or features described herein with reference to one or more other embodiments of the present invention. The present invention may thus comprise any possible or suitable combinations, re-arrangements, assembly, re-assembly, or other utilization of some or all of the modules or functions or components that are described herein, even if they are discussed in different locations or different chapters of the above discussion, or even if they are shown across different drawings or multiple drawings.

While certain features of some demonstrative embodiments of the present invention have been illustrated and described herein, various modifications, substitutions, changes, and equivalents may occur to those skilled in the art. Accordingly, the claims are intended to cover all such modifications, substitutions, changes, and equivalents.

What is claimed is:

1. A wearable article comprising:

a footwear having an integral and non-removable insole, the insole comprising at least a bottom layer formed of Ethylene-Vinyl Acetate (EVA) polymer, a middle layer formed of Ethylene-Vinyl Acetate (EVA) polymer, and a top layer formed of one or more materials selected from the group consisting of: a co-polymer, a fabric, a textile, a polyether-polyurea copolymer, an elastic plastic layer, an elastomer, a stretchable plastic layer, an elastic rubber layer, a stretchable nylon layer, silicon, silicone, silicon glue, silicone glue;

wherein the middle layer comprises apertures therein;

wherein said apertures in the middle layer, with corresponding portions of the top layer that are above said apertures, and with corresponding portions of the bottom layer that are beneath said apertures, define two or more internal discrete storage chambers within said insole;

wherein each of said internal discrete storage chambers stores therein a mixture of two or more particulate materials which comprise at least:

(i) one or more materials selected from Group A, wherein Group A consists of: natural sand, synthetic sand, artificial sand, kinetic sand, silica, quartz; and (ii) one or more materials selected from Group B, wherein Group B consists of: powdered aluminum, powdered titanium, powdered zinc, powdered magnesia, powdered silver, powdered anti-bacterial agent, powdered metal, powdered talcum, grained cork, grained coal, grained wood, carbon nanotubes, carbon nanofibers, ground carbon, carbon powder, black carbon particles, charcoal particles, graphite, ground graphite, stainless steel powder, stainless steel particles, silicone glue, silicone caulk, Room Temperature Vulcanizing (RTV) silicone;

wherein said footwear comprises:

one or more electromyogram (EMG) sensors, that are integrated in said footwear, and that are configured to sense electrical activity from one or more muscles of a foot of a human wearer of said footwear, in response to stepping on said internal discrete storage chambers that store therein said mixture.

2. The wearable article of claim 1, wherein said footwear further comprises:

one or more Transcutaneous Electrical Nerve Stimulation (TENS) units, that are integrated in said footwear, and that are configured to provide electrical current stimulation to the foot of the human wearer;

wherein the one or more electromyogram (EMG) sensors, that are integrated in said footwear, are configured to sense electrical activity from one or more muscles of the foot, in response to both (I) stepping on said internal discrete storage chambers that store therein said mixture and (II) provision of electrical current stimulation by said one or more TENS units to said foot.

3. The wearable article of claim 2, wherein said footwear further comprises:

one or more Electrodes, that are integrated in said insole, and that are configured to provide electrical current stimulation to the foot of the human wearer;

wherein the one or more Electrodes, that are integrated in said footwear, are configured to sense electrical activity from one or more muscles of the foot, in response to both (I) stepping on said internal discrete storage chambers that store therein said mixture and (II) provision of electrical current stimulation by said one or more Electrodes to said foot.

4. The wearable article of claim 3, wherein said footwear further comprises:

one or more Infrared Radiation Units, that are integrated in said footwear, and that are configured to provide Infrared Radiation stimulation to the foot of the human wearer;

wherein the one or more electromyogram (EMG) sensors, that are integrated in said footwear, are configured to sense electrical activity from one or more muscles of the foot, in response to both (I) stepping on said internal discrete storage chambers that store therein said mixture and (II) provision of electrical current stimulation by said one or more Infrared Radiation Units to said foot.

5. The wearable article of claim 4, wherein said footwear further comprises:

a Stimulant Controller, configured to separately and selectively control one or more operational properties of said one or more TENS units and said one or more Electrodes and said one or more Infrared Radiation Units.

6. The wearable article of claim 4, wherein said footwear further comprises:

a Wireless Transceiver configured to wireless transmit to an external electronic device, over a wireless communication link, data sensed by said one or more electromyogram (EMG) sensors in response to stepping on said internal discrete storage chambers that store therein said mixture.

7. The wearable article of claim 4, wherein said footwear further comprises:

a Wireless Transceiver configured to wireless transmit to an external electronic device, over a wireless communication link, data sensed by said one or more electromyogram (EMG) sensors in response to both (I) stepping on said internal discrete storage chambers that store therein said mixture and (II) provision of electrical current stimulation by an electric stimulation unit of said footwear to said foot.

8. The wearable article of claim 1, wherein said footwear further comprises:

one or more Temperature Sensors that are integrated in said footwear, and that are configured to sense temperature at one or more locations that are in proximity to said foot;

wherein said footwear is operably associated with a Data Processor, that is configured to process both (I) data sensed by the one or more electromyogram (EMG) sensors that are integrated in said footwear, and (II)

data sensed by the one or more Temperature Sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

9. The wearable article of claim 1, wherein said footwear further comprises:

one or more Pressure Sensors that are integrated in said footwear, and that are configured to sense pressure at one or more locations that are in proximity to said foot;

wherein said footwear is operably associated with a Data Processor, that is configured to process both (I) data sensed by the one or more electromyogram (EMG) sensors that are integrated in said footwear, and (II) data sensed by the one or more Pressure Sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

10. The wearable article of claim 1, wherein said footwear further comprises:

one or more Humidity Sensors that are integrated in said footwear, and that are configured to sense humidity at one or more locations that are in proximity to said foot;

wherein said footwear is operably associated with a Data Processor, that is configured to process both (I) data sensed by the one or more electromyogram (EMG) sensors that are integrated in said footwear, and (II) data sensed by the one or more Humidity Sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

11. The wearable article of claim 1, wherein said footwear further comprises:

one or more Electrodermal Activity (EDA)/Galvanic Skin Response (GSR) Sensors that are integrated in said footwear, and that are configured to sense electric conductivity at one or more regions of said foot;

wherein said footwear is operably associated with a Data Processor, that is configured to process both (I) data sensed by the one or more electromyogram (EMG) sensors that are integrated in said footwear, and (II) data sensed by the one or more EDA/GSR Sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

12. The wearable article of claim 1, wherein said footwear is operably associated with a Data Processor, that is configured to process both (I) data sensed by the one or more electromyogram (EMG) sensors in response to stepping on said internal discrete storage chambers that store therein said mixture, and (II) data sensed by one or more other sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

13. The wearable article of claim 1, wherein said Data Processor applies a Machine Learning (ML) algorithm that estimates whether or not said human wearer has a particular medical condition, based on data collected by the one or more electromyogram (EMG) sensors in response to stepping on said internal discrete storage chambers that store therein said mixture.

14. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more other sensors that are integrated in said footwear.

15. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Pressure Sensors that are integrated in said footwear.

16. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Temperature Sensors that are integrated in said footwear.

17. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Humidity Sensors that are integrated in said footwear.

18. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more EDA/GSR Sensors that are integrated in said footwear.

19. The wearable article of claim 1, wherein said Data Processor applies a Machine Learning (ML) algorithm that estimates whether or not said human wearer has a particular medical condition, based cumulatively on (I) data collected by the one or more electromyogram (EMG) sensors in response to stepping on said internal discrete storage chambers that store therein said mixture, and also (II) data sensed by one or more Accelerometers that are integrated in said footwear.

20. The wearable article of claim 1, wherein said footwear further comprises:

one or more Sweat Sensors that are integrated in said footwear, and that are configured to sense sweat at one or more locations that are in proximity to said foot;

wherein said footwear is operably associated with a Data Processor, that is configured to process both (I) data sensed by the one or more electromyogram (EMG) sensors that are integrated in said footwear, and (II) data sensed by the one or more Sweat Sensors that are integrated in said footwear;

wherein said Data Processor is configured to generate at least one of: (i) a signal indicating an estimated abnormal medical condition of said human wearer, (ii) a signal indicating a command to selectively modify an operational characteristic of at least one component of said footwear.

21. The wearable article of claim 1, wherein said footwear is a footwear selected from the group consisting of:

casual shoes, formal shoes, dress shoes, athletic shoes, sports shoes, sneaker shoes, footwear formed of leather, footwear formed of rubber, footwear formed of plastic materials, footwear formed of fabric, slip-on shoes, high-heel shoes, mule shoes, sling-back shoes, clogs, platform shoes, sandals, open-toe shoes, boat shoes, slippers, shoes for indoor use, shoes for outdoor use, boots, rain-boots, ski boots, hiking boots, dance shoes, tap shoes, military shoes, orthopedic shoes, flip-flops.

* * * * *